US006473586B2

(12) United States Patent
Noda et al.

(10) Patent No.: US 6,473,586 B2
(45) Date of Patent: Oct. 29, 2002

(54) DEVELOPING UNIT AND IMAGE FORMING APPARATUS USING THE SAME

(75) Inventors: Akihiko Noda; Shota Oba; Masaaki Yamaura, all of Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/950,701

(22) Filed: Sep. 13, 2001

(65) Prior Publication Data

US 2002/0122677 A1 Sep. 5, 2002

(30) Foreign Application Priority Data

Mar. 2, 2001 (JP) ..... 2001-058012

(51) Int. Cl.[7] ..... G03G 15/09
(52) U.S. Cl. ..... 399/275; 399/267; 399/277
(58) Field of Search ..... 399/53, 267, 274, 399/273, 276, 277, 282, 285, 270, 271

(56) References Cited

U.S. PATENT DOCUMENTS

| | | | | |
|---|---|---|---|---|
| 3,854,449 A | | 12/1974 | Davidson | |
| 3,906,897 A | | 9/1975 | Davidson | |
| 3,940,272 A | | 2/1976 | Davidson | |
| 4,844,008 A | * | 7/1989 | Sakemi et al. | 399/270 |
| 4,851,872 A | * | 7/1989 | Murasaki et al. | 399/276 |
| 4,887,131 A | * | 12/1989 | Kinoshita et al. | |
| 5,044,313 A | * | 9/1991 | Yuge et al. | 399/277 |
| 5,446,526 A | * | 8/1995 | Shimizu | 399/274 |
| 5,517,286 A | * | 5/1996 | Tada et al. | 399/274 |
| 5,576,812 A | * | 11/1996 | Hibino et al. | 399/267 |
| 5,991,585 A | * | 11/1999 | Nakamura et al. | 399/267 |
| 6,078,768 A | * | 6/2000 | Suzuki | 399/267 |
| 6,081,684 A | * | 6/2000 | Naganuma et al. | 399/277 |

FOREIGN PATENT DOCUMENTS

| | | | |
|---|---|---|---|
| JP | 55-3707 B2 | | 1/1980 |
| JP | 58-34469 | | 2/1983 |
| JP | 59-2057 | * | 1/1984 |
| JP | 61-182060 | * | 8/1986 |
| JP | 63-229466 | | 9/1988 |
| JP | 5-119607 | * | 5/1993 |
| JP | 5-289491 | | 11/1993 |
| JP | 5-289520 | | 11/1993 |
| JP | 8-137219 | | 5/1996 |
| JP | 8-278695 | | 10/1996 |
| JP | 10-333431 | | 12/1998 |
| JP | 2000-147903 | | 5/2000 |

* cited by examiner

*Primary Examiner*—Susan S. Y. Lee
(74) *Attorney, Agent, or Firm*—Morgan, Lewis & Bockius LLP

(57) ABSTRACT

In a two-component developing unit, by devising the layout of magnetic poles 6 (particularly a pickup magnetic pole 6*b* and a trimming magnetic pole 6*c*) of a magnet member 5 arranged inside a developer carrier 3, an excess portion of a developer G picked up onto the surface of the developer carrier 3 is allowed to drop in the vicinity of the height of the rotational center O of the developer carrier 3, and only the developer G restricted to a predetermined layer thickness is carried and transported to a development region m. A charging member 9 is disposed over a periphery of the developer carrier 3, as required. In addition, the layout of the magnetic poles 6 of the magnet member 5 arranged inside the developer carrier 3 is set variably between the time of development and the time of nondevelopment, and the amount of developer carried on the surface of the developer carrier and transported to the development region m is set to substantially zero at the time of nondevelopment.

18 Claims, 31 Drawing Sheets

SET POSITION Y OF MAGNET ROLL

SET POSITION X OF MAGNET ROLL

PRIOR ART

PRIOR ART

DEVELOPING UNIT AND IMAGE FORMING APPARATUS USING THE SAME

BACKGROUND OF THE INVENTION

1. Technical Field

The present invention relates to a developing unit for use in an image forming apparatus such as a copying machine, a printer, and the like, and more particularly to improvements of a developing unit using a two-component developer having a magnetic carrier and a toner and an image forming apparatus using the same.

2. Related Art

Generally, development systems used in the electrophotographic process are largely classified into a one-component development system which uses as a developer only a toner constituted by pigment particles and a two-component development system using as the developer one in which magnetic substance particles and a toner constituted by pigmented particles are mixed and agitated.

The one-component development system includes magnetic one-component development using a magnetic toner and a nonmagnetic one-component development using a nonmagnetic toner, and since the magnetic toner does not allow light to transmit therethrough depending on the magnetic powder, the magnetic toner is mainly used as a black toner. Meanwhile, the nonmagnetic toner is suitable for color, but the nonmagnetic toner is currently used principally in low-speed machines in view of the fact that its maintainability is short.

In contrast, since the two-component development system handles the toner with the medium of magnetic substance particles, the two-component development system is able to make use of the magnetically attracting force, handling is facilitated concerning the nonmagnetic toner as well, and it excels particularly in the maintainability. Hence the two-component development system is widely used principally in full-color machines and high-speed machines.

As a conventional developing unit using the two-component development system, one shown in FIG. 33, for example, is generally used.

In the drawing, a developing unit 210 has a development housing 211 with an opening 212 for development formed therein in such a manner as to oppose a latent image carrier 200 such as a photoconductor drum, and development roll 213 serving as a developer carrier is disposed in face-to-face relation to the opening 212 for development, a two-component developer G having a magnetic carrier and a toner is carried on the surface of the development roll 213, and after the thickness of the developer layer is restricted to a predetermined layer thickness by a trimming member 220, an electrostatic latent image on the latent image carrier 200 is converted into a visible image in a development region opposing the latent image carrier 200 of the development roll 213.

Here, the development roll 213 has a development sleeve 214 disposed rotatably so as to rotate, for example, from the upper side toward the lower side in a development region, as well as a magnet member 215 which is fixedly provided inside the development sleeve 214 and in the periphery of which a plurality of magnetic poles 216 are arranged. As the layout of the magnetic poles 216 of the magnet member 215, a development magnetic pole 216 is disposed at a position corresponding to the development region, fixed magnetic poles 216*b* to 216*e* are disposed in the order of an S pole, an N pole, an N pole, and an S pole on the downstream side, in the rotating direction of the development sleeve 214, of the development magnetic pole 215*a* (e.g., N pole). A portion in which the magnetically attracting force is weak or nil is secured midway between the fixed magnetic poles 216*c* and 216*d* of the same polarity, and the fixed magnetic pole 216*d* is disposed before the trimming member 220, thereby allowing the fixed magnetic pole 216*d* to function as a pickup magnetic pole for capturing the developer.

Further, in this example, a transport paddle 221 which rotates in a direction opposite to the rotating direction of the development roll 213 is disposed at a position adjacent to the development roll 213 inside the development housing 211, e.g., at an opposing portion. Furthermore, a pair of screw augers 222 and 223 for agitating and mixing the developer and circulatingly transporting the developer are disposed on the inner side behind it.

In such a developing unit, the magnetically attracting force acts inside the development roll 213 by the distribution of the magnetic force of the magnet member 215 inside it. The developer G agitated and mixed by the screw augers 222 and 223 is carried and transported on the surface of the development roll 213 by the magnetically attracting force, and after it is restricted to a predetermined layer thickness by the trimming member 220, the developer G reaches the development region, and develops an electrostatic latent image on the latent image carrier 200.

Then, the developer G which lost part of the toner upon completion of development is transported to the downstream side of the development roll 213. However, since a portion in which the magnetically attracting force is weak or nil is formed midway between the fixed magnetic poles 216*c* and 216*d* of the same polarity, the transported developer G drops from the surface of the development roll 213 due to the action of the gravity.

Subsequently, the dropped developer G is transported to the screw auger 222 by the transport paddle 221, is further transported in the direction of the axis of rotation of the screw auger 222 and is delivered to the screw auger 223 at an unillustrated delivery section. Even if, for instance, a fresh toner is added there, the added developer G, while being agitated by the screw auger 223, is sent in a direction opposite to the screw auger 222, is delivered again to the screw auger 222 at an opposite delivery section and is transported in the axial direction. At the same time, this developer G is gradually supplied to the vicinity of the development roll 213 by the transport paddle 221.

In this state, the supplied developer adheres to the surface of the development roll 213 by the magnetically attracting force, and the processes in which the developer is subjected to transport, layer formation, and development are repeated again.

Incidentally, in the two-component development system, the attraction between the toner and the carrier making up the developer makes use of the fact that they electrostatically attract each other as a result of the fact that the surfaces of the toner and the carrier respectively charged to mutually opposite polarities by the frictional charging at the time when the toner and the carrier are agitated and mixed. For this reason, it becomes necessary to agitate and mix the developer replenished with the toner, as described above, while the developer is being transported.

In addition, in the development region, it is necessary to control the rate of developer transported within a fixed range so that the developer passes that region with a sufficient amount and does not cause clogging or the like in making contribution to development. For this reason, a method is adopted in which the trimming member is provided to forming the thickness of the developer layer to a predetermined thickness.

Further, in the development region, since the toner in the developer is developed by an electric field formed between the latent image carrier and the developer on the development roll, a development bias voltage is generally applied to the development roll.

The quantity of toner developed at that time is most important among various characteristics that concern the image quality, since it determines the image density. Since the quantity of development toner is determined by neutralizing the electric field in the aforementioned development region by the charge of the toner, it is very important to maintain the charge of the toner to a fixed level.

In the two-component development system, as shown in FIG. 34, the density of the toner in the developer and the amount of toner charge are in an inversely proportional relationship, so that the amount of toner charge can be set to a substantially fixed level by controlling the toner density by adjusting the rate of toner consumption and the rate of replenishing the toner.

[Problems to be Solved]

In the developing unit of this type, as the processes of agitation/mixing, layer formation, and development are repeated in the two-component development system, the developer becomes deteriorated, and the charging capability of the developer declines.

Under such a situation, with the two-component development system which is used for long periods of time, the toner density must be gradually controlled to a low level so as to set the quantity of development toner to a fixed level. However, if the toner density becomes lower than a certain limit, the probability of presence of the toner on the developer surface becomes low, a streaky pattern, which is called a brush mark, occurs on the developed image, thereby possibly exerting an adverse effect on the image quality.

In addition, although the charge of the toner inevitably has a certain degree of distribution, if the amount of toner charged declines with the use of the developer over long periods of time, in the distribution there occur toners which have not been charged or have been charged with an opposite polarity. In this case, the uncharged toner and the toner charged with the opposite polarity are likely to be developed in background portions of the image, and there is hence a possibility of causing so-called fogging.

Furthermore, if the carrier deteriorates with the use of the developer over long periods of time, a situation can occur in which the resistance of the carrier declines. However, when the resistance of the carrier is low to some extent, there is a possibility of the occurrence of so-called carry-over in which the carrier adheres to the latent image carrier side because the electrostatically attracting force between the carrier and the latent image carrier becomes stronger than the magnetically attracting force as the charge is injected from the development roll.

At this time, since the particle size of the carrier is generally quite large and hard as compared with the toner, a faulty close-contact area is formed between the latent image carrier and the recording material which is a sheet to be transferred to is formed in a transfer station. Faulty transfer occurs in this faulty close-contact area, and there is the possibility that blanking with the carrier serving as a nucleus can occur in the transferred image.

Thus, since various problems occur if the developer deteriorates, various techniques have been proposed for minimizing the deterioration of the developer and prolonging the life of the developer.

For example, as a means for reducing the stress in the developer caused by the trimming member, there have been proposed, among others, a method in which the magnetic flux density of the magnetic pole opposing the trimming member is lowered to weaken the magnetically attracting force so as to weaken the pressure applied to the developer (e.g., the Unexamined Japanese Patent Application Publication No. Hei8-278695) and a method in which the trimming member is formed in two stages in such a manner as to sandwich the opposing magnetic pole inside the development roll so as to reduce the stress applied to the developer (e.g., the Unexamined Japanese Patent Application Publication No. Hei10-333431). In each of these proposed methods, however, since a developer pool is generated on the upstream side of the trimming member, and unnecessary pressure is applied to the developer, it has not been successful to prolong the life of the developer substantially.

On the other hand, the life of the developer can be prolonged by increasing the quantity of the carrier used in total, but this results in an increase in cost. Namely, the life of the developer in the two-component development system has been an obstacle in lowering the cost.

Thus, with the two-component developing unit, a major technical problem (a first technical problem) has been how the thickness of the developer layer carried on the developer carrier can be accurately restricted without imparting undue stresses to the developer.

In addition, in, for example, a four-cycle type image forming apparatus, four developing units of yellow, magenta, cyan, and black are disposed around a latent image carrier such as a photoconductor drum, and respective color-component electrostatic latent images on the latent image carrier are developed and made visible and are consecutively multi-transferred onto an intermediate transfer member, thereby forming a color image.

With the four-cycle type image forming apparatus of this type, in a case where the developer is present on the development roll by being in contact with the latent image carrier in the developing units at the time of nondevelopment as well (e.g., developing units of magenta, cyan, and black at the time of the development of a yellow color), since the developer is in contact with the surface of the latent image carrier, there are technical problems in that the developed image on the upstream side may be destroyed by a downstream-side multi-color development brush, and that so-called color mixing can occur in which the toner of another color is mixed in an image of a specific color (e.g., a yellow image).

As prior art for overcoming the technical problems of this type, a proposal has already been proposed in which, for example, the developing units are retracted from the latent image carrier at the time of nondevelopment (e.g., the Examined Japanese Patent Application Publication No. Sho55-3707).

This technique, however, is not desirable since various problems are involved in such as that because the developer is magnetically erect in the development region, the developing units need to move a substantial distance in order to be set in a noncontact state, and it takes time correspondingly, that vibrations occur during retraction, and that the retracting mechanism is complex, making it difficult to render the units compact and lower the cost.

Accordingly, as prior art which does not use such a retracting mechanism, there have been proposed a technique in which the developer on the developer carrier is forcibly scraped and separated by a developer separator (e.g., a blade) (e.g., the Unexamined Japanese Patent Application Publication No. Sho58-34469), as well as a technique in which, in a development roll having a magnet roll disposed inside a rotatable development sleeve, a pair of magnetic poles of the same polarity are formed in an outer periphery of the magnet roll, and during development a magnetic-force declining portion of the pair of magnetic poles of the same polarity is set on the downstream side of the trimming member and on the upstream side of the development region, while during nondevelopment the magnetic-force declining portion is set at a portion opposing the trimming member, so as to block the transport of the developer to the downstream side of the trimming member during nondevelopment (e.g., the Unexamined Japanese Patent Application Publication No. Hei5-289520).

However, in the case where the developer separators of the above-described prior art are used, large stresses are applied to the developer at the time of separation of the developer, so that it cannot be said that such a technique is desirable in terms of the prolongation of the life of the developer.

In addition, in the case of the latter prior art as well, a developer pool is generated on the upstream side of the trimming member during both development and nondevelopment, and exerts unnecessary pressure to the developer, so that this technique cannot be said to be preferable in terms of the prolongation of the developer.

Meanwhile, as other prior art which does not use the retracting mechanism and does not apply large stresses to the developer, the following techniques are known, for example: A technique in which the supply to the developer carrier is stopped by stopping the rotation of an auxiliary fixed magnet for supplying the developer to the developer carrier (e.g., the Unexamined Japanese Patent Application Publication No. Sho63-229466); a technique in which, in a development roll having a fixed magnet roll (provided with a pair of magnetic poles of the same polarity among its magnetic poles) disposed inside a rotatable development sleeve, the developer on the development roll is caused to drop at the point of time when it has passed the pair of magnetic poles of the same polarity of the magnet roll by reversely rotating the development sleeve at the time of nondevelopment, to thereby prevent the developer from being held on the development roll in the development region (e.g., the Examined Japanese Patent Application Publication No. Hei6-25880); and a technique in which the positions of magnetic poles are changed by rotating the magnet roll inside the development sleeve at the time of nondevelopment, and a portion between the pair of adjacent magnetic poles is disposed in such a manner as to oppose the latent image carrier, so as to suppress so-called color mixing (e.g., the Unexamined Japanese Patent Application Publication No. Hei5-289491).

However, with the above-described first prior art (the Unexamined Japanese Patent Application Publication No. Sho63-229466), even if the developer is not supplied to the developer carrier by the auxiliary fixed magnet, if the developer carrier rotates, there is a possibility of the developer becoming carried by the distribution of the magnetic forces on the developer carrier side, so that it is difficult to completely avoid color mixing.

Further, with the above-described second prior art (the Examined Japanese Patent Application Publication No. Hei6-25880), in the case where a plurality of developing units are rotated by one driving motor, it is inevitable to additionally install a large number of components such as clutches and gears, so that the configuration of the drive system becomes wastefully complex.

Furthermore, with the above-described third prior art (the Unexamined Japanese Patent Application Publication No. Hei5-289491), since the developer layer on the developer carrier in the development region is merely in a state in which its spikes are laid, and not in a state in which the developer layer is completely removed, it is difficult to completely prevent the so-called color mixing in a case where the gap between the developer carrier and the latent image carrier is small.

Thus, with, for example, the four-cycle type image forming apparatus, a major technical problem (a second technical problem) has been how the amount of developer carried on the developer carrier is adjusted to zero without imparting undue stresses to the developer during nondevelopment, i.e., how adjustment is to be made into a state in which the developer is not supplied to the development region.

It should be noted that such a technical problem similarly occurs with a type in which a plurality of color-component toner images are formed on a common latent image carrier as with a tandem two-cycle type image forming apparatus.

The invention has been devised to overcome the above-described first technical problem, and its object is to provide a developing unit capable of accurately restricting the thickness of the developer layer carried on the developer carrier without imparting undue stresses to the developer at the time of development, as well as an image forming apparatus using the same.

In addition, the invention has been devised to overcome the above-described second technical problem, and its another object is to provide a developing unit capable of restricting to substantially zero the thickness of the developer layer carried on the developer carrier without imparting undue stresses to the developer at the time of nondevelopment, as well as an image forming apparatus using the same.

[Means for Solving the Problems]

Namely, to overcome the first technical problem (restriction of the thickness of the developer layer at the time of development), in accordance with the invention, as shown in FIG. 1, there is provided a developing unit which has a development housing 2 with an opening 2*a* for development formed therein in such a manner as to oppose a latent image carrier 1, and in which a developer carrier 3 is disposed in face-to-face relation to the opening 2*a* for development, and a two-component developer G having a magnetic carrier and a toner is carried on a surface of the developer carrier 3, so as to convert an electrostatic latent image on the latent image carrier 1 into a visible image in a development region m opposing the latent image carrier 1 of the developer carrier 3, characterized in that the developer carrier 3 is provided with a development sleeve 4 for carrying the two-component developer G and disposed rotatably so as to rotate from an upper side toward a lower side in the development region m as well as a magnet member 5 which is fixedly provided inside the development sleeve 4 and in a periphery of which a plurality of magnetic poles 6 are arranged, and that the magnet member 5 is provided with a development magnetic pole 6*a* disposed at a position corresponding to the development region m and contributing to development, a pickup magnetic pole 6*b* disposed in a region which is located on a lower side than the height of a rotational center O of the development sleeve 4 in a region where the development sleeve 4 in terms of its rotating direction is headed from the lower side toward the upper side, and adapted to capture the developer G inside the development housing 2 onto a surface of the development sleeve 4, and a trimming magnetic pole 6*c* disposed on a downstream side, in the rotating direction of the development sleeve 4, of the pickup magnetic pole 6*b* and adapted to restrict a developer layer into a predetermined thickness by causing an excess portion of the developer captured by the pickup magnetic pole 6*b* to drop in a vicinity of the height of the rotational center O of the development sleeve 4 and thereby causing only a necessary amount of the developer G to be carried.

In the above-described technical means, the developer carrier 3 may be selected as required insofar as it is provided with the rotatable development sleeve 4 which rotates from the upper side toward the lower side in the development region m, and the magnet member 5 is fixedly provided inside the development sleeve 4.

In such a case, the magnetic member 5 may be selected as required insofar as it is provided with the plurality of magnetic poles 6. However, to allow the magnet forces from the magnetic poles 6 to uniformly act on the surface of the development sleeve 4, it is preferable to provide the magnetic poles 6 in outer peripheral portions of the roll-like member or to adopt a technique in which the outer peripheral portions of the roll-like member are magnetized to predetermined magnetic forces by an unillustrated magnetizer.

In addition, of the magnetic poles 6 of the magnet member 5, the development magnetic pole 6*a* may be of a single-piece configuration or a multiple-piece configuration insofar as it contributes to development. In the mode of the multiple-piece configuration, an appropriate arrangement may be selected as required. For example, one of the development magnetic poles 6*a* maybe disposed in such a manner as to oppose a central portion of the development region m, or may be opposingly disposed at a position offset from the center of the development region m. Alternatively, portions between adjacent ones of the plurality of magnetic poles may be disposed in such a manner as to oppose the central portion of the development region m.

Further, the pickup magnetic pole 6*b* may be of a single-piece configuration or a multiple-piece configuration insofar as it has the function of being capable of capturing the developer G on the lower side than the height of the rotational center O of the development sleeve 4. However, it is necessary for the amount of development captured to be greater than the required amount carried on the developer carrier 3.

Furthermore, the trimming magnetic pole 6*c* may be either of a single-piece configuration or of a multiple-piece configuration insofar as it is disposed on the downstream side, in the rotating direction of the development sleeve 4, of the pickup magnetic pole 6*b,* and exhibits the action of magnetic force for restricting only a necessary amount of developer in the vicinity of the height of the rotational center O of the development sleeve 4.

Here, a description will be given of the preferred forms of the invention. It is preferred that the trimming magnetic pole 6*c* be set to have a weaker magnetic field than the pickup magnetic pole 6*b* in view of the ease of formation of the magnetic force distribution whereby an excess portion of the developer G captured by the pickup magnetic pole 6*b* is caused to drop reliably in the vicinity of the height of the rotational center O of the development sleeve 4.

Nevertheless, even if the trimming magnetic pole 6*c* has a stronger magnetic field than the pickup magnetic pole 6*b,* if a mode is adopted in which the trimming magnetic pole 6*c* is sufficiently spaced apart from the height of the rotational center O of the development sleeve 4, it is possible to appropriately adjust the magnetic field distribution in the vicinity of the height of the rotational center O of the development sleeve 4.

In addition, although the layout of the trimming magnetic pole 6*c* may be selected as required, from the viewpoint of the ease with which the trimming action (the action of restricting the developer layer thickness) of the trimming magnetic pole 6*c* can be demonstrated, the trimming magnetic pole 6*c* should preferably be disposed at a position higher than the height of the rotational center O of the development sleeve 4.

Further, to reliably transport to the development region m the developer G with its layer thickness restricted by the trimming magnetic pole 6*c,* the magnet member 5 may preferably have a transporting magnetic pole 6*d* disposed between the trimming magnetic pole 6*c* and the development magnetic pole 6*a* in the rotating direction of the development sleeve 4 and adapted to transport the developer with its layer thickness restricted by the trimming magnetic pole 6*c*.

Furthermore, in a case where it is desirable to temporarily separate the developer G on the developer carrier 3 before capturing the developer G by the pickup magnetic pole 6*b,* a pair of magnetic poles of the same polarity (not shown) for separating the developer G may be provided on the downstream side, in the rotating direction of the development sleeve 4, of the development region m. In this case, the downstream-side magnetic pole of the pair of magnetic poles of the same polarity may be used as the pickup magnetic pole 6*a*.

In addition, in the invention, it goes without saying that the developing unit may be provided with various measures.

For example, as a mode which makes it possible to increase the efficiency of replacing the developer G, it is possible to cite a mode in which a dropping assisting mechanism is provided for causing an excess portion of the developer G captured on the surface of the development sleeve 4 by the pickup magnetic pole 6*b* to drop on the lower side than the height of the rotational center O of the development sleeve 4.

In this mode, the developer G which was deprived of its toner can be temporarily moved away from the developer carrier 3 to be replenished with the toner, and the developer G replenished with the toner can be supplied again to the developer carrier 3. Therefore, this mode is effective in continuously performing development at a high area ratio.

Further, in this embodiment, since the developing unit is arranged that the layer thickness of the developer G on the developer carrier 3 is restricted by the trimming magnetic pole 6*c,* it is unnecessary to separately provide a layer-thickness restricting member (trimming member) at a position opposing the developer carrier 3.

However, from the viewpoint of avoiding the leakage of the developer from the development housing 2 as much as possible, a sealing member 7 for sealing a gap between the development housing 2 and the developer G layer should preferably be provided over a periphery of the developer carrier 3 on which the developer G with its layer thickness restricted by the trimming magnetic pole 6*c* is transported to the development region m.

This sealing member 7 may be selected as required by such as forming an edge of the opening 2 for development in the development housing 2 into a preferred shape, or separately providing the sealing member inside the development housing 2.

The sealing member 7 referred to herein means not a trimming member but one which at least does not cause the developer G to drop from the developer carrier 3 by blocking the developer G. Further, in the mode in which the trimming member also serves as a seal on the upstream side of the development region as in a conventional developing unit, at an outlet of the developer where the developer is blocked by the trimming member and a layer is formed, a toner cloud is relatively prone to occur since the developer which was subjected to the force is released. In the invention, however, since a large force is not applied to the developer G, the amount of toner cloud generated at the output of the sealing member 7 is suppressed.

Furthermore, to accurately restrict the layer thickness of the developer G on the developer carrier 3, as its precondition it becomes necessary to supply a sufficient amount of developer G to the pickup magnetic pole 6*b* of the developer carrier 3.

Accordingly, as an effective mode in supplying a sufficient amount of developer G to the pickup magnetic pole 6*b*, it is possible to cite a mode in which a developer supplying member (not shown) for supplying the developer G is disposed inside the development housing 2 at a portion of the developer carrier 3 corresponding to the pickup magnetic pole 6*b*.

Additionally, from the viewpoint of satisfactorily maintaining the charging properties of the developer, an agitating member (notshown) for agitating the developer G should preferably be disposed in the development housing 2.

In addition, the layout of the magnetic poles 6 of the magnet member 5 may be selected as required insofar as the aforementioned development magnetic pole 6*a*, pickup magnetic pole 6*b*, and trimming magnetic pole 6*c* are included. However, from the viewpoint of enhancing the degree of freedom of locating the position where the development region m is provided, the magnet member 5 is preferably one in which magnetic poles 6 of different polarities are arranged alternately.

According to this mode, the degree of freedom in the layout of the position where the development region m is provided can be enhanced by the portion in which the pair of magnetic poles of the same polarity need not be provided on the downstream side of the development region m.

In addition, from the viewpoint of making the developing unit compact, only the developer carrier 3 should preferably be disposed in the development housing 2.

Further, to satisfactorily maintain the circulating properties of the developer G inside the development housing 2, the development housing 2 should preferably have a guide portion (not shown) for guiding the developer G dropping from the developer carrier 3 toward a developer storage section.

This guide portion includes, for instance, an inclined portion which allows the developer G to move toward the developer storage section by its own weight.

It should be noted that although the developer storage section refers to a portion where the developer G is stored, it goes without saying that an agitating member for the developer G, a developer supplying member, and the like may be provided.

In addition, as described above, the developing unit in accordance with the invention is so arranged that the layer thickness of the developer G on the developer carrier 3 is restricted by the trimming magnetic pole 6*c*, so that it becomes unnecessary to separately provide a layer-thickness restricting member (trimming member) at a position opposing the developer carrier 3. However, to maintain more satisfactorily the state of the developer G layer being transported to the development region m, a leveling member 8 for leveling the developer G layer should preferably be provided over a periphery of the developer carrier 3 on which the developer G with this layer thickness restricted by the trimming magnetic pole 6*c* is transported to the development region m.

Here, the leveling member 8 is sufficient if it has the function of leveling the developer G layer, and the leveling member 8 includes one which blocks a portion of the developer. Nevertheless, to reliably suppress the stresses to the developer G, it is preferable to eliminate the function of blocking the developer G.

Further, in the invention, an agitating member such as a screw auger for agitating the developer G is, to be sure, effective in enhancing the charging properties of the developer G. On the other hand, there is a drawback in that the life of the developer G is shortened since the developer G is forcibly agitated. For example, in the case where the screw auger is used, it is absolutely necessary to dispose two screw augers in two directions so that the developer will not be offset. However, in this returning section, since the direction is changed by applying pressure to the group of developers, the life of the developer is shortened. If an attempt is made to make this arrangement smooth, it leads to a large-size unit and higher cost.

Meanwhile, since a conventional trimming member need not be disposed over the periphery of the developer carrier 3, it is possible to make use of the space for installation of this trimming member.

Accordingly, from the viewpoint of minimizing the agitating member for the developer G or of disusing it, a charging member 9 for charging the developer G should preferably be provided over a periphery of the developer carrier 3 on which the developer G with this layer thickness restricted by the trimming magnetic pole 6*c* is transported to the development region m.

Here, as a preferable form of the charging member 9, it is possible to cite one in which the charging member 9 is formed by a charging projecting member for charging the developer G without causing the developer G to drop in a direction opposite to the rotating direction of the developer carrier 3.

This charging projecting member which is the charging member 9 is disposed continuously or discontinuously along the rotating direction of the developer carrier 3, charges the layer of the passing developer G while imparting turbulence thereto, and is preferred because the charging efficiency is high.

In addition, the charging member 9 suffices if it exhibits charging action based on friction with the layer of the developer G which passes, but a charging electric field may be caused to act in the charging member 9.

As a preferred form of the charging electric field at this time, it suffices if an alternating electric field is formed in a region where the charging member 9 and the developer carrier 3 are opposed to each other.

In addition, in the mode in which the charging member 9 is provided over the periphery of the developer carrier 3, since the surface of the developer G layer is somewhat disturbed when the developer G layer passes through the charging member 9, the leveling member 8 for leveling the developer G layer should preferably be provided on the downstream side, in the rotating direction of the developer carrier 3, of the charging member 9.

However, if the magnetic pole 6 such as the transporting magnetic pole 6*d* is provided on the downstream side, in the rotating direction of the developer carrier 3, of the charging member 9 before the development region m, the developer G layer, when passing by the transporting magnetic pole 6*d*, is leveled to some extent in accordance with the distribution of magnetic force from the transporting magnetic pole 6*d*, the leveling member 8 is not essentially required.

Next, by way of comparison it will be described that a developing unit in accordance with a comparative model shown in FIG. 33 (having a trimming member 220) is not preferable for the life of the developer, and that the developing unit in accordance with the invention shown in FIG. 1 is preferable for the life of the developer.

According to studies conducted by the present inventors, a decline in the charging capability of the developer, which constitutes a major cause of the decline in the life of the developer, is due to a decline in the charging capability of the carrier.

Namely, the present inventors confirmed that the effective charging surface area of the carrier decreases as toner-side components, i.e., a binder for the toner, external additives used on the toner surfaces for the purpose of charging control and securing fluidity, and the like, become fixed to the carrier surfaces.

In addition, the cause of occurrence of the above-described fixation of the toner-side components to the carrier surfaces is that the toner and the carrier are coupled to each other through frictional charging. When the degree of fixation of the toner-side components to the carrier surfaces was examined by shutting off the transfer of the developer between the respective sections and by independently moving the developer in order to examine in which section of the developing unit the effect is strong, it was found that the formation of the layer by the trimming member contributes most greatly.

The pressure in the section for forming the layer by using the trimming member 220 was considered as shown in FIG. 35.

To cut off the spikes smoothly with respect to the developer G layer on a development roll 213, the trimming member 220 is disposed slightly downstream of a fixed magnetic pole (e.g., 216*d*). When the developer G is blocked by the trimming member 220 and the state is set in a steady state, a large amount of developer G is held on the upstream side of the trimming member 220 by the fixed magnetic pole 216*d*. From this large quantity of the group of developer G, part of the developer G on a development sleeve 214 side passes in the form of a layer through the gap between the trimming member 220 and the development roll 213.

At this time, at a boundary portion (indicated by a dotted line in FIG. 35) between the developer G which slips through and the developer G which remains, a magnetically attracting force F acts due to the magnetization of the developer G located outwardly of the boundary portion. Namely, the greater the amount of developer G held, the stronger this magnetically attracting force F. Further, the force obtained by multiplying that magnetically attracting force F by the coefficient of friction at the boundary portion becomes a transporting force S (frictional force) at the boundary portion. Accordingly, the greater the amount of developer G held on the upstream side of the trimming member 220, the greater the transporting force S and the greater the area of the boundary portion where the frictional force S acts. Further, the group of developer G is pressed by the trimming member 220 and is thereby subjected to large pressure.

It is conceivable that the deterioration of the developer G is promoted by the accumulation of the large quantity of developer G on the upstream side of the trimming member 220 in the above-described manner.

Here, although the accumulation of the large quantity of developer G can be prevented by setting to a small level the magnetic flux density of the fixed magnetic pole 216*d* on the upstream side of the trimming member 220, the situation in which the layer forming operation is made unstable is unavoidable.

Namely, since the developer G supplied to the development roll 213 is subjected to the effect of, for instance, the pitches of blades of a transport paddle 221 and screw augers 222 and 223 (see FIG. 33) for supplying the developer G, if the amount of accumulation of the developer G layer on the upstream side of the trimming member 220 is small, the effect directly appears in the developer G layer and, hence, in the image.

For this reason, it can be understood that the accumulation of the developer G before the trimming member 220 contributes to the stabilization of the layer forming operation.

Accordingly, in the invention, in view of these circumstances, a method for effecting the layer formation without using the trimming member 220 was newly devised.

Namely, in the invention, as shown in FIG. 3, the layout of the magnetic poles 6 of the magnet member 5 is so devised that after the developer G is captured at a portion of the developer carrier 3 corresponding to the pickup magnetic pole 6*b*, the excess developer G which cannot be held on the developer carrier 3 by the magnetically attracting force is allowed to drop in the section leading to the trimming magnetic pole 6*c* so as to hold a necessary amount of developer G.

In accordance with this mode, the fixation of the toner component to the carrier can be suppressed as much as possible since there is no portion where the developer G slips through with friction and a large quantity of developer G attached to the fixed magnetic pole 216*d* (a strong magnetic field portion) is not pressed strongly against the trimming member 220 as is the case with the comparative model using the trimming member 220 for forming the layer.

Here, if detailed consideration is given to the process of transporting the developer G with reference to FIG. 3, it is considered that the force for transporting the developer mainly consists of the magnetically attracting force of the developer carrier 3, the coefficient of friction between the developer carrier 3 and the developer G, the coefficient of friction between the particles of the developer G, gravity, and inertial force. Of these elements, description of the magnetically attracting force and the inertial force will be omitted for the sake of simplicity because the magnetically attracting force in the tangential direction of the developer carrier 3 is complicated since it differs depending on the positional relationship between the developer G and the magnetic poles 6, because the inertial force is complicated since it differs depending on the rotating speed and diameter of the developer carrier 3, and because no discrepancy arises even if these elements are ignored in a general explanation in comparison with an actual phenomenon.

Now, on the surface of the developer carrier 3 corresponding to the pickup magnetic pole 6*b*, the gravity and a vertical component (shown by a thin line in the drawing) of the magnetically attracting force acting in the normal direction are balanced on the surface of the group of the developer G, as shown in a portion A in FIG. 3.

Subsequently, when the developer G held in the vicinity of the surface of the developer carrier 3 is transported to a height (a portion B in FIG. 3) substantially identical to the position of the rotational center O of the developer carrier 3 from the portion of the pickup magnetic pole 6*b* (a portion A' in FIG. 3), the magnetically attracting force is considerably weak.

At this time, the forces for upwardly transporting the developer G are the magnetically attracting force and the frictional force based on the coefficient of friction, and since the magnetically attracting force has become weak, the position where this frictional force and the gravity are balanced is located on the inner side of the developer G layer as compared with the position on the pickup magnetic pole 6*b*. Consequently, the developer G located outwardly thereof drops from the developer carrier 3 (the portion B in FIG. 3).

As a result, the developer G is restricted to a predetermined layer thickness in the vicinity of the height of the rotational center O of the developer carrier 3.

When the developer G is further transported upwardly, as shown in a portion C in FIG. 3, the component of the gravity normal to the developer carrier 3 becomes oriented toward the developer carrier 3, so that the force acting in the tangential direction of the developer carrier 3 (the force for transporting the developer G), which is obtained by multiplying the sum of this force and the magnetically attracting force by the coefficient of friction of the developer G, increases.

At this time, if the force for transporting the developer G is lower than the tangential component of the gravity, the developer G drops, and if it is not lower, the developer G does not drop.

Here, in order for the transporting the developer G to be lower than the tangential component of the gravity, it is necessary that the magnetically attracting force has dropped more than the component of the gravity normal to the developer carrier 3 has increased in comparison with the portion B in FIG. 3. Unless such a situation occurs, the developer G is transported to the development region m as it is with the predetermined layer thickness without dropping from the developer carrier 3.

Accordingly, in order to form the developer G into a thin layer of a predetermined thickness on the developer carrier 3 in the section leading from the pickup magnetic pole 6*b* to the trimming magnetic pole 6*c*, it is preferable to make the design so that the excess developer G drops in the vicinity of the height of the rotational center O of the developer carrier 3. For this purpose, it is necessary for the pickup magnetic pole 6*b* to be located on the lower side than the position of the rotational center O of the developer carrier 3.

In addition, major factors for determining this condition of layer formation are the intensities of and the positional relationship between the magnetic poles 6, particularly the pickup magnetic pole 6*b* and the trimming magnetic pole 6*c*. Other factors contributing to the condition of the layer formation include, among others, the surface roughness of the developer carrier 3, the coefficient of internal friction or the fluidity of the developer G, the diameter and rotating speed of the developer carrier 3. To obtain a more desirable developer G layer, it is necessary to make adjustment with respect to these factors as well.

It should be noted that although, of the applications filed by the present applicant, a technique similar to the invention of this case has been filed as an earlier application, it is supplementarily stated here that that technique is different in the concept from this case.

Namely, the above-described earlier application (the Japanese Patent Application No. Hei11-281199) is characterized in that "the magnetic force and magnetic force distribution of the magnetic-field generating means in the pickup region and the transport region are set such that a difference between the amount of developer picked up onto the development roll in the pickup region and the amount of developer dropping from the development roll in the transport region constitutes a necessary amount of developer required in the development region."

This earlier application is premised on the fact that the respective functions (pickup, transport, and development) in the respective regions are demonstrated by setting the magnetic force and the magnetic force distribution in each region (pickup region, transport region, and development region). In addition, the amount of developer dropping in the transport region mainly refers to the developer which drops when it is leveled by a leveling member. Therefore, this earlier application differs in the concept from the characteristic feature of the invention of this case: "a trimming magnetic pole disposed on a downstream side, in the rotating direction of the development sleeve, of the pickup magnetic pole and adapted to restrict a developer layer into a predetermined thickness by causing an excess portion of the developer captured by the pickup magnetic pole to drop in a vicinity of the height of the rotational center of the development sleeve and thereby causing only a necessary amount of the developer to be carried."

In addition, to overcome the above-described second technical problem (restriction of the thickness of the developer layer at the time of nondevelopment), in accordance with the invention, it suffices if, as shown in FIG. 2, there is provided a developing unit which has a development housing 2 with an opening 2*a* for development formed therein in such a manner as to oppose a latent image carrier 1, and in which a developer carrier 3 is disposed in face-to-face relation to the opening 2*a* for development, and a two-component developer G having a magnetic carrier and a toner is carried on a surface of the developer carrier 3, so as to convert an electrostatic latent image on the latent image carrier 1 into a visible image in a development region m opposing the latent image carrier 1 of the developer carrier 3, characterized in that the developer carrier 3 is provided with a development sleeve 4 for carrying the two-component developer G and disposed rotatably so as to rotate from an upper side toward a lower side in the development region m as well as a magnet member 5 which is fixedly provided inside the development sleeve 4 and in a periphery of which a plurality of magnetic poles 6 are arranged, and that the magnet member 5 is so arranged that the layout of the magnetic poles is set variably between the time of development and the time of nondevelopment, and the amount of developer transported to the development region m while being carried on the surface of the developer carrier 3 is set to substantially zero at the time of nondevelopment.

In such a technical means, the layout of the magnetic poles of the magnet member 5 at the time of development is not particularly limited, and an appropriate layout may be selected insofar as, at the time of nondevelopment, the layout of the magnetic poles changes to one in which the amount of development carried on the surface of the developer carrier 3 and transported to the development region m is set to substantially zero.

In addition, invariably setting the layout of the magnetic poles between the time of development and the time of nondevelopment, the entire magnet member 5 may be moved, or some magnetic poles 6 may be moved.

Further, as the layout of the magnetic poles at the time of nondevelopment, a mode may be adopted in which the amount itself of developer G picked up onto the developer carrier 3 is set to substantially zero, or a mode may be alternatively adopted in which the developer g is temporarily picked up onto the developer carrier 3, but all the developer G picked up is caused to drop.

Here, as the former layout of the magnetic poles at the time of nondevelopment, in a mode in which, for example, the magnet member 5 is provided with repellent magnetic poles (a pair of magnetic poles of the same polarity) for separating the remaining developer, it is possible to cite a mode in which the pair of magnetic poles of the same polarity are moved to a position corresponding to the pickup region for picking up onto the developer carrier 3, and the amount itself of developer G picked up onto the developer carrier 3 is set to substantially zero.

In addition, as the latter layout of the magnetic poles at the time of nondevelopment, in the case where the layout of the magnetic poles at the time of development is the same as the mode shown in FIG. 1 (development magnetic pole 6*a*, pickup magnetic pole 6*b*, and trimming magnetic pole 6*c*), it is possible to cite a mode in which, as shown in FIG. 2, by making use of the fact that the amount of the layer thickness of the developer G restricted differs due to the positional change of at least the trimming magnetic pole 6*c*, the amount of the layer thickness of the developer G restricted is set to substantially zero by moving the position of the trimming magnetic pole 6*c*.

In particular, the latter example of the layout of the magnetic poles at the time of nondevelopment is preferable in that, by variably setting the layout of the magnetic poles, the developer with its layer thickness restricted can be supplied to the developer carrier 3 at the time of development, and the supply of the developer can be stopped at the time of nondevelopment.

In addition, in the mode in which the position of at least the trimming magnetic pole 6*c* is variably set, it suffices if, at the time of nondevelopment, the trimming magnetic pole 6*c* is displaced more on the upstream side in the rotating direction of the development sleeve 4 than the position used at the time of development.

In this case, since the range of change of the trimming magnetic pole 6*c* can be controlled to a relatively small range, this mode is preferable in that the layout of the magnetic poles can be controlled to a minimum.

In addition, although the invention of the modes shown in FIGS. 1 and 2 has the developing unit as its subject, the invention is not limited to the same, and may have as its subject an image forming apparatus itself which uses the developing unit.

DETAILED DESCRIPTION OF THE PREFERRED EMBODIMENTS

[Mode for Carrying Out the Invention]

Hereafter, a detailed description will be given of the invention on the basis of the embodiments illustrated in the appended drawings.

First Embodiment

Figure 4:
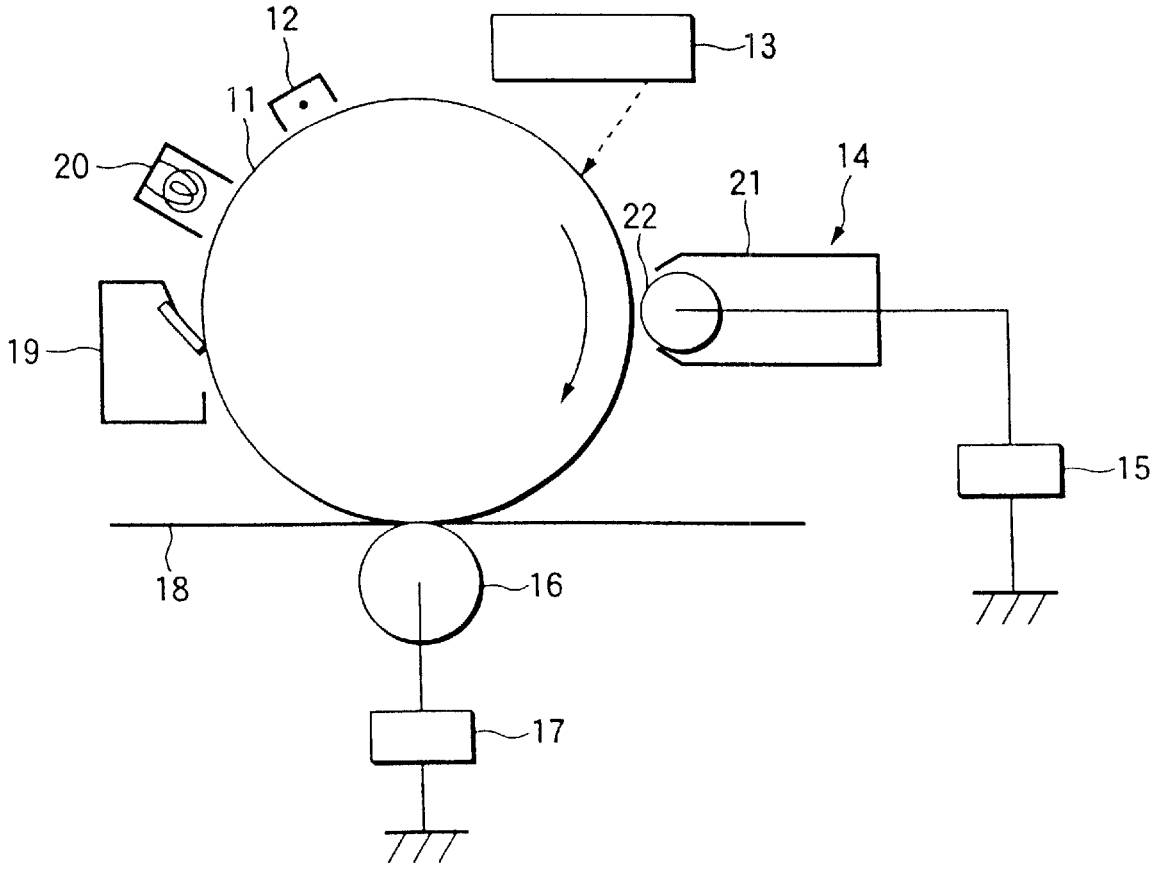
FIG. 4 is an explanatory diagram illustrating a first embodiment of an image forming apparatus including the developing unit to which the invention is applied.

FIG. 4 illustrates a first embodiment of an image forming apparatus including a developing unit to which the invention is applied.

In the drawing, reference numeral 11 denotes a photoconductor drum which is a latent image carrier that rotates in the direction of the arrow. This photoconductor drum 11 is electrostatically charged by a charging unit 12 such as a corotron, and an electrostatic latent image is written by an exposure unit 13 such as a laser scanner. This electrostatic latent image is formed as a potential image based on contrast between portions where the light has struck and caused the surface potential on the photoconductor drum 11 to decline and high-potential portions where the light has not struck.

In addition, a developing unit 14 is arranged such that a two-component developer consisting of a toner, i.e., pigmented particles, and a carrier is accommodated in a development housing 21, the developer is carried on a development roll 22, and a development bias is applied from a bias power supply 15 to this development roll 22, whereby the development roll 22 is held at an intermediate potential between the high-potential portion and the low-potential portion of an electrostatic latent image, and either the high-potential portions or the low-potential portions of the electrostatic latent image are selectively developed with the toner charged with either polarity.

Further, a transfer unit 16 is constituted by, for example, a transfer roll disposed in contact with the photoconductor drum 11, and is adapted to transfer the toner image on the photoconductor drum 11 onto a recording material 18 by applying by a bias power supply 17 a transfer bias in the direction of attracting the toner image on the photoconductor drum 11.

Subsequently, the toner remaining on the photoconductor drum 11 is removed by a cleaning unit 19, and after the charge remaining nonuniformly on the photoconductor drum 11 is erased by a whole-surface exposure unit 20 or the like, the same image forming process is repeated again.

Figure 5:
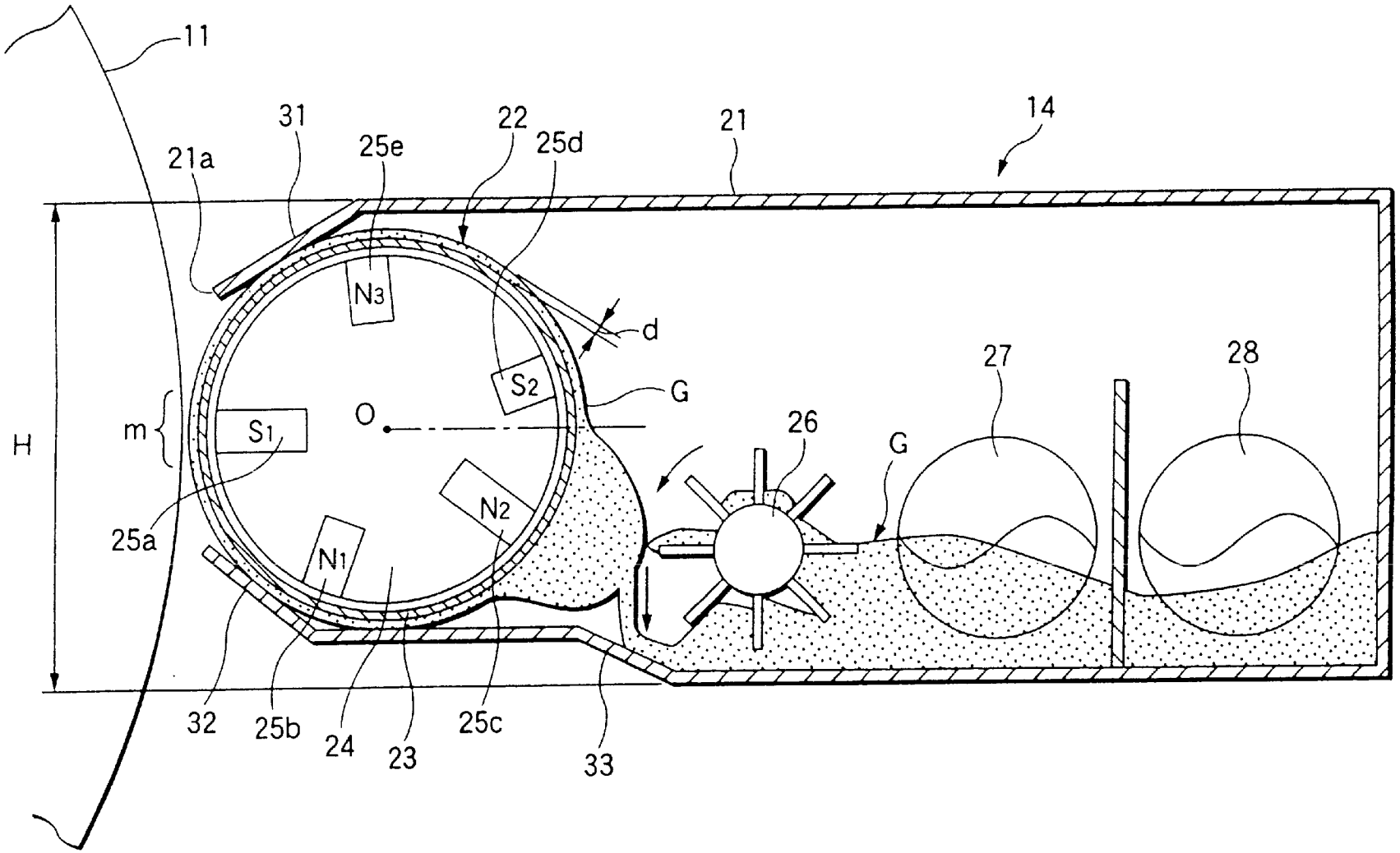
FIG. 5 is an explanatory diagram illustrating the developing unit in accordance with the first embodiment.

In this embodiment, as the developing unit 14, a developing unit having the form shown in FIG. 5 is used, for example.

In the drawing, the developing unit 14 has the development housing 21 in which an opening 21*a* for development is provided in such a manner as to oppose the photoconductor drum 11, a two-component developer G consisting of a toner and a carrier is accommodated in this development housing 21, and the development roll 22 is disposed in face-to-face relation to the opening 21*a* for development in the development housing 21. Inside the development housing 21, a transport paddle 26 is disposed on the rear surface side of the development roll 22, and a pair of screw augers 27 and 28 for agitating the developer are disposed on the rear surface side of the transport paddle 26 such that the developer G is circulatingly transported.

In this embodiment, the height H of the development housing 21 is set to be slightly larger than the outside diameter of the development roll 22. The development roll 22 has a development sleeve 23 formed of a nonmagnetic material and adapted to rotate from the upper side toward the lower side in a development region m opposing the photoconductor drum 11, as well as a magnet roll 24 which is fixedly provided inside the development sleeve 23 and in the periphery of which a plurality of magnetic poles 25 are arranged.

As the magnet roll 24, one is used on which the magnetic poles 25 are formed by embedding magnets at predetermined positions in the main body of the magnet roll or by magnetizing corresponding portions of the main body of the magnet roll.

As the layout of the magnetic poles used in this example, the following layout is adopted, for example. Namely, a development magnetic pole 25*a* (S1 in this example) is disposed on the development region m side in alignment with a horizontal plane passing through the rotating center O of the development sleeve 23 (or the development roll 22). A pair of magnetic poles 25*b* and 25*c* (N1 and N2 in this example) of the same polarity are disposed on the downstream side, in the rotating direction of the development sleeve 23, of the development magnetic pole 25*a,* and the magnetic pole 25*c* located on the downstream side is disposed as a pickup magnetic pole for capturing the developer in a region which is located on a lower side than the height of the rotational center O of the development sleeve 23 in a region where the development sleeve 23 in terms of its rotating direction is headed from the lower side toward the upper side. Further, a trimming magnetic pole 25*d* (S2 in this example) for restricting the thickness of the developer layer is disposed on the downstream side of this pickup magnetic pole 25*c* and at a position higher than the rotational center O of the development sleeve 23. Furthermore, a transporting magnetic pole 25*e* (N3 in this example) for transporting the developer is disposed on the downstream side of this trimming magnetic pole 25*d*.

In this example, the magnetic forces of and the positional relationship between the pickup magnetic pole 25*c* (N2) and the trimming magnetic pole 25*d* (S2), in particular, are important, and the behavior of the developer G in the vicinity of the height of the rotational center O on the surface of the development sleeve 23 is adjusted as follows.

Figure 6A:
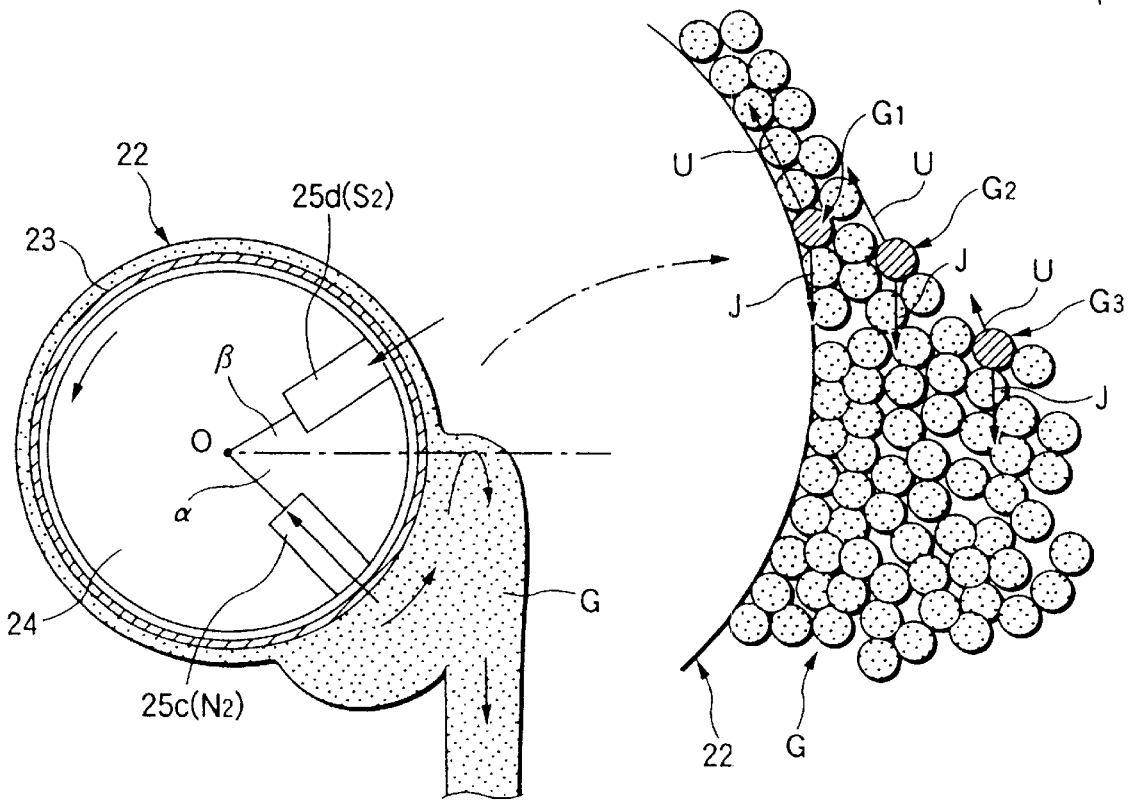
FIG. 6A is an explanatory diagram schematically illustrating the force acting on an developer between a pickup magnetic pole and a trimming magnetic pole of a development roll used in this embodiment.

Namely, as shown in FIG. 6A, the pickup magnetic pole 25*c* is disposed on a lower side by an angle α with respect to the horizontal plane passing through the rotational center O of the development sleeve 23. However, the smaller the angle α, the stronger the magnetically attracting force acting in the vicinity of the height of the rotational center O on the surface of the development sleeve 23. Conversely, the greater the angle α, the weaker the magnetically attracting force.

In addition, although the trimming magnetic pole 25*d* is disposed on an upper side by an angle β with respect to the horizontal plane passing through the rotational center O of the development sleeve 23, the smaller the angle β, the stronger the magnetically attracting force acting in the vicinity of the height of the rotational center O on the surface of the development sleeve 23. Conversely, the greater the angle β, the weaker the magnetically attracting force.

Accordingly, by adjusting the magnetic forces of the pickup magnetic pole 25*c* and the trimming magnetic pole 25*d* and their positional relationship, it becomes possible to adjust the force acting in the vicinity of the height of the rotational center O on the surface of the development sleeve 23.

In this example, for instance, the following mode is selected from the viewpoints of sufficiently securing the force for capturing the developer G and of weakening to some extent the magnetically attracting force acting in the vicinity of the height of the rotational center O on the surface of the development sleeve 23. As the pickup magnetic pole 25*c,* one having a strong magnetic field is used, and as for its layout the angle α is set to a relatively large angle, whereas, as the trimming magnetic pole 25*d,* one having a weaker magnetic field than the pickup magnetic pole 25*c* is used, and as for its layout the angle β is set to a relatively small angle.

In such a mode, the developer G which is present around the development roll 22 is sufficiently captured on the development sleeve 23 by the magnetic force of the pickup magnetic pole 25*c*.

Then, of the developer G which has been captured by the pickup magnetic pole 25*c* and transported close to the vicinity of the height of the rotational center O on the surface of the development sleeve 23, in the case of the developer located very close to the surface of the development sleeve 23 as in the case of a developer particle G1, the transporting force (frictional force) U obtained by multiplying this magnetically attracting force by the coefficient of friction of the developer G is greater than the gravity J, so that this developer is transported on the development sleeve 23 toward the trimming magnetic pole 25*d*.

In addition, of the developer G which has been transported close to the vicinity of the height of the rotational center O on the surface of the development sleeve 23, in the case of the developer which is located further away from the surface of the development sleeve 23 as in the case of a developer particle G2, the magnetically attracting force acting on that developer particle G2 weakens. Hence, the transporting force (frictional force) U obtained by multiplying this magnetically attracting force by the coefficient of friction of the developer G becomes substantially equal to the gravity J. Furthermore, in the case of the developer which is located on the outer side away from the surface of the development sleeve 23 as in the case of a developer particle G3, the magnetically attracting force acting on that developer particle G3 weakens further. Therefore, the transporting force (frictional force) U obtained by multiplying this magnetically attracting force by the coefficient of friction of the developer G becomes smaller than the gravity J, so that the developer particle G3 drops due to the gravity J.

For this reason, of the developer G which has been transported close to the vicinity of the height of the rotational center O on the surface of the development sleeve 23, the developer G located on the inward side of the developer particle G2 is transported by the transporting force U which is greater than the gravity J, whereas the developer G located on the outward side thereof drops due to the gravity which is greater than the transporting force U. Thus, as shown in FIG. 5, a layer of the developer G with a predetermined layer thickness d is formed on the development roll 22.

Accordingly, in this embodiment, it becomes unnecessary to use a conventionally used trimming member to restrict the developer G to a predetermined layer thickness, so that it becomes possible to eliminate the stress acting on the developer G when the trimming member is used. Hence, it is possible to prolong the life of the developer G by that margin.

It should be noted that even if the trimming member is used in this embodiment, the amount of the developer itself which can be blocked by the trimming member is very small (substantially zero), so that the stress applied to the developer G by the trimming member is practically nil.

Figure 6B:
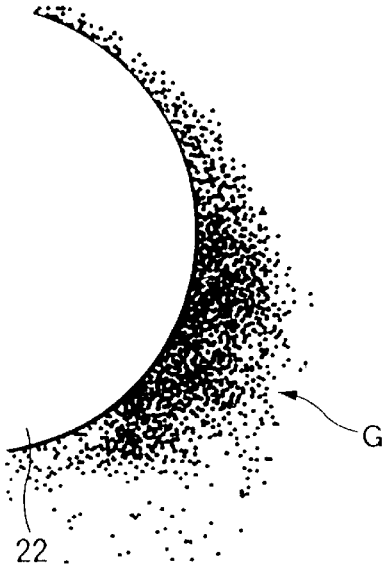
FIGS. 6B and 6C are explanatory diagrams illustrating the state of operation of developer particles based on the result of a simulation calculation using that model as well as directions of motion of the developer particles.
Figure 6C:
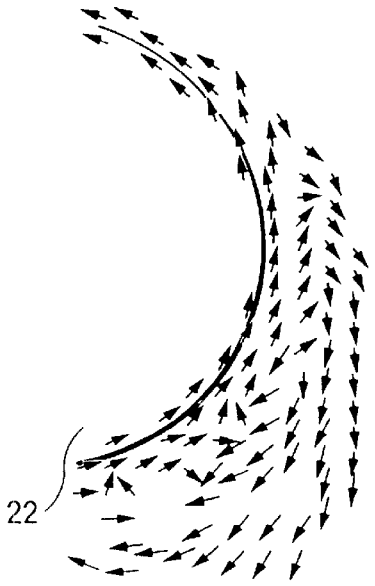

In addition, when a simulation calculation was conducted with respect to a developing unit model in this embodiment, it was confirmed that the developer G particles undergo motion as shown in FIG. 6B. Further, as for the direction of force to which the developer G particle is subjected, the result shown in FIG. 6C was obtained, and the above-described relationship between the transporting force and the gravity with respect to the developer G was confirmed.

In addition, the behavior of these particles of the developer G was confirmed in the examples which will be described later.

Further, in this embodiment, the developer G, whose layer thickness has been restricted by the pickup magnetic pole 25*c* and the trimming magnetic pole 25*d,* is transported to the development region m along the magnetic force of the transporting magnetic pole 25*e* as it is carried on the development roll 22.

At this time, in this embodiment, an upper edge portion 31 of the opening 21*a* for development in the development housing 21 is disposed in such a manner as to be spaced apart by the restricted layer thickness of the developer G from the surface of the development roll 22. This upper edge portion 31 of the opening 21*a* for development functions as a leveling member for leveling the surface of the developer G, and also functions as a sealing member for preventing a toner cloud from leaking from inside the development housing 21.

Furthermore, in this embodiment, a lower edge portion 32 of the opening 21*a* for development in the development housing 21 is also disposed in such a manner as to be spaced apart by the restricted layer thickness d of the developer G from the surface of the development roll 22, and functions as a sealing member for preventing the leakage of the toner cloud.

It should be noted that although the upper edge portion 31 and the lower edge portion 32 of the opening 21*a* for development in the development housing 21 function as the sealing members and the like, it goes without saying that a sheet film may be attached to the edge portion of the opening 21*a* for development within the range that does not destroy the developer G layer with its layer thickness restricted.

In addition, in this embodiment, since the development housing 21 is formed with the height H which is slightly larger than the outside diameter of the development roll 22, the unit itself can be made thin.

For this reason, in a four-cycle type image forming apparatus, for example, also in a mode in which developing units 14 for the respective color components are juxtaposed in the vertical direction, the developing unit 14 in accordance with this embodiment can be effectively used.

Further, in this embodiment, the transport paddle 26 is disposed on the rear surface side of the development roll 22, and this transport paddle 26 at its opposing portion rotates in the opposite direction to the rotating direction of the development roll 22. Moreover, a most projecting end of the transport paddle 26 on the development roll 22 side is located lower than the position of the height of the rotational center O on the surface of the development roll 22, and is disposed in such a manner as to project into a pool of the developer G which drops from the vicinity of the height of the rotational center O on the surface of the development roll 22.

Accordingly, in this embodiment, the pool of the developer G is scraped off downward by the rotation of the transport paddle 26, so that the developer G in the vicinity of the height of the rotational center O on the surface of the development roll 22 is correspondingly caused to drop reliably.

Thus, the transport paddle 26 assists the dropping movement of the developer G. In accordance with this embodiment, since the developer G deprived of its toner is temporarily moved away from the development roll 22 to replenish the toner, and it is therefore possible to supply again to the development roll 22 the developer G with the toner replenished, this arrangement is effective in continuously effecting development with a high area rate.

In addition, in this embodiment, a guiding tapered portion 33 which is inclined diagonally downward toward the inner side of the development housing 21 is formed on a bottom wall of the development housing 21 at a position corresponding to the portion of the pool of the developer G scraped off by the transport paddle 26. The developer G which dropped to the bottom wall of the development housing 21 is thus adapted to move naturally toward the inner side of the development housing 21 along the guiding tapered portion 33.

At this time, in this embodiment, the transport paddle 26 transports toward the screw augers 27 and 28 the developer G which moves along the guiding tapered portion 33 of the development housing 21, and the developer G, which is appropriately replenished with the toner and agitated and mixed by the screw augers 27 and 28, is fed again to the development roll 32 side by the transport paddle 26.

In addition, although in this embodiment the magnet roll 24 is provided with the pair of magnetic poles 25*b* and 25*c* of the same polarity are disposed on the downstream side, in the rotating direction of the development sleeve 23, of the development region m, since the bottom wall of the development housing 21 located below the development roll 22 is, in the first place, disposed in proximity to the development roll 22, even if the developer G is temporarily released from the surface of the development roll 22 due to the repellent magnetic field formed in an intermediate portion between the pair of magnetic poles 25*b* and 25*c* of the same polarity, this released developer G is moved to the inner side of the development housing 21 by following the rotation of the development roll 22 as it is filled between the development roll 22 and the bottom wall of the development housing 21.

Figure 7:
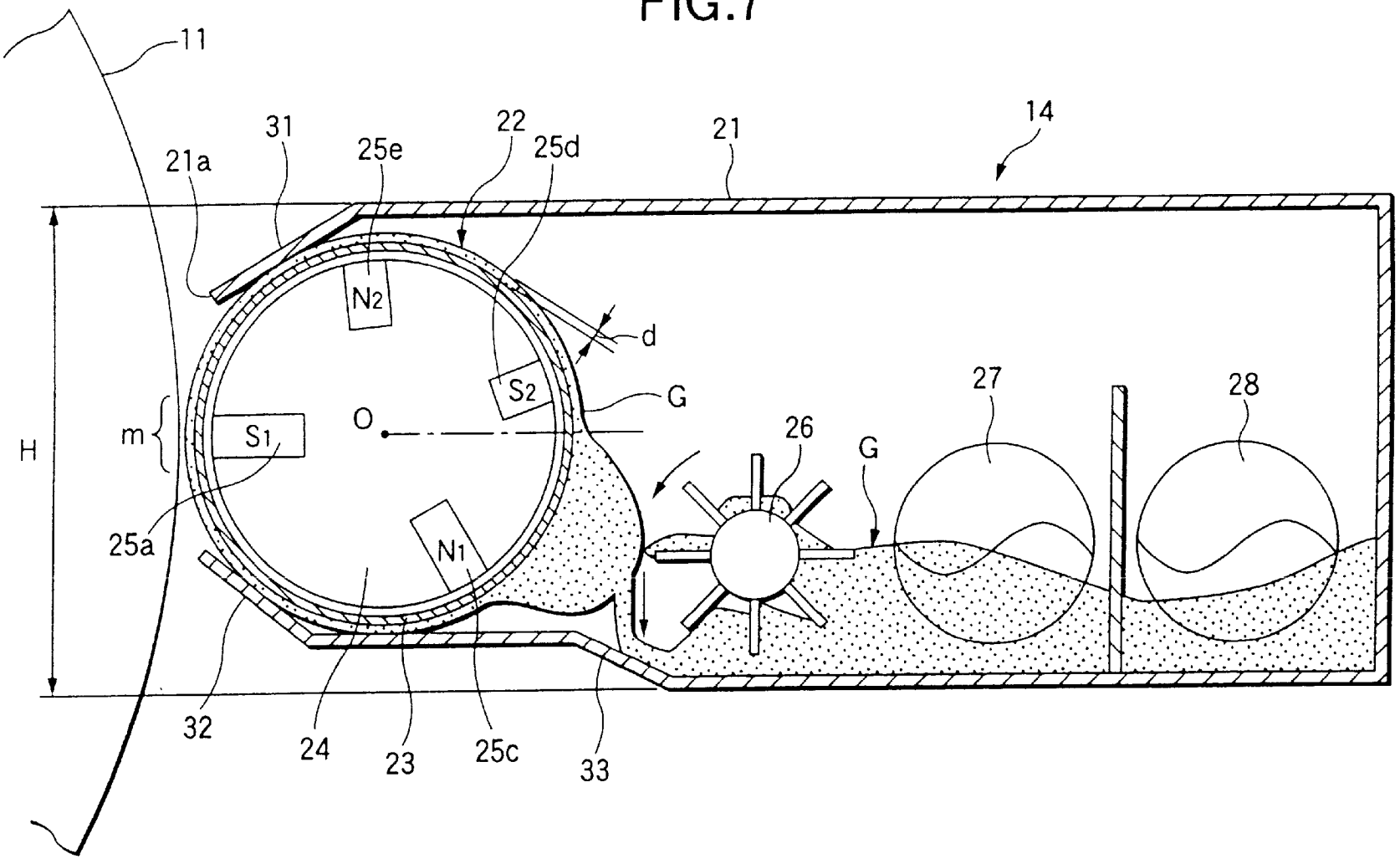
FIG. 7 is an explanatory diagram illustrating the developing unit in accordance with a modification of the first embodiment.

Accordingly, in the mode in which the bottom wall portion of the development housing 21 located below the development roll 22 is disposed in close proximity to the development roll 22 as in this embodiment, the magnetic poles 25 of different polarities may be arranged alternately as the magnetic poles 25 of the magnet roll 24, including the magnetic pole 25*a* (S1 in this example), the pickup magnetic pole 25*c* (N1 in this example), the trimming magnetic pole 25*d* (S2 in this example), and the transporting magnetic pole 25*e* (N2 in this example) without providing the pair of magnetic poles of the same polarity, as shown in FIG. 7.

Second Embodiment

Figure 1:
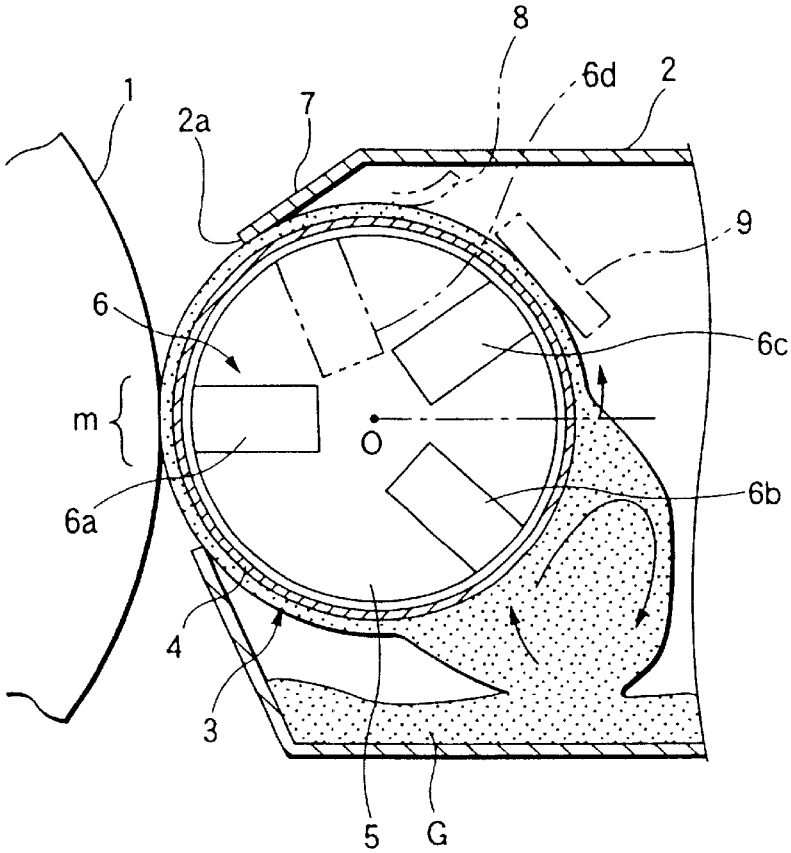
FIG. 1 is an explanatory diagram illustrating an outline of a developing unit in accordance with the invention.
Figure 2:
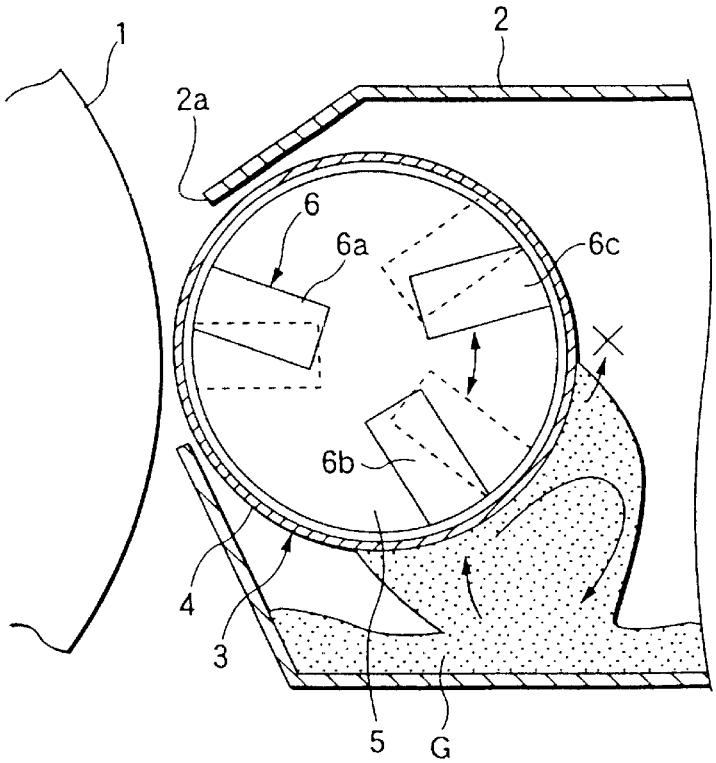
FIG. 2 is an explanatory diagram illustrating an outline of the developing unit in accordance with another mode of the invention.
Figure 3:
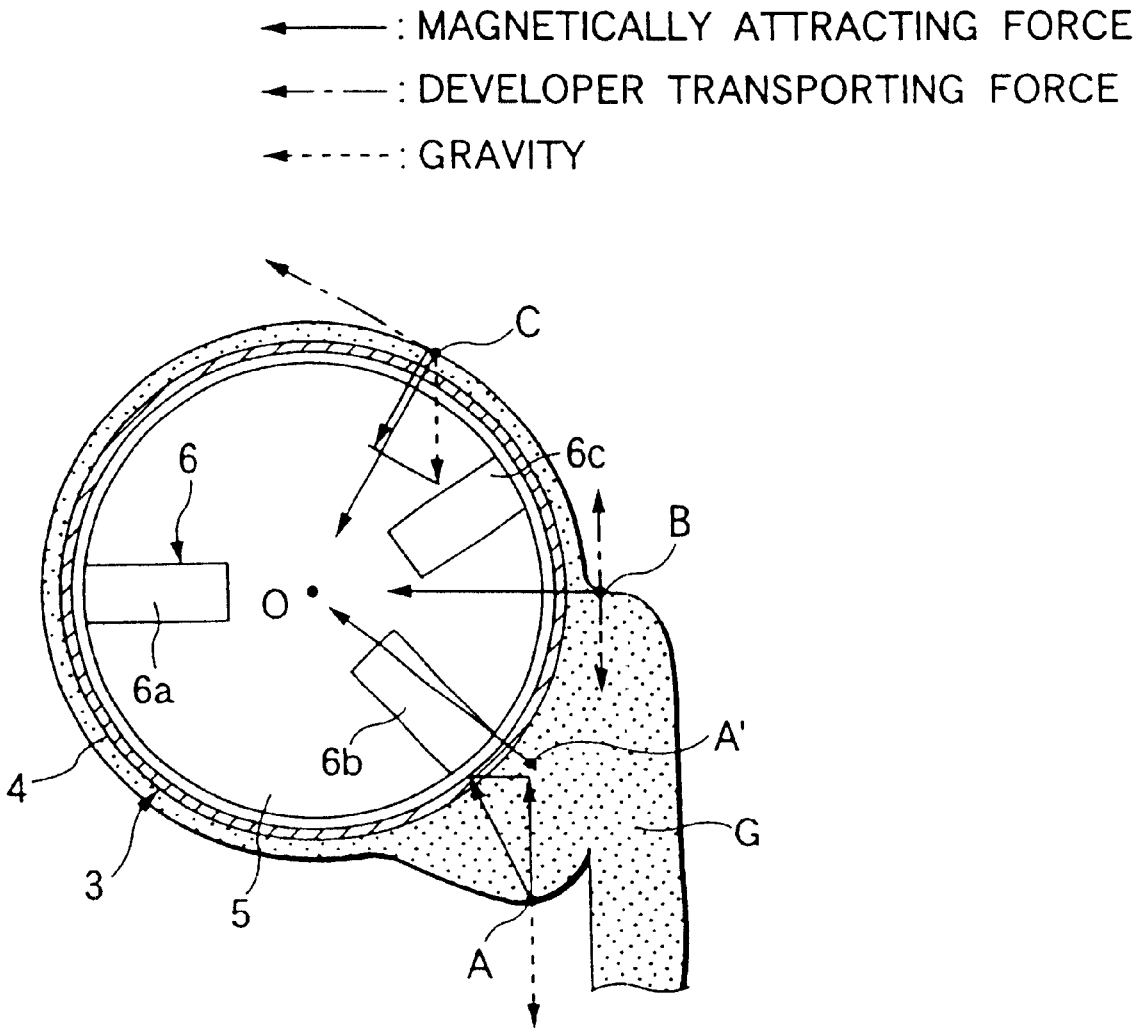
FIG. 3 is an explanatory diagram illustrating the operation of the developing unit in accordance with the invention.

FIG. 2 shows a second embodiment of the developing unit to which the invention is applied.

In the drawing, the developing unit 14 is constructed substantially in the same way as the first embodiment, but the shape of the development housing 21, the arrangement of the development roll 22, and the layout of the transport paddle 26 and the screw augers 27 and 28 are differ from those of the first embodiment. It should be noted that component elements similar to those of the first embodiment will be denoted by the same reference numerals as those used in the first embodiment, and a detailed description thereof will be omitted here.

Namely, in this embodiment, the development housing 21 has a height greater than in the first embodiment, the transport paddle 26 is disposed below the space where the development roll 22 is disposed inside the development housing 21, and the pair of screw augers 27 and 28 are disposed diagonally below the rear surface of the development roll 22 and on the rear surface side of the transport paddle 26.

In addition, the development roll 22 used in this embodiment is formed by fixedly providing the magnet roll 24 inside the development sleeve 23. As the layout of the magnetic poles 25 of the magnet roll 24, the following layout is adopted. Namely, the development magnetic pole 25*a* (S1 in this example) is disposed at a position corresponding to the development region m, and the pair of magnetic poles 25*b* and 25*c* (N1 and N2 in this example) of the same polarity are disposed on the downstream side, in the rotating direction of the development sleeve 23, of the development magnetic pole 25*a,* the magnetic pole 25*c* located on the downstream side being made to function as the pickup magnetic pole. Further, the trimming magnetic poles 25*d* having a plurality of magnetic poles (S2, N3, and S3 in this example) are disposed on the downstream side of this pickup magnetic pole 25*c*. Furthermore, the transporting magnetic pole 25*e* is disposed on the downstream side of these trimming magnetic poles 25*d*.

Here, the pickup magnetic pole 25*c* is disposed lower than the height of the rotational center O on the development sleeve 23, while the trimming magnetic poles 25*d* are disposed higher than the height of the rotational center O on the development sleeve 23. As the pickup magnetic pole 25*c,* one having a strong magnetic field is used, while, as the trimming magnetic poles 25*d,* those having a weaker magnetic field than the pickup magnetic pole 25*c* are used, respectively.

Further, in this embodiment, the aforementioned transport paddle 26 is disposed at a lower position corresponding to an intermediate portion between the pair of magnetic poles 25*b* and 25*c* of the same polarity, and the transport paddle 26 at its opposing portion is adapted to rotate in the opposite direction to the rotating direction of the development roll 22.

Next, a description will be given of the behavior of the developer in the developing unit in accordance with this embodiment.

Now, of the developer G agitated and mixed by the screw augers 27 and 28, the developer G which is present in the vicinity of the transport paddle 26 is paddled up to the neighborhood of the pickup magnetic pole 25*c* on the development roll 22 side by the transport paddle 26.

For this reason, a sufficient amount of the developer G is supplied to the vicinity of the pickup magnetic pole 25*c* of the development roll 22, so that the developer G is reliably captured onto the surface of the development roll 22 by the magnetic force of the pickup magnetic pole 25*c*.

Subsequently, as the development roll 22 (development sleeve 23) rotates, the developer G on the development roll 22 is transported to the vicinity of the height of the rotational center O on the surface of the development roll 22. However, when this developer G reached that portion, since the magnetically attracting force based on the pickup magnetic pole 25*c* and the trimming magnetic poles 25*d* becomes weaker than that of the pickup magnetic pole 25*c*, an excess portion of the developer G being carried on the surface of the development roll 22 drops, so that only a necessary amount is carried on the surface of the development roll 22.

In particular, as for the trimming magnetic poles 25*d*, a plurality of magnetic poles of different polarities (a weaker magnetic field than the pickup magnetic pole 25*c*) are arranged alternately in this embodiment as compared with the fact that a single trimming magnetic pole is used in the first embodiment. Therefore, it is easy to adjust the magnetically attracting force in the vicinity of the height of the rotational center O on the surface of the development sleeve 23, and it becomes possible to stabilize over a wide range the transporting force of the developer G with its layer thickness restricted.

For this reason, in this embodiment as well, the developer G on the development roll 22, after being restricted to the predetermined layer thickness d before the trimming magnetic poles 25*d*, is transported to the development region m while being held by the magnetic forces of the trimming magnetic poles 25*d* and the transporting magnetic pole 25*e*. In that development region m, an electrostatic latent image on the photoconductor drum 11 is then converted to a visible image by the action of the development magnetic pole 25*a*.

Subsequently, the remaining developer G which passed the development region m is caused to drop downward from the development roll 22 by the repellent magnetic field formed by the intermediate portion between the pair of magnetic poles 25*b* and 25*c* of the same polarity.

Figure 8:
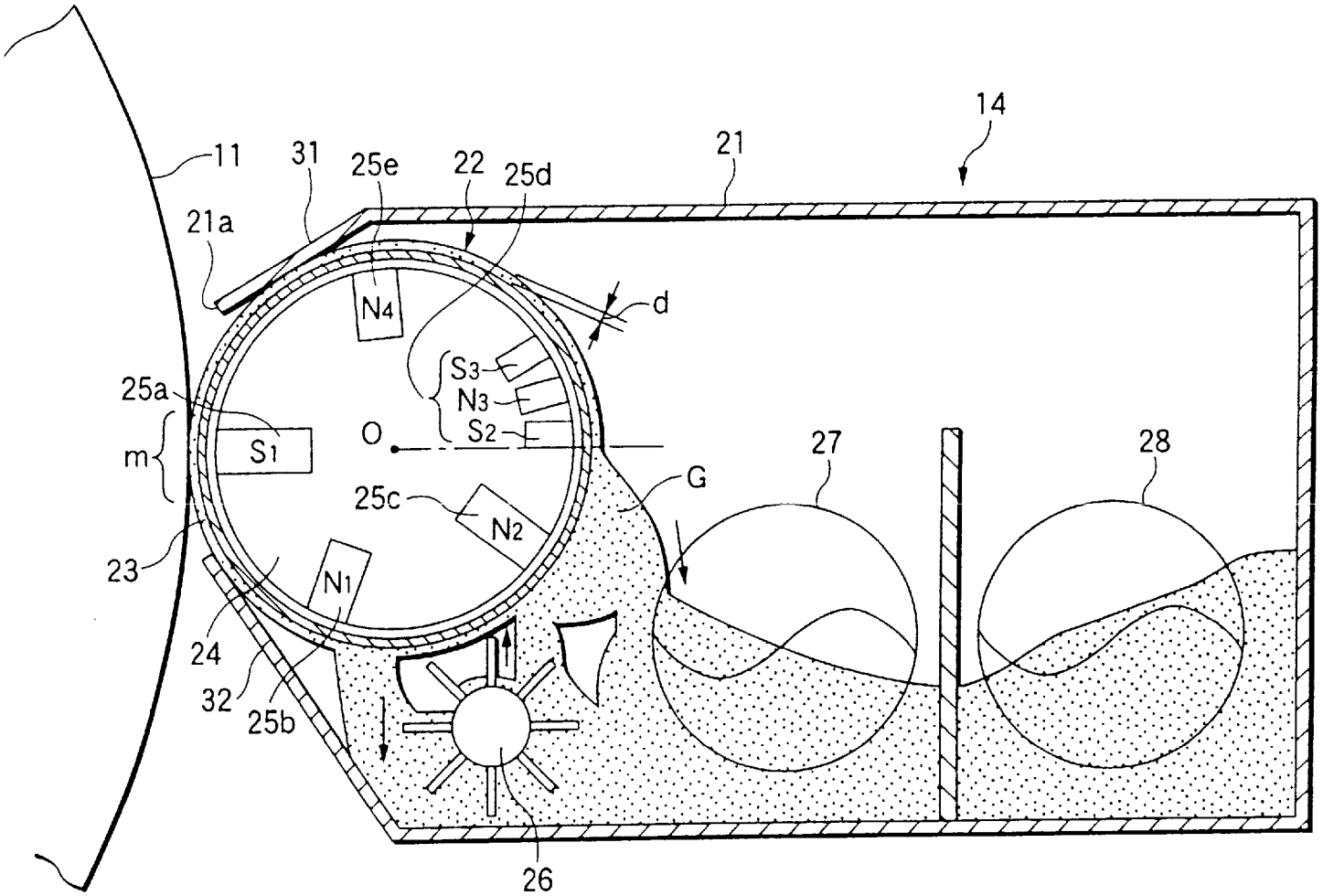
FIG. 8 is an explanatory diagram illustrating the developing unit in accordance with a second embodiment.

Then, the developer G which dropped is transported toward the screw augers 27 and 28 on the inner side of the development housing 21 by the transport paddle 26, as indicated by the arrow in FIG. 8. Meanwhile, the developer G which dropped before the trimming magnetic poles 25*d* of the development roll 22 is naturally returned toward the screw augers 27 and 28. For this reason, the developer G which was returned to the side of the screw augers 27 and 28 is appropriately replenished with the toner, is then agitated and mixed by the screw augers 27 and 28, and is fed again to the development roll 22 side by the transport paddle 26.

Third Embodiment

Figure 9:
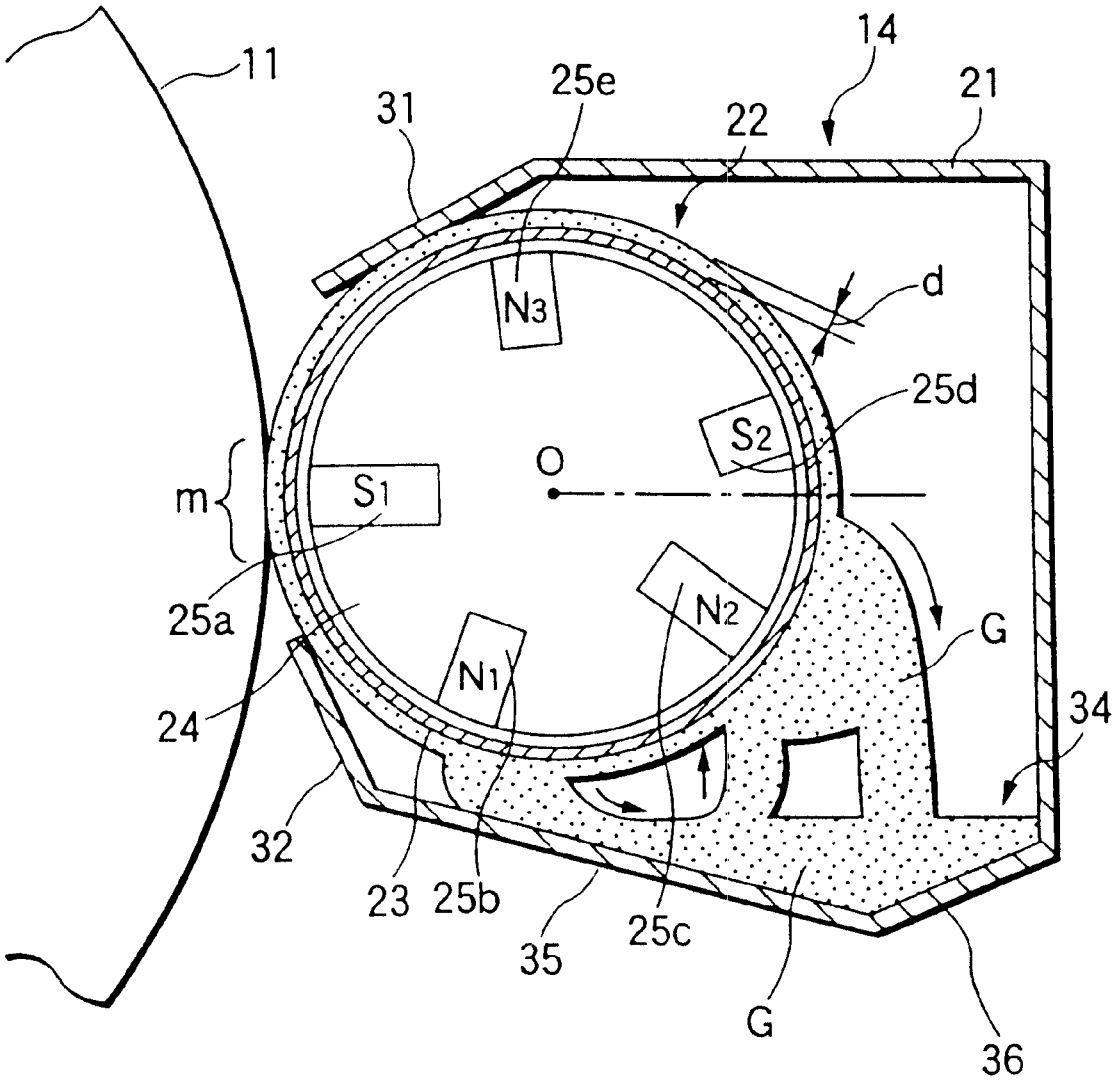
FIG. 9 is an explanatory diagram illustrating the developing unit in accordance with a third embodiment.

FIG. 9 shows a third embodiment of the developing unit to which the invention is applied.

Unlike the first and second embodiments, the developing unit 14 in accordance with this embodiment has such a mode that only the development roll 22 facing the opening 21*a* for development in the development housing 21, and the transport paddle 26 and the screw augers 27 and 28 are not used, thereby realizing a compact arrangement as compared with the first and second embodiments. It should be noted that component elements similar to those of the first embodiment will be denoted by the same reference numerals as those used in the first embodiment, and a detailed description thereof will be omitted here.

Here, the development roll 22 in terms of its construction has the development sleeve 23 and the magnet roll 24 (provided with the development magnetic pole 25*a*, the pair of magnetic poles 25*b* and 25*c* of the same polarity one of which functions as the pickup magnetic pole, the trimming magnetic pole 25*d*, and the transporting magnetic pole 25*e*) which are similar to those of the first embodiment. As the development housing 21, one is used in which a developer storage section 34 for storing the developer G is secured below the development roll 22, a first guiding tapered portion 35 which is inclined diagonally downward toward the inner side of the development housing 21 is formed in that portion of a bottom wall for partitioning the developer storage section 34 that corresponds to the lower sides of the pair of magnetic poles 25*b* and 25*c* of the same polarity of the development roll 22, and a second guiding tapered portion 36 continuing from the first guiding tapered portion 35 to jointly form a substantially V-shaped configuration is formed on the further inner side of the first guiding tapered portion 35.

Next, a description will be given of the behavior of the developer in the developing unit in accordance with this embodiment.

If it is now assumed that the development roll 22 is undergoing rotating motion, the developer G which is present in the vicinity of the pickup magnetic pole 25*c* is captured onto the surface of the development roll 22 by the magnetic force of the pickup magnetic pole 25*c*.

Subsequently, when the development roll 22 (development sleeve 23) continues to rotate, the developer G on the development roll 22 is transported to the vicinity of the height of the rotational center O on the surface of the development roll 22. However, when this developer G reached that portion, since the magnetically attracting force based on the pickup magnetic pole 25*c* and the trimming magnetic pole 25*d* becomes weaker than that of the pickup magnetic pole 25*c*, an excess portion of the developer G being carried on the surface of the development roll 22 drops, so that only a necessary amount is carried on the surface of the development roll 22.

For this reason, the developer G on the development roll 22, after being restricted to the predetermined layer thickness d before the trimming magnetic pole 25*d*, is transported to the development region m while being held by the magnetic forces of the trimming magnetic pole 25*d* and the transporting magnetic pole 25*e*. In that development region m, an electrostatic latent image on the photoconductor drum 11 is then converted to a visible image by the action of the development magnetic pole 25*a*.

Subsequently, the remaining developer G which passed the development region m is caused to drop from the development roll 22 to the developer storage section 34 disposed therebelow by the repellent magnetic field formed by the intermediate portion between the pair of magnetic poles 25*b* and 25*c* of the same polarity. This developer G which dropped is caused to move to the region below the pickup magnetic pole 25*c* along the first guiding tapered portion 35 by its own weight.

Meanwhile, although the developer G which dropped from the vicinity of the height of the rotational center O on the surface of the development roll 22 is also returned to the developer storage section 34, this returned developer G is caused to move to the region below the pickup magnetic pole 25*c* along the second guiding tapered portion 36 by its own weight.

For this reason, the portion of the developer storage section 34 which is located below the pickup magnetic pole 25*c* is kept in a state in which the developer G is constantly stored, so that the operation of capturing the developer G by the pickup magnetic pole 25*c* is stabilized.

Figure 10A:
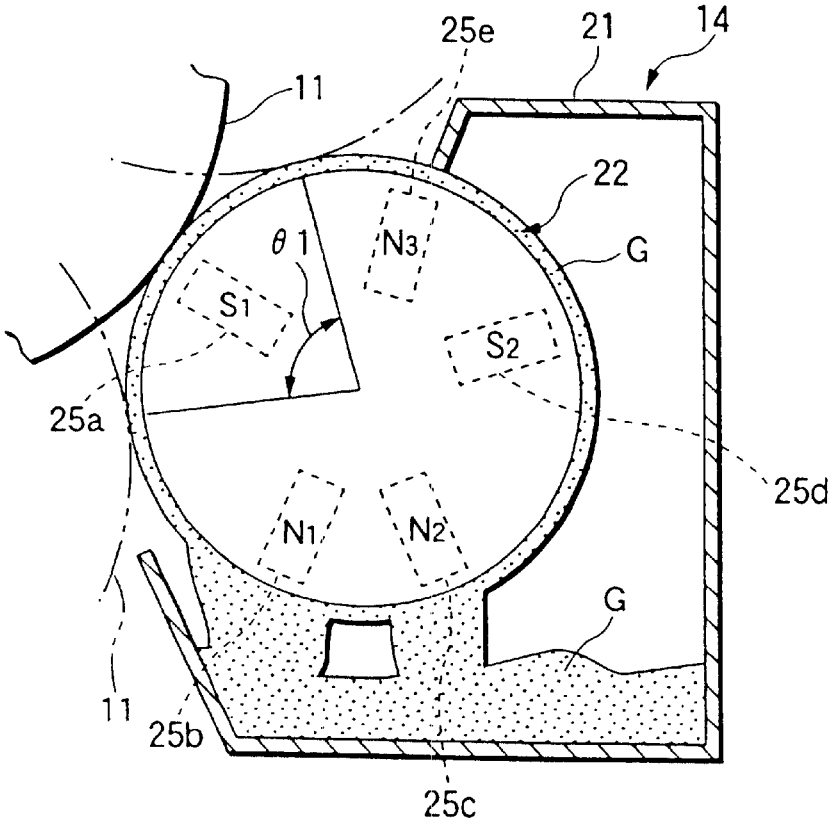
FIG. 10A is an explanatory diagram illustrating a range in which a development region can be set in a case where a magnet roll has repellent magnetic poles of the same polarity in the model of the third embodiment.

In addition, in this embodiment, a repellent magnetic field is formed by the pair of magnetic poles 25*b* and 25*c* of the same polarity so as to temporarily release the developer G from the development roll 22. For this reason, the angular range where the development magnetic pole 25*a* can be disposed in the development roll 22 is restricted to □1, as shown in FIG. 10A, due to the fact that the pair of magnetic poles 25*b* and 25*c* of the same polarity are essential.

Figure 10B:
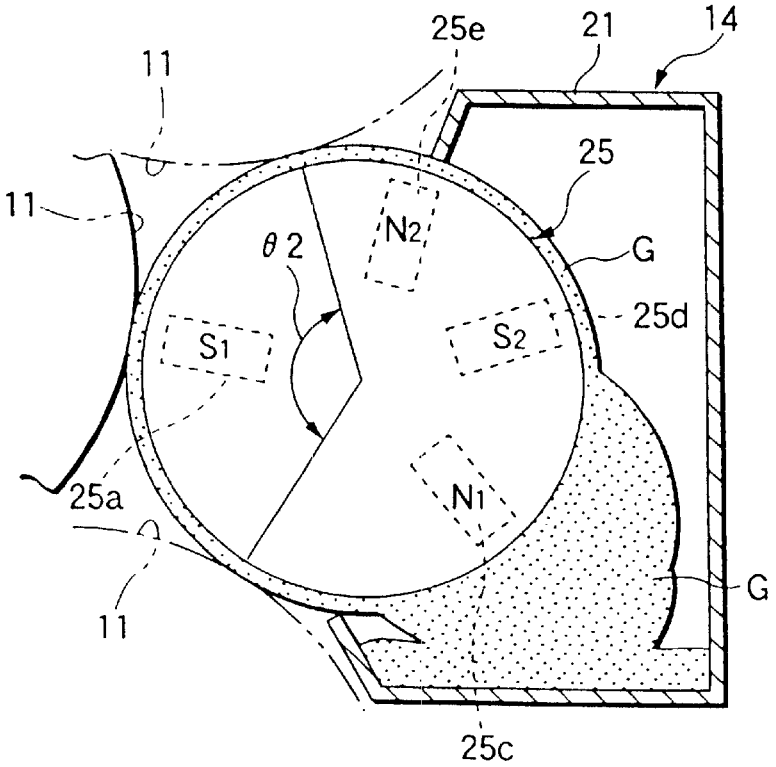
FIG. 10B is an explanatory diagram illustrating the range in which the development region can be set in a case where the magnet roll does not have the repellent magnetic poles of the same polarity in that model.

In this respect, if the layout of the magnetic poles of the development roll 22 in this embodiment is provided as shown in the modification in FIG. 7, the magnetic pole 25*b* of the pair of magnetic poles 25*b* and 25*c* of the same polarity becomes unnecessary, so that the angular range where the development magnetic pole 25*a* can be disposed in the development roll 22 becomes □2, as shown in FIG. 10B. Hence, the degree of freedom in the layout of disposition of the development magnetic pole 25*a* increases as compared to the mode in which the pair of magnetic poles 25*b* and 25*c* of the same polarity are used.

It should be noted that, in this respect, the invention is not limited to this embodiment, and the same also applies to the first and second embodiments.

Fourth Embodiment

Figure 11:
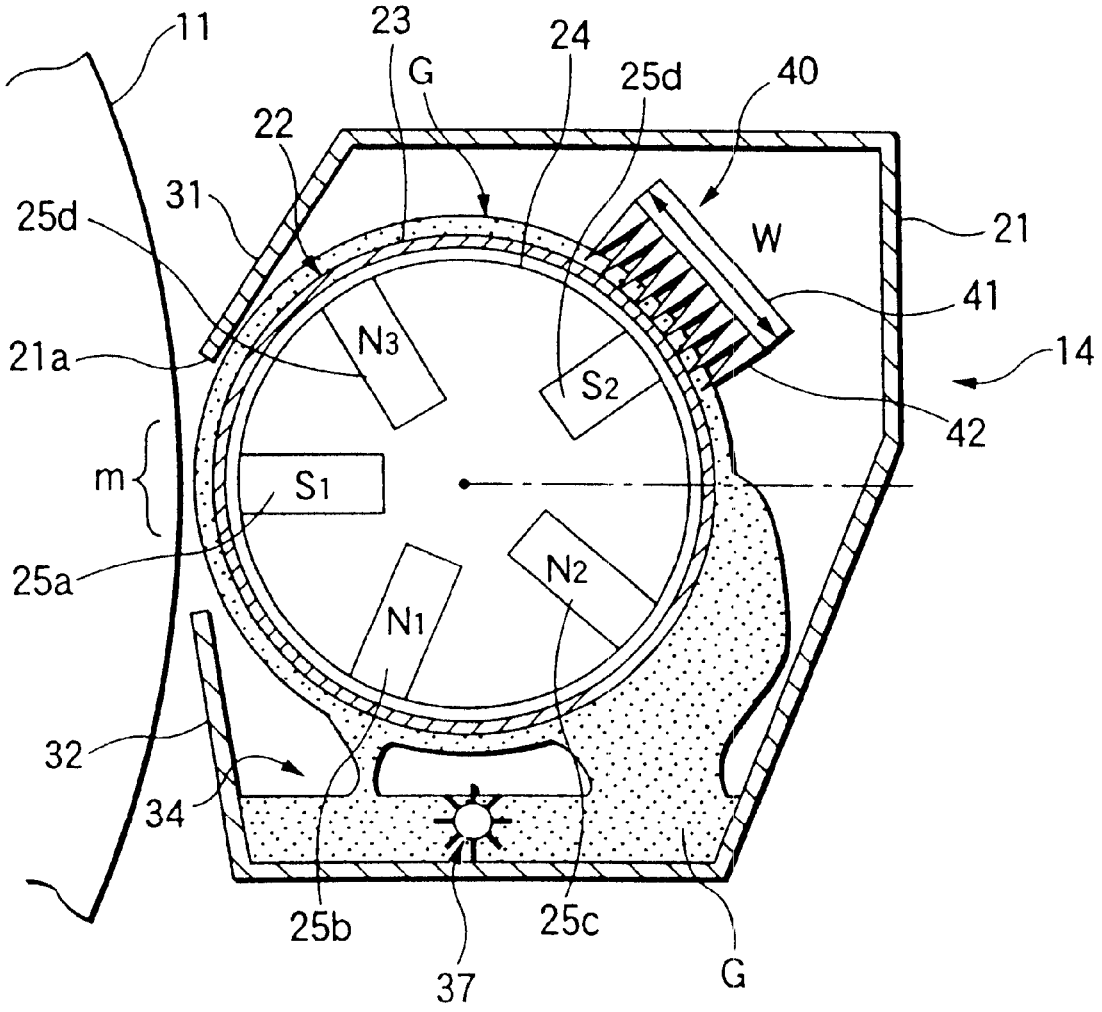
FIG. 11 is an explanatory diagram illustrating the developing unit in accordance with a fourth embodiment.

FIG. 11 shows a fourth embodiment of the developing unit to which the invention is applied.

In the drawing, the basic configuration of the developing unit 14 is as follows: The development housing 21 in which opening 21*a* for development is formed in such a manner as to oppose the photoconductor drum 11 is provided. The development roll 22 is disposed in face-to-face relation to the opening 21*a* for development. The developer storage section 34 for storing the developer G is secured inside the development housing 21 in a region below the development roll 22. A simple agitating/transporting member 37 for agitating and transporting the developer G in the rearward direction is disposed in this development storage section 34. Further, a charging projecting member 40 serving as a charging member is disposed over the periphery of the development roll 22 in an opposing manner.

In this embodiment, the development roll 22 has the development sleeve 23 and the magnet roll 24 (provided with the development magnetic pole 25*a,* the pair of magnetic poles 25*b* and 25*c* of the same polarity one of which functions as the pickup magnetic pole, the trimming magnetic pole 25*d,* and the transporting magnetic pole 25*e*) which are similar to those of the first embodiment.

In addition, in this example, the charging projecting member 40 is disposed in such a manner as to oppose the trimming magnetic pole 25*d,* and is formed such that charging projecting portions 42 are provided on one surface of a rectangular plate 41 which has an axial length corresponding to the axial dimension of the development roll 22 and has a predetermined width w along the rotating direction of the development roll 22 (development sleeve 23).

Figure 12A:
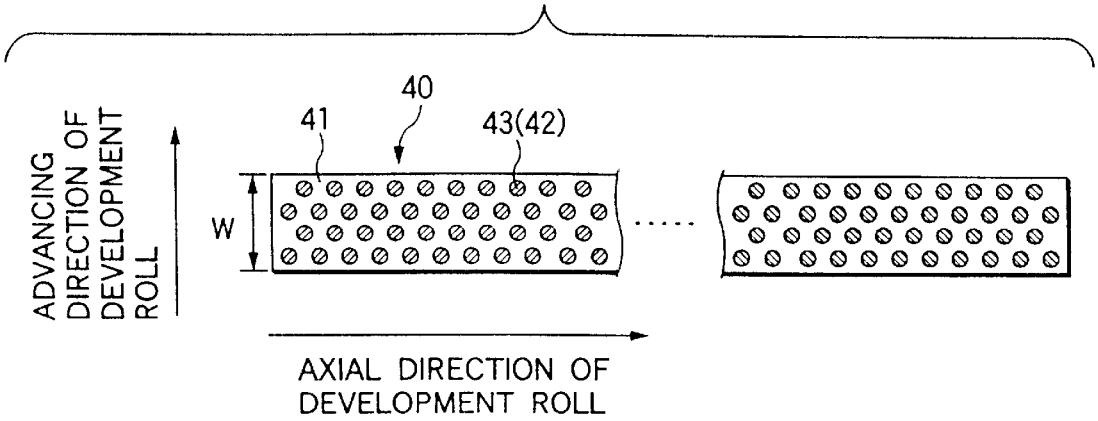
FIGS. 12A to 12C are explanatory diagrams illustrating various patterns of a charging projecting member used in the fourth embodiment.
Figure 12B:
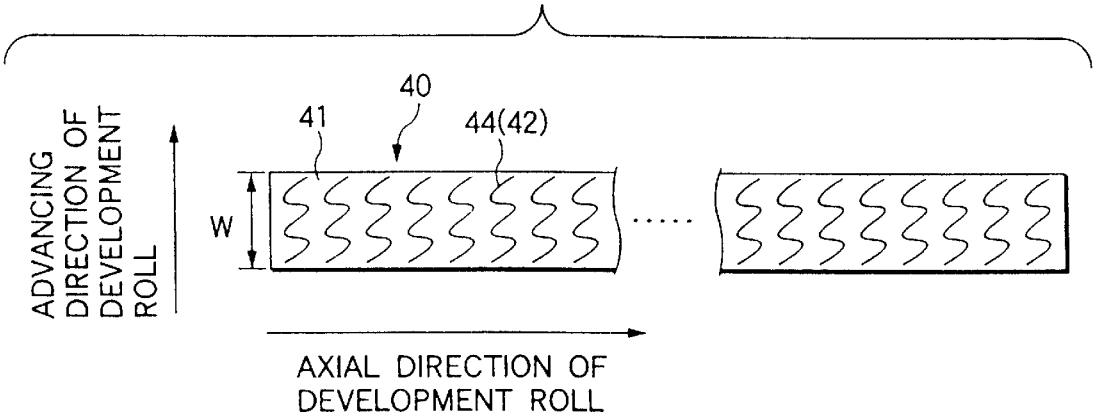
Figure 12C:
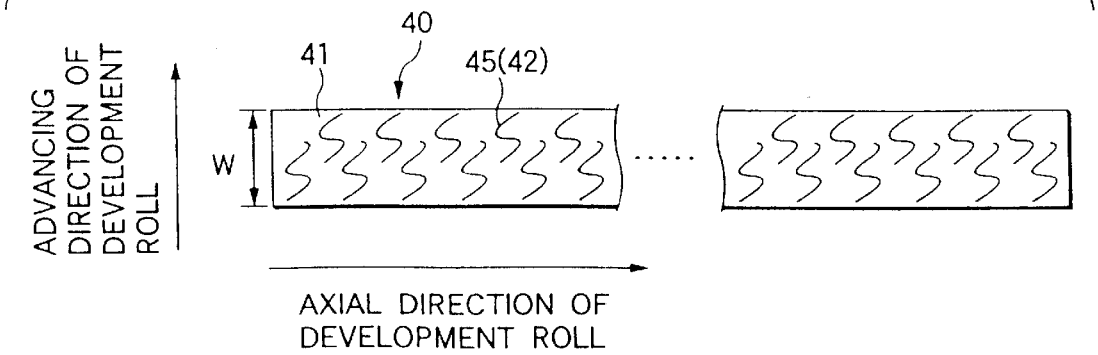

Here, the pattern of arrangement of the charging projecting portions 42 of the charging projecting member 40 may be selected, as required, from the following modes, for example. As shown in FIG. 12A, needle-like projections 43 are arranged in a staggered manner at predetermined pitch intervals with respect to the rotating direction (advancing direction) of the development roll 22. As shown in FIG. 12B, continuous wavy projections 44 are arranged at predetermined intervals along the axial direction of the development roll 22. As shown in FIG. 12C, short wavy projections 45 in two rows arranged in front and in rear along the rotating direction (advancing direction) of the development roll 22 are disposed at predetermined intervals along the axial direction of the development roll 22 and such that their positions of arrayal differ between the front and the rear.

Further, this charging projecting member 40 is disposed in such a positional relationship that the charging projecting portions 42 are embedded to an extent substantially corresponding to the layer thickness of the developer G with its layer thickness restricted.

Next, a description will be given of the operation of the developing unit in accordance with this embodiment.

First, the developer G inside the developer storage section 34 is agitated and transported to the lower side of the pickup magnetic pole 25*c* of the development roll 22 by the agitating/transporting member 37, and is reliably captured by the pickup magnetic pole 25*c* of the development roll 22.

In due course of time, at the point of time when the developer G captured by the development roll 22 reaches the vicinity of the height of the rotational center O on the surface of the development roll 22 in conjunction with the rotation of the development roll 22 (development sleeve 23), its excess portion is caused to drop by the magnetically attracting force based on the pickup magnetic pole 25*c* and the trimming magnetic pole 25*d,* and only a necessary amount is held and carried on the development roll 22 after being subjected to the restriction of its layer thickness.

Subsequently, when the development roll 2 further rotates, the developer G with its layer thickness restricted on the development roll 22 reaches the charging projecting member 40.

At this time, since the charging projecting portions 42 of the charging projecting member 40 assume the state of being embedded in the developer G being transported, the developer G passing through the charging projecting portions 42 is set in a state of turbulence due to the presence of the charging projecting portions 42. Hence, the opportunity of the surfaces of the toner and the carrier of the developer G coming into contact with each other increases, so that the charging of the toner is accelerated.

Nevertheless, although the developer g assumes the state of turbulence, since portions of the developer G pushed out to the outside by the charging projecting portions 42 passes the sides of the charging projecting portions 42, the phenomenon does not occur in which the developer G is blocked due to the presence of the charging projecting member 40 and is caused to drop downward.

Thus, in this embodiment, since the charging projecting member 40 is used as the charging member, it is possible to improve the efficiency of charging the developer G without blocking the developer G.

The charging efficiency in specific examples of the configuration of this charging projecting member 40 will be described in examples which will be described later.

For this reason, as for the developer G with its layer thickness restricted on the development roll 22, at the point of time when it passes through the charging projecting member 40, the developer G is frictionally charged sufficiently, and is transported to the development region m through the magnetic force of the transporting magnetic pole 25*e*.

In particular, in this embodiment, although the developer G assumes the state of turbulence at the point of time of passing through the charging projecting member 40, the turbulent layer of the developer G is leveled to some extent by the magnetic force of the transporting magnetic pole 25*e* at the point of time when it passes over the transporting magnetic pole 25*e* portion. Moreover, since the developer G is reliably leveled by the upper edge portion 31 (serving as both the sealing member and the leveling member) of the development housing 21, the layer of the developer G is kept in a uniform state at the point of time when the developer G on the development roll 22 reaches the development region m.

Accordingly, the development operation in the development region m is stabilized remarkably.

In addition, in this embodiment, since it is unnecessary to dispose the conventional trimming member, it is possible to dispose the charging projecting member 40 by making use of the installation space for the trimming member. Hence, the charging projecting member 40 can be simply disposed in the vicinity of the periphery of the development roll 22 correspondingly.

In addition, since it is unnecessary to use the screw augers 27 and 28 as used in the first and second embodiments in order to electrostatically charge the developer G, the unit itself can be made compact, and it is possible to suppress the degradation of the developer G accompanying the agitating and mixing operation thereof.

Further, although a method of electrostatically charging the developer G through the frictional charging between the charging projecting member 40 and the developer G is adopted in this embodiment, the invention is not limited to the same, and a design change may be made, as required.

Figure 13:
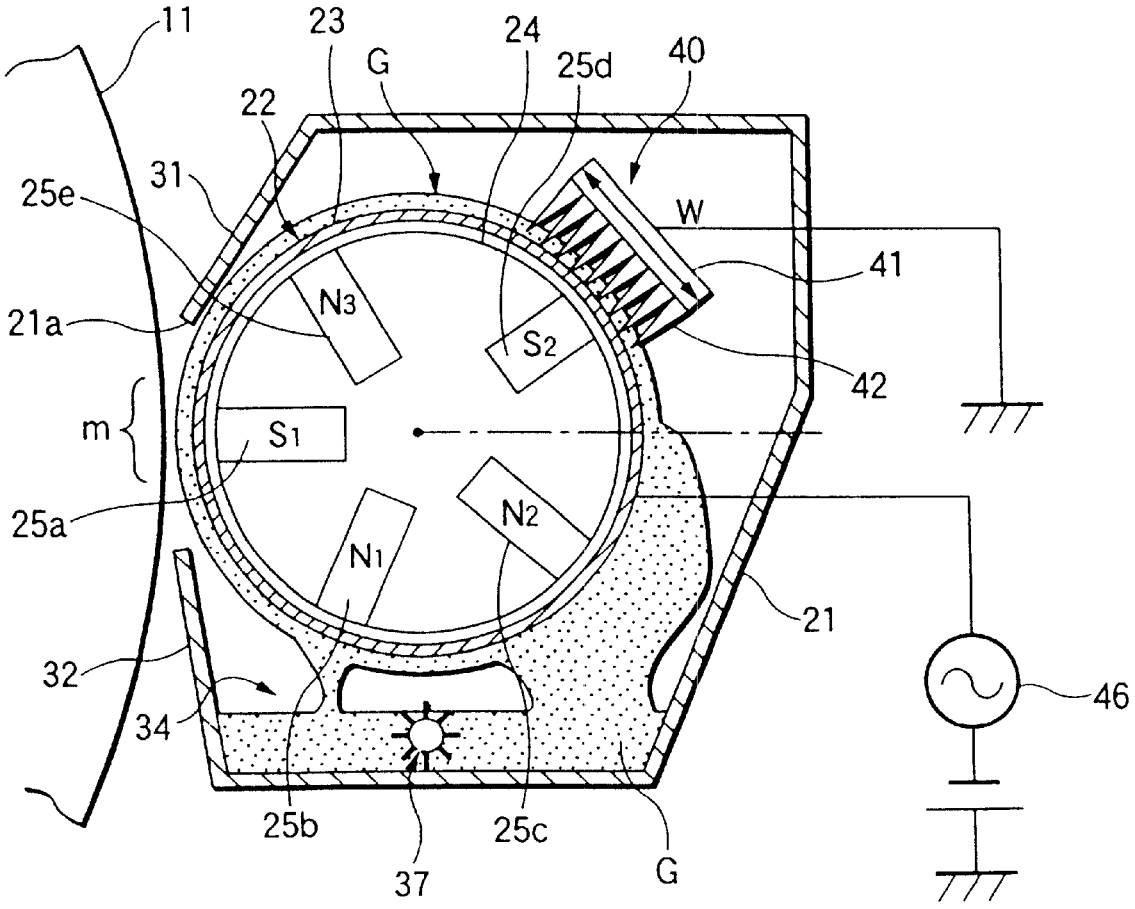
FIG. 13 is an explanatory diagram illustrating the developing unit in accordance with a modification of the fourth embodiment.

For example, in order to further enhance the efficiency of charging the developer G, it suffices if the number of times of contact between the toner and the carrier is increased. To realize this, it suffices if, as shown in FIG. 13, the charging projecting member 40 is grounded, and an ac power supply 46 is connected to the development sleeve 23 of the development roll 22, to thereby cause an alternating electric field to act between the development sleeve 23 and the charging projecting member 40.

Figure 14:
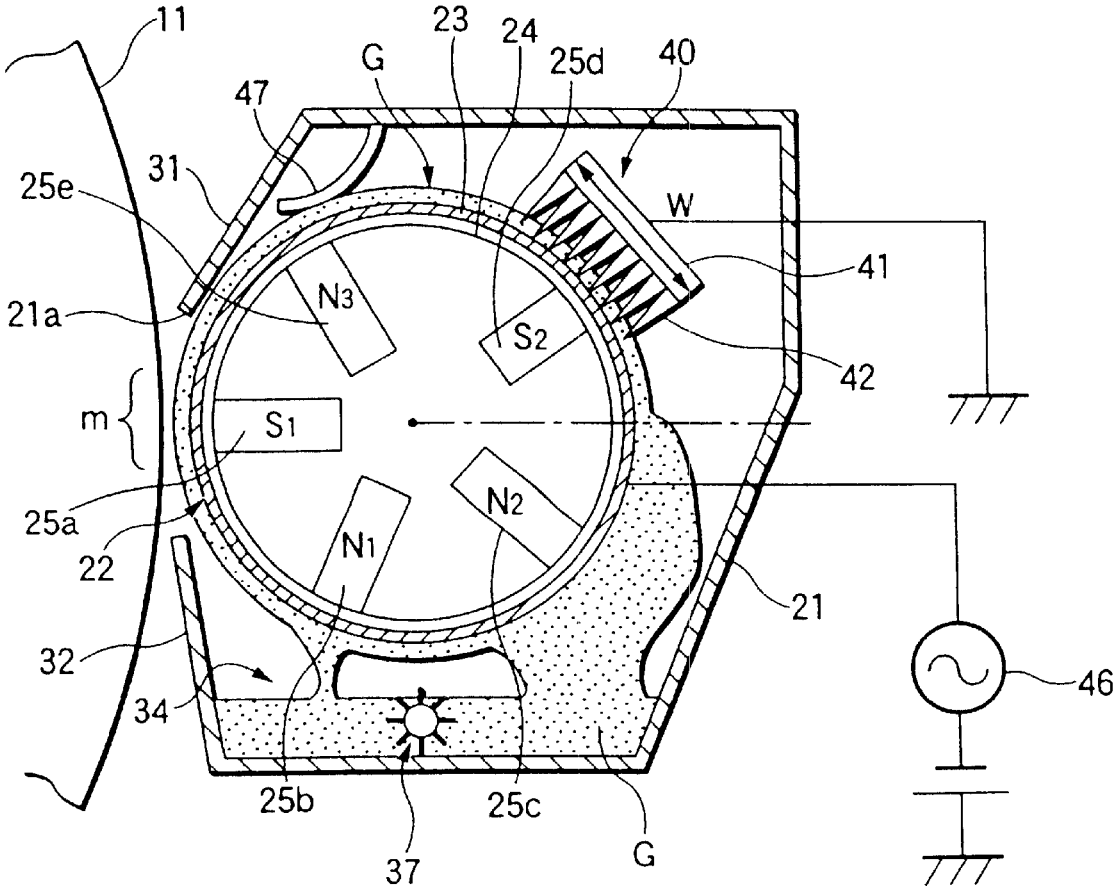
FIG. 14 is an explanatory diagram illustrating the developing unit in accordance with another modification of the fourth embodiment.

Furthermore, as shown in FIG. 14, a leveling member 47 formed of a flexible film may be separately provided on the downstream side, in the rotating direction of the development roll 22, of the charging projecting member 40 in range leading to the development region m, e.g., at a position corresponding to the transporting magnetic pole 25*e,* so as to actively level the developer G. In this mode, an alternating electric field may caused to act, as required, between the charging projecting member 40 and the development sleeve 23.

It should be noted that, in this mode, even if the trimming member is separately provided instead of the leveling member 47, since the layer thickness of the developer G is, in the first place, restricted by the layout of the magnetic poles, the amount of the layer thickness restricted by the trimming member can be set to substantially zero, thereby making it possible to minimize the stress applied to the developer G.

Figure 15:
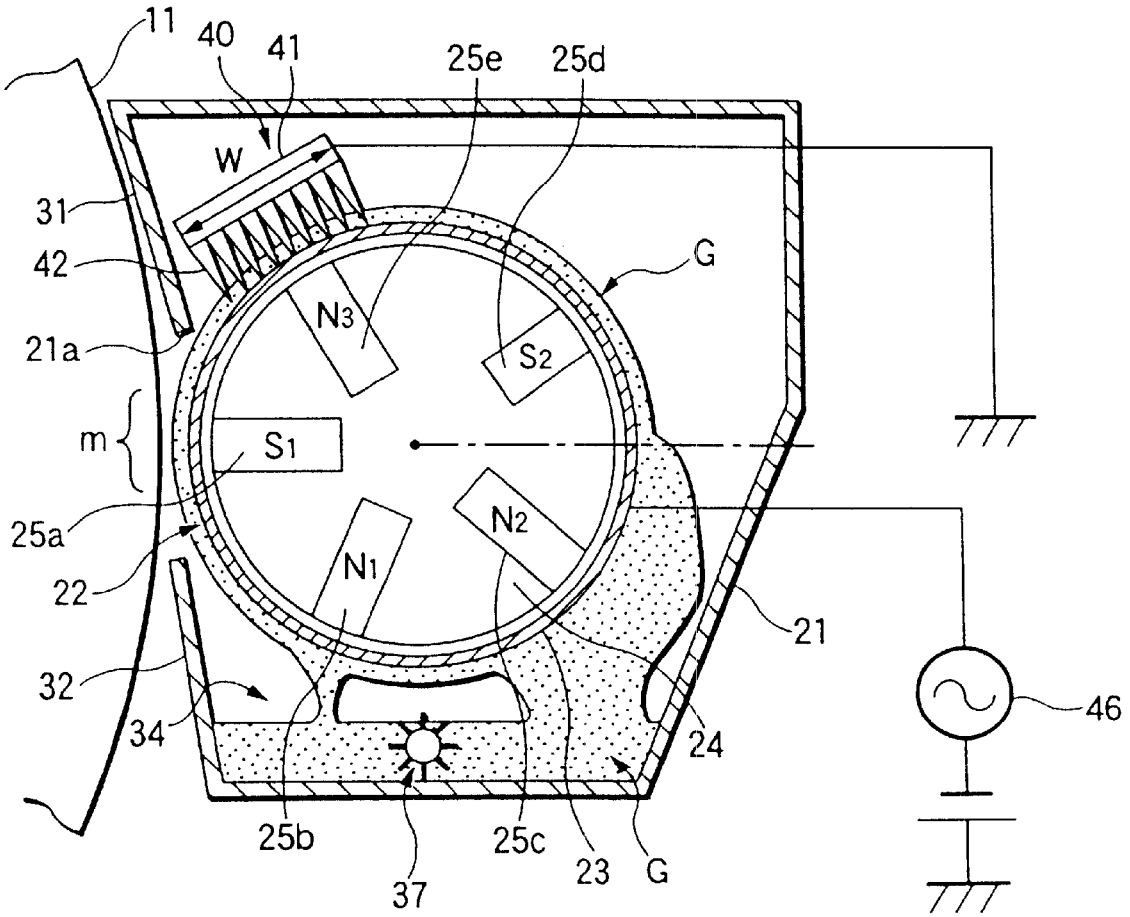
FIG. 15 is an explanatory diagram illustrating the developing unit in accordance with still another modification of the fourth embodiment.

In addition, although in this embodiment, as the layout of the charging projecting member 40, the charging projecting member 40 is disposed at a position opposing the trimming magnetic pole 25*d,* the invention is not limited to the same. For example, as shown in FIG. 15, the charging projecting member 40 may be disposed at a position opposing the transporting magnetic pole 25*e,* and an alternating electric field based on the ac power supply 46 may caused to act, as required, between the charging projecting member 40 and the development sleeve 23.

In addition, although in this embodiment the developer G is electrostatically charged by using the charging projecting member 40, the invention is not limited to the same, and a conventionally known technique may be used.

For example, after the amount of the two-component developer on the development roll is restricted, an alternating electric field is formed between the development roll and the charging member which is disposed in such a manner as to oppose the development roll and to be spaced apart from the developer with its amount restricted, the developer with its amount restricted is introduced into the charging space with the alternating electric field formed therein, and the developer is vibrated by the alternating electric field so as to effect charging (e.g., Japanese Patent No. 2592552).

With this method, however, it is difficult to sufficiently move the developer in the entire layer by only the vibration based on the alternating electric field, and there is a drawback in that it is difficult to sufficiently secure Q/M (the quantity charged per unit mass). To overcome this drawback, a need arises to enlarge the area of the charging member, for example. However, if the area of the charging member is made large, the electrostatic capacity becomes large, so that the power supply cost becomes high. In addition, if the charging member is disposed with respect to the development roll at a distance for allowing the alternating electric field to function effectively, the developer is likely to stagnate, and the stress is likely to become large, so that caution is required in the design.

In addition, as another charging system, for instance, a technique is known in which a developer-charging accelerating member opposing the development roll is provided on the upstream side of the trimming member, this developer-charging accelerating member is provided with a magnetic-field generating member, and at least one magnetic pole of the magnet roll is disposed in a development roll portion opposing this developer-charging accelerating member, so as to make variable the magnetic flux density between the developer-charging accelerating member and the development roll (e.g., the Unexamined Japanese Patent Application Publication No.2000-147903).

With this charging system, however, since a system is used in which the developer between the developer-charging accelerating member and the development roll is magnetically erected, and a magnetic brush is formed on the developer-charging accelerating member side to effect frictional charging, the developer is concentrated in the same way as the trimming member used in the usual two-component development system, so that there is concern that a very large stress is imparted to the developer. Hence, it is necessary to pay heed to it. Further, to increase the charging efficiency, as the developer-charging accelerating member it is possible to use a rotating member provided with a magnetic-field generating member, but there is concern that the cost becomes high.

Furthermore, as another charging system, there is a technique in which a rotatable layer-thickness restricting member is disposed in such a manner as to oppose the development roll, a dc voltage based on a dc power supply is applied across this layer-thickness restricting member and the development roll, a permanent magnet having at least two poles is disposed in the layer-thickness restricting member, and the magnetic poles in this layer-thickness restricting member and the magnetic poles in the development roll are disposed in face-to-face relation with magnetic poles of different polarities (e.g., the Unexamined Japanese Patent Application Publication No.Hei8-137219).

With this charging system, however, since magnetic poles are disposed inside the layer-thickness restricting member, the developer is subjected to stress based on a magnetic field, so that there is concern that the developer layer transported to the development region is liable to become nonuniform. In addition, since the aforementioned layer-thickness restricting member has a permanent magnet, there is concern that the cost is likely to become high.

Fifth Embodiment

Figure 16:
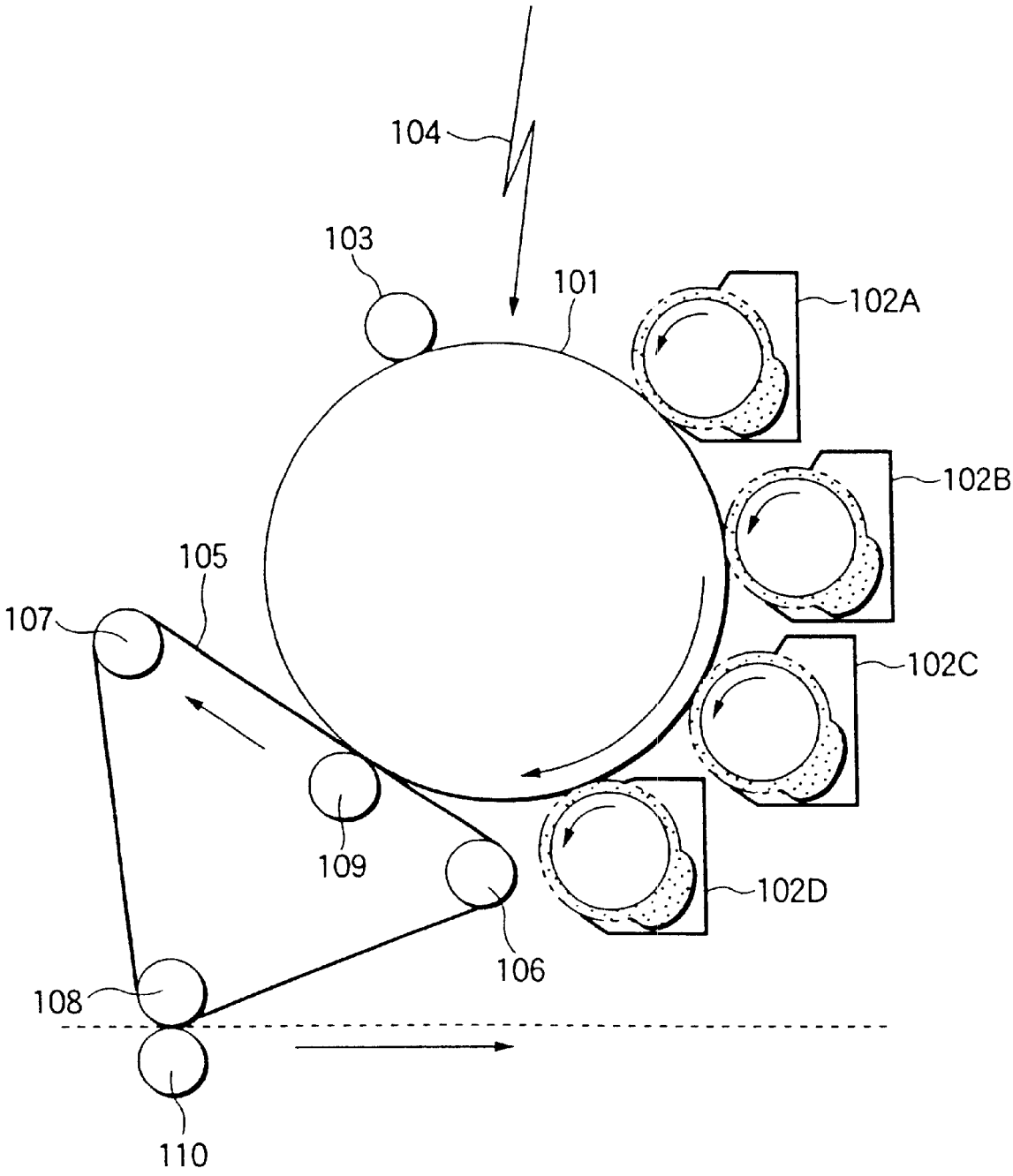
FIG. 16 is an explanatory diagram illustrating a fifth embodiment of the image forming apparatus including the developing unit to which the invention is applied.

FIG. 16 shows a fifth embodiment of an image forming apparatus including the developing units to which the invention is applied.

In the drawing, the image forming apparatus in accordance with this embodiment is a four-cycle type which is constructed as follows: Developing units 102 (specifically, 102A, 102B, 102C, and 102D) in which developers of four color components (e.g., yellow, magenta, cyan, and black) are accommodated are disposed in parallel around a photoconductor drum 101 serving as a latent image carrier. A charging roll 103 serving as a charging unit and an exposure unit (shown by a beam in this example) 104 such as a laser scanner are disposed on the upstream side, in the rotating direction of the photoconductor drum 101, of these developing units 102, while an intermediate transfer belt 105 trained around a plurality of training rolls 106 to 108 is disposed on the downstream side, in the rotating direction of the photoconductor drum 101, of the developing units 102. A primary transfer roll 109 serving as a primary transfer unit is disposed at a position on the intermediate transfer belt 105 that opposes the photoconductor drum 101, and a secondary transfer unit, e.g., a secondary transfer roll 110 using the training roll 108 as its backup roll, is disposed at a position on the intermediate transfer belt 105, so as to transfer a toner image on the intermediate transfer belt 105 on to an unillustrated recording material. It should be noted that cleaners for the photoconductor drum 101 and the intermediate transfer belt 105, and other devices (a discharger and the like) are omitted.

In accordance with this embodiment, in the case of a monochromatic mode, for instance, an electrostatic latent image of a predetermined color (e.g., black) is formed by the exposure unit 104 on the photoconductor drum 101 charged by the charging roll 103, and the electrostatic latent image is converted to a visible image with the black toner by the corresponding developing unit 102 (e.g., 102D), and is primarily transferred onto the intermediate transfer belt 105 and is secondarily transferred onto the recording material.

Meanwhile, in the case of a color mode, the charging, exposure and development processes corresponding to the respective color component images are consecutively repeated on the photoconductor drum 101, and after the color component toner images are consecutively multi-transferred onto the intermediate transfer belt 105, and are collectively transferred onto the recording material by the secondary transfer roll 110.

Figure 17:
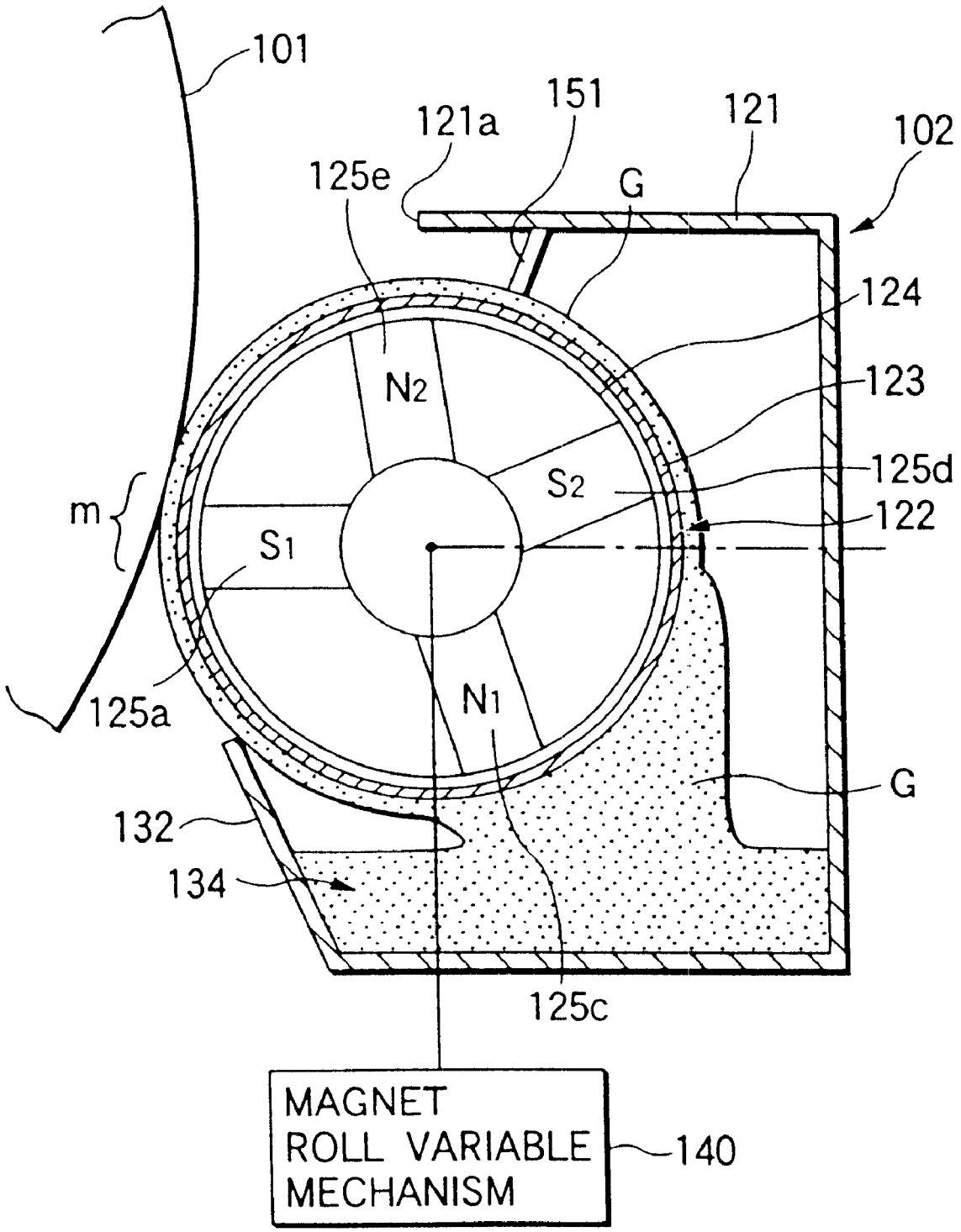
FIG. 17 is an explanatory diagram illustrating the developing unit in accordance with the fifth embodiment.

In addition, each of the developing units 102 (102A to 102D) used in this embodiment is arranged such that, as shown in FIG. 17, a development housing 121 is provided in which an opening 121*a* for development is formed in such a manner as to oppose the photoconductor drum 101, a development roll 122 is provided in face-to-face relation to the opening 121*a* for development in the development housing 121, and a developer storage section 134 for storing the two-component developer G is formed below the development roll 122 inside the development housing 121.

Here, the development roll 122 has a development sleeve 23 formed of a nonmagnetic material and adapted to rotate from the upper side toward the lower side in the development region m opposing the photoconductor drum 101, as well as a magnet roll 124 which is fixedly provided inside the development sleeve 123 and in the periphery of which a plurality of magnetic poles 125 (specifically, 125*a,* 125*c,* 125*d,* and 125*e*) are arranged.

In particular, in this embodiment, the magnet roll 124 in terms of its layout is arranged to be variably set in a set position X at the time of development and in a set position Y at the time of nondevelopment by a magnet roll variable mechanism 140.

Figure 18B:
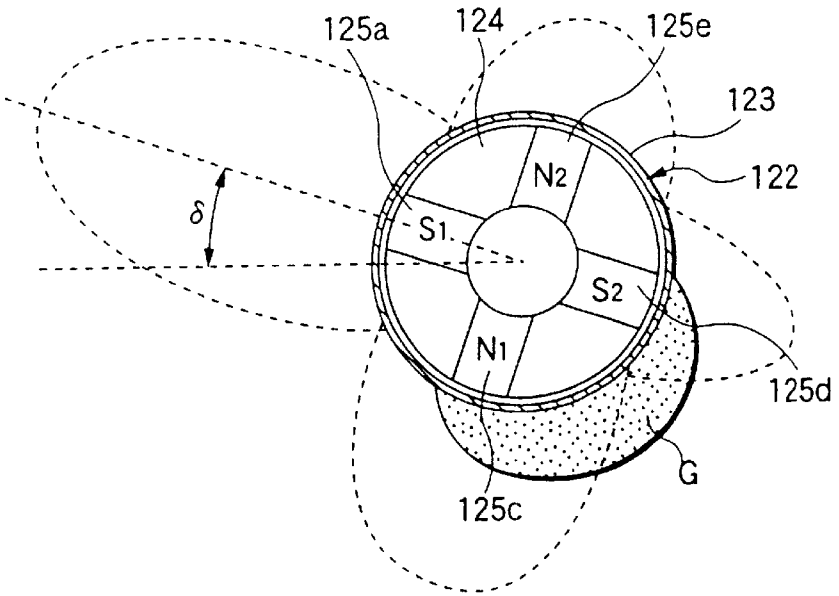
FIGS. 18A and 18B are explanatory diagrams respectively illustrating different set positions of the magnet roll of the developing unit in accordance with the fifth embodiment.
Figure 18A:
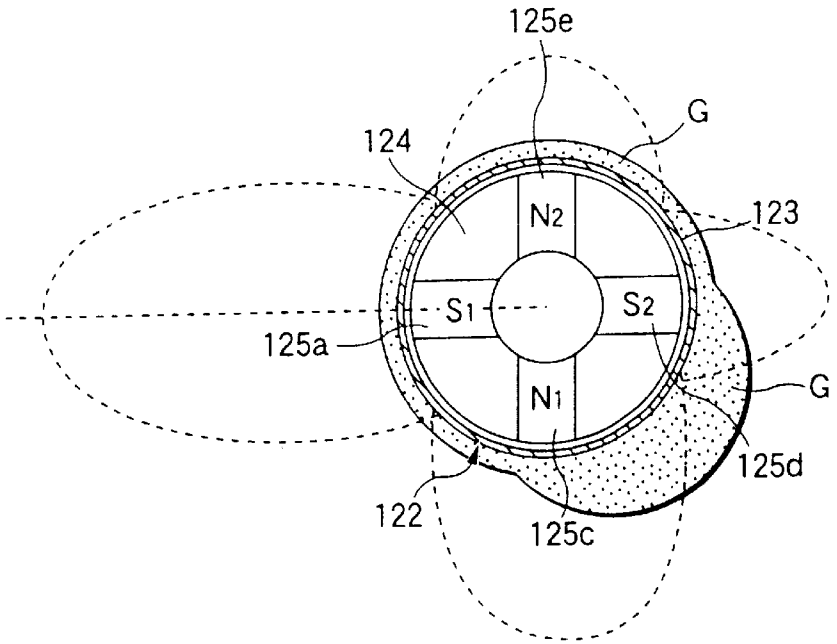

Here, as shown in FIGS. 17 and 18A, the following set position is used as the set position X of the magnet roll 124 at the time of development: For example, the development magnetic pole 125*a* (S1 in this example) is disposed on the development region m side in alignment with a horizontal plane passing through the rotating center O of the development sleeve 23 (or the development roll 122). The pickup magnetic pole 125*c* (N1) for capturing the developer is disposed on the downstream side, in the rotating direction of the development sleeve 123, of the development magnetic pole 125*a,* specifically in a region which is located on a lower side than the height of the rotational center O on the development sleeve 123 in a region where the development sleeve 123 in terms of its rotating direction is headed from the lower side toward the upper side. Further, the trimming magnetic pole 125*d* (S2 in this example) for restricting the thickness of the developer layer is disposed on the downstream side of this pickup magnetic pole 125*c* and at a position higher than the rotational center O on the development sleeve 123. Furthermore, the transporting magnetic pole 125*e* (N2 in this example) for transporting the developer is disposed on the downstream side of this trimming magnetic pole 125*d.*

In addition, as the pickup magnetic pole 125*c,* one having a strong magnetic field is used, and as the trimming magnetic pole 125*d,* one having a weaker magnetic field than the pickup magnetic pole 125*c* is used.

Meanwhile, as the set position Y of the magnet roll 124 at the time of nondevelopment, a set position is used in which, as shown in FIGS. 17 and 18B, the magnet roll 124 is rotatively moved by a predetermined angle δ (e.g., 5° to 45° or thereabouts) with respect to the rotating direction of the development sleeve 123 from the set position X of the magnet roll 124 at the time of development.

Figure 19B:
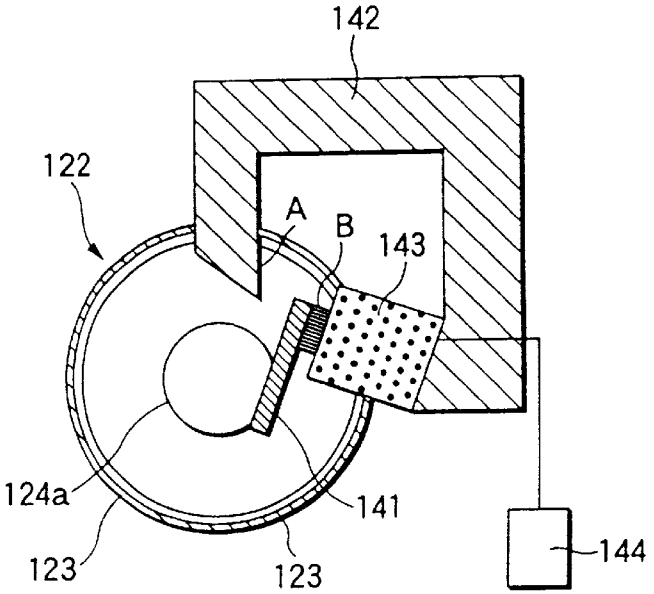
FIGS. 19A and 19B are explanatory diagrams illustrating a specific example of a magnet roll variable mechanism.
Figure 19A:
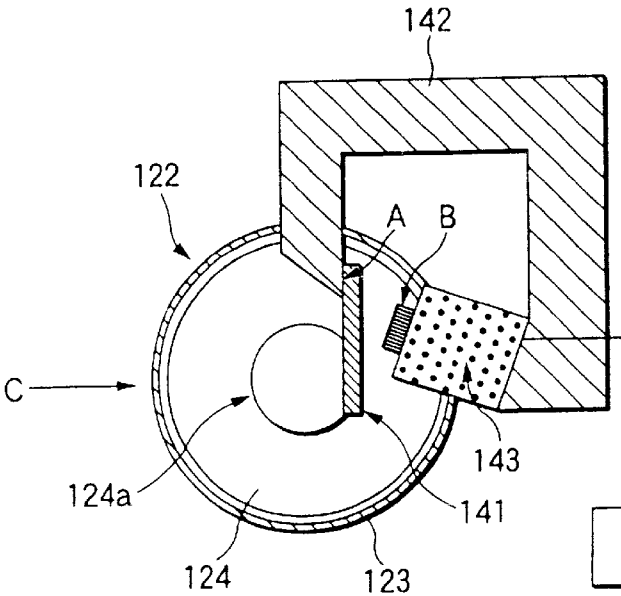
Figure 19C:
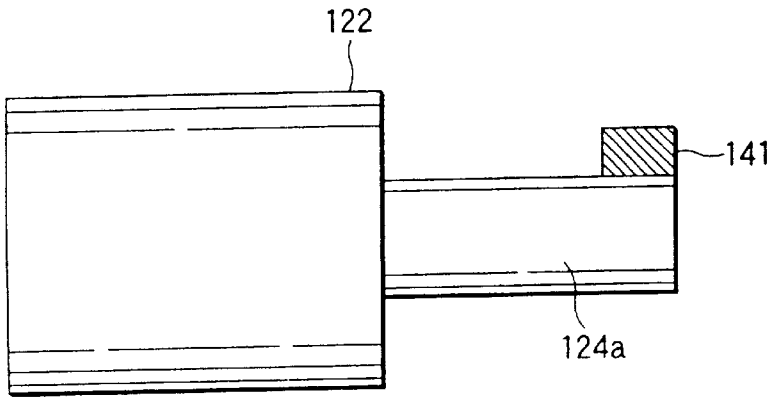
FIG. 19C is a view taken in the direction of arrow C in FIG. 19A.

Further, as the magnet roll variable mechanism 140, one is used in which, as shown in FIGS. 19A to 19C, for example, the magnet roll 124 is made rotatable about a roll shaft 124*a,* a position restricting plate 141 is fixed to this roll shaft 124*a,* a positioning bracket 142 with a substantially inverse U-shape for positioning the position restricting plate 141 at the positioning positions A and B is fixedly disposed, an electromagnet 143 is attached to one side of this positioning bracket 142, and a signal output unit 144 to which an energization signal is inputted at the time of nondevelopment is connected to this electromagnet 143.

In this mode, at the time of development, since the unillustrated developer is attached to the development sleeve 123, the magnet roll 124 also rotates in the same direction as the development sleeve 123 due to the magnetically attracting force with the developer.

Then, as the magnet roll 124 rotates, the position restricting plate 141 fixed to the roll shaft 124*a* of the magnet roll 124 also moves, and abuts against a positioning position A of the positioning bracket 142, thereby allowing the magnet roll 124 at the time of development to be positioned at the set position X (see FIG. 18A).

Meanwhile, at the time of nondevelopment, since the signal output unit 144 sends an energization signal to the electromagnet 143, the position restricting plate 141 is pulled back to a positioning position B by the electromagnet 143, thereby allowing the magnet roll 124 at the time of nondevelopment to be positioned at the set position Y (see FIG. 18B).

At this time, as for the fixation of the position restricting plate 141, the position restricting plate 141 may be held by constantly applying a voltage to the solenoid of the electromagnet 143, or the position restricting plate 141 which returned by the solenoid may be supported by a pin or the like.

Figure 20B:
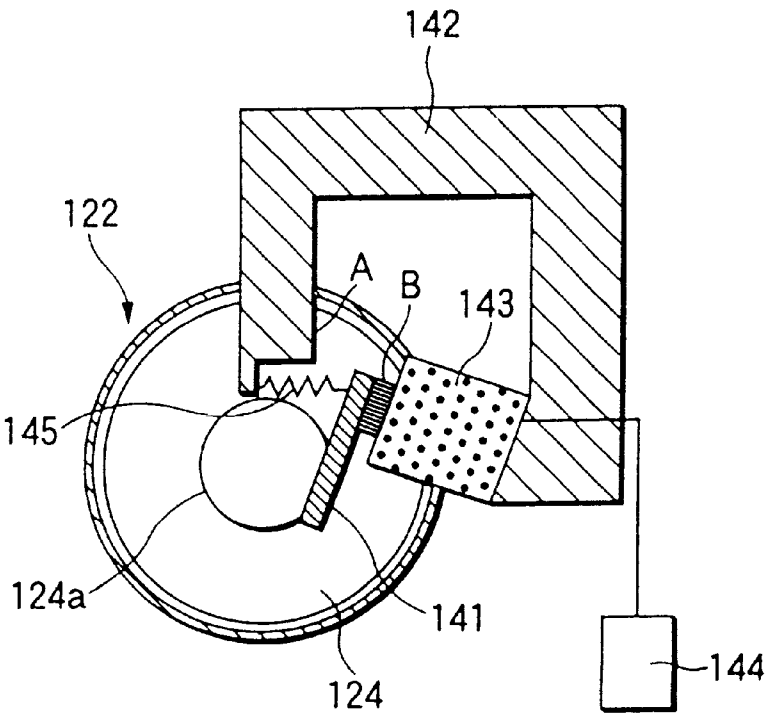
FIGS. 20A and 20B are explanatory diagrams illustrating another specific example of the magnet roll variable mechanism.
Figure 20A:
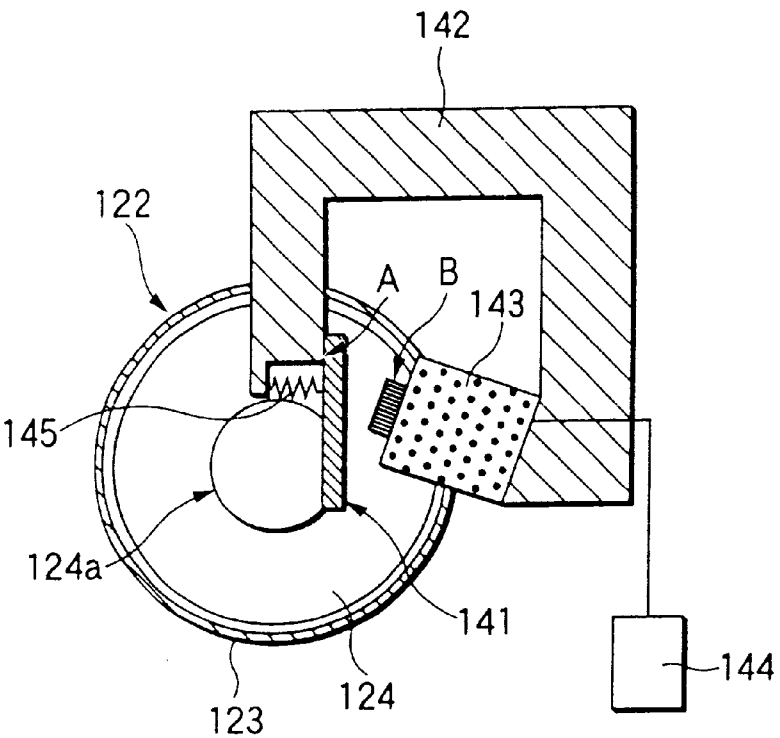

In addition, the magnet roll variable mechanism 140 is not limited to the above-described one. For example, as shown in FIGS. 20A and 20B, a return spring 145 may be interposed between the positioning bracket 142 and the position restricting plate 141 such that when the energization of the electromagnet 143 is canceled, the position restricting plate 141 is immediately returned to the positioning position A by the action of the return spring 145.

According to this mode, since the magnet roll 124 can be immediately set to the setting position X at the time of development, the development operation of the developing unit 102 can be immediately started.

Figure 21B:
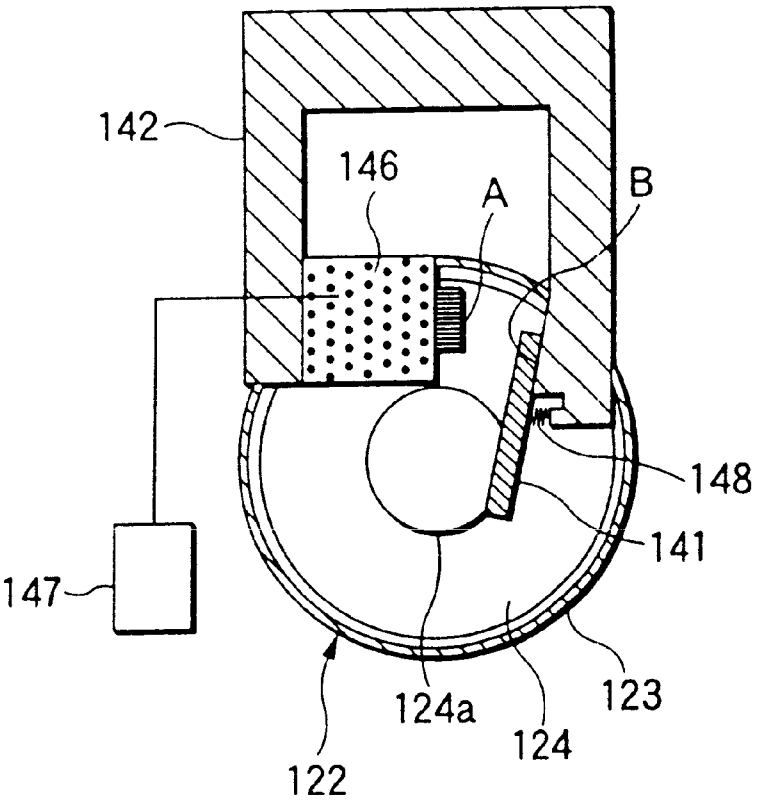
FIGS. 21A and 21B are explanatory diagrams illustrating still another specific example of the magnet roll variable mechanism.
Figure 21A:
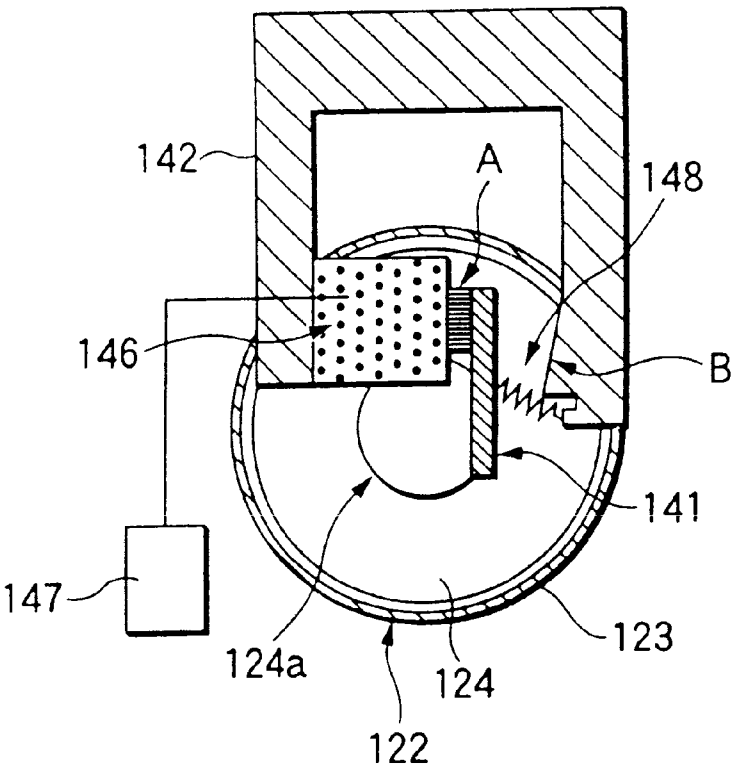

Furthermore, as the magnet roll variable mechanism 140, an arrangement may be provided such that, as shown in FIGS. 21A and 21B, for example, an electromagnet 146 is provided on the positioning position A side of the positioning bracket 142, a signal output unit 147 to which an energization signal is inputted at the time of development is connected to this electromagnet 146, and a return spring 148 may be interposed between the positioning restricting plate 141 and the positioning position B side of the positioning bracket 142.

According to this mode, at the time of development, since the signal output unit 147 sends an energization signal to the electromagnet 146, the position restricting plate 141 is attracted to and fixed at the positioning position A by the electromagnet 146, thereby allowing the magnet roll 124 at the time of development to be positioned at the set position X.

Meanwhile, at the time of nondevelopment, at the same time as the energization of the electromagnet 146 is canceled, the position restricting plate 141 can be immediately returned to the positioning position B by the action of the return spring 148, thereby allowing the magnet roll 124 to be immediately set at the set position Y at the time of nondevelopment.

Next, a description will be given of the operation of the developing units and the image forming apparatus in accordance with this embodiment.

First, a description will be given of the operation of the developing unit 102 in accordance with this embodiment. At the time of development, the magnet roll 124 is set to the set position X (see FIG. 18A) by the magnet roll variable mechanism 140.

Figure 22B:
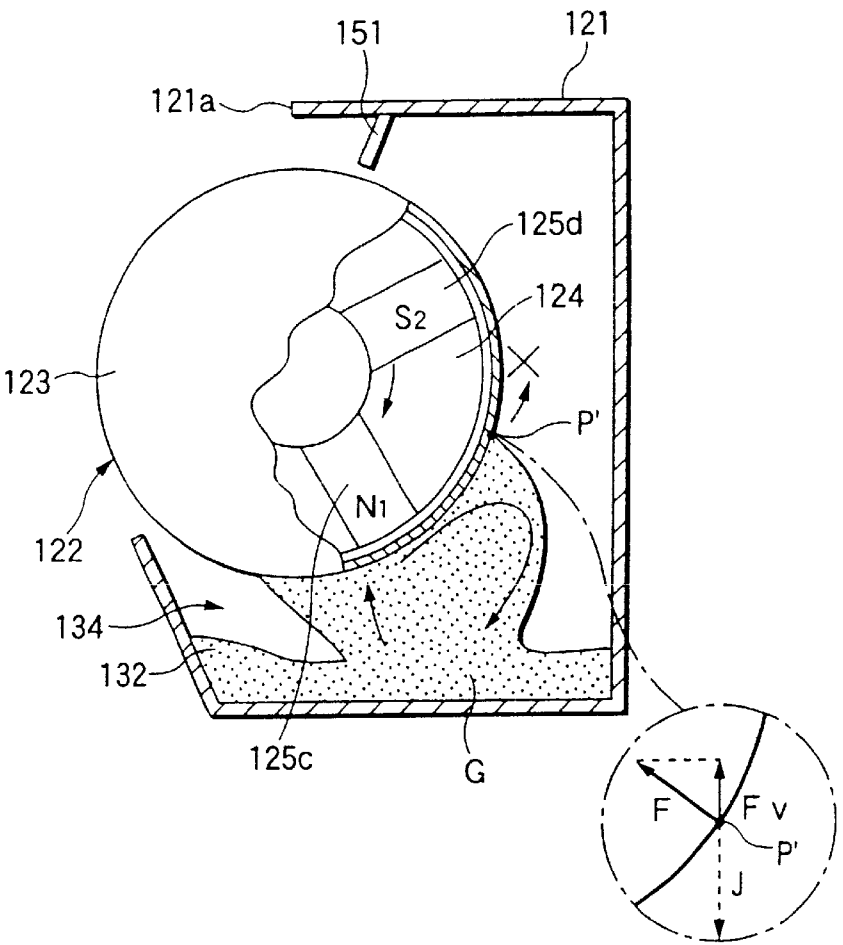
FIGS. 22A and 22B are explanatory diagrams respectively illustrating the process of operation at the time of development of the developing unit and the process of operation at the time of nondevelopment thereof in accordance with the fifth embodiment.
Figure 22A:
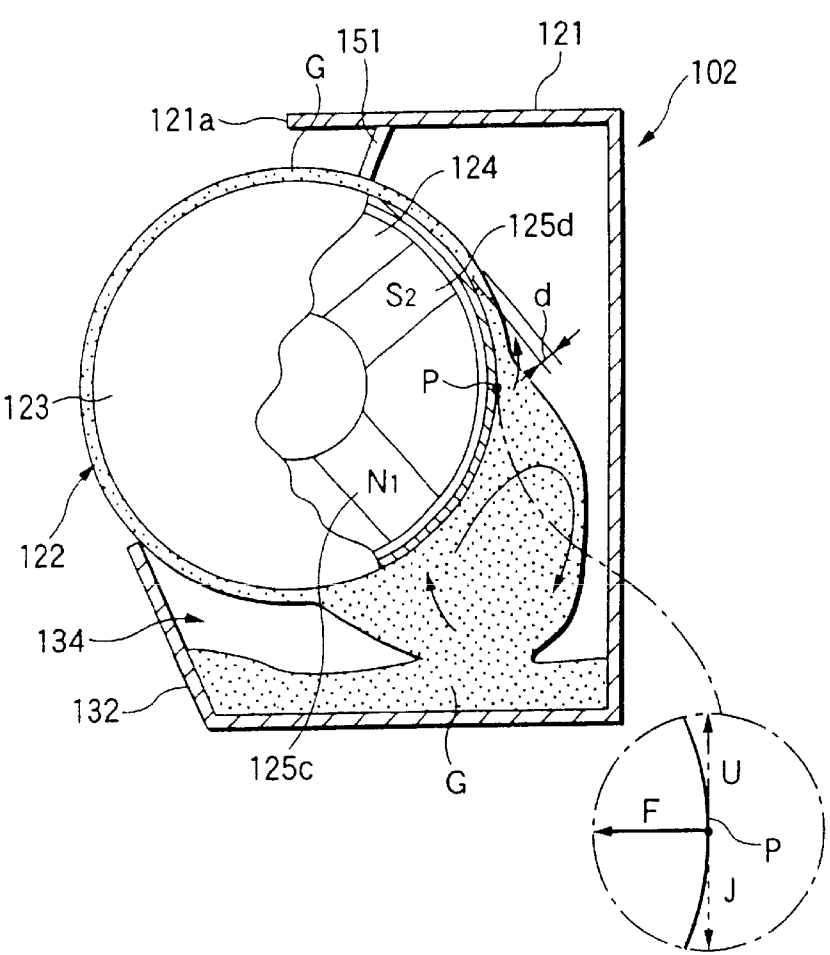

In this state, the developer G stored in the in the developer storage section 134 of the development housing 121 is captured by the magnetic force of the pickup magnetic pole 125*c*, as shown in FIGS. 17 and 22A.

Subsequently, as the development roll 122 (development sleeve 123) rotates, the developer G on the development roll 122 is transported to the vicinity of the height of the rotational center O on the surface of the development roll 122. However, when this developer G reached that portion, since the magnetically attracting force based on the pickup magnetic pole 125*c* and the trimming magnetic pole 125*d* becomes weaker than that of the pickup magnetic pole 25*c*, an excess portion of the developer G being carried on the surface of the development roll 122 drops, so that only a necessary amount is carried on the surface of the development roll 122.

Consequently, the developer G on the development roll 22 in a state of being restricted to the predetermined layer thickness d is transported to the development region m along the magnetic forces of the trimming magnetic pole 125*d* and the transporting magnetic pole 125*e*.

In addition, in this embodiment, as shown in FIGS. 17 and 22, a sealing/leveling member 151 is separately provided on the downstream side, in the rotating direction of the development roll 122, of the trimming magnetic pole 125*d*, and is disposed in such a manner as to be spaced apart from the development roll 122 by a portion corresponding to the restricted layer thickness d of the developer G. By virtue of the presence of this sealing/leveling member 151, the leakage of the toner cloud in the development housing 121 is prevented, and the surface of the developer G layer is leveled.

Then, in the development region m the electrostatic latent image on the photoconductor drum 101 is converted to a visible image by the action of the development magnetic pole 125*a*, and the remaining developer G which passed the development region m is returned again into the development housing 121 and is captured again together with the other developer G by the pickup magnetic pole 125*c* so as to be used for ensuing development.

It should be noted that, in this example, a lower edge portion 132 of the opening 121*a* for development in the development housing 121 is disposed in such a manner as to be spaced apart from the development roll 122 by the portion of the restricted layer thickness d, and is adapted to function as a sealing member for preventing the leakage of the toner cloud in the development housing 121.

Meanwhile, at the time of nondevelopment, the magnet roll 124 is set to the set position Y (see FIG. 18B) by the magnet roll variable mechanism 140.

In this state, the developer G stored in the developer storage section 134 of the development housing 121 is captured by the magnetic force of the pickup magnetic pole 125*c*, as shown in FIGS. 17 and 22B. However, since the pickup magnetic pole 125*c* and the trimming magnetic pole 125*d* move to the upstream side in the rotating direction of the development roll 122 with respect to the position at the time of development, the position P corresponding to the vicinity of the height of the rotational center O on the surface of the development roll 122 at the time of development moves to a lower P'. As a result, the effect of gravity becomes greater than the transporting force at that portion, so that all the developer G which reached the vicinity of that height drops down due to the gravity.

Namely, at the time of development, as shown in FIG. 22A, the transporting force U obtained by multiplying a magnetically attracting force F by a coefficient of friction acts in the upward direction at the position P corresponding to the vicinity of the height of the rotational center O on the surface of the development roll 122, and the developer G is transported under the condition that this transporting force U is greater than the gravity J. In contrast, at the time of nondevelopment, as shown in FIG. 22B, a vertical component Fv of the magnetically attracting force F acts in the upward direction at the position P' which was moved downward on the surface of the development roll 122. However, this vertical component Fv (Fv<F) is likely to be smaller than the gravity J, so that the developer G which reached this position P' drops due to the gravity J.

For this reason, at the time of nondevelopment, as shown in FIG. 22B, the developer G ceases to be directed toward the trimming magnetic pole 125*d* side by being held on the development roll 122, and the developer G on the development roll 122 is not supplied to the development region m.

Next, a description will be given of the operation of the image forming apparatus incorporating the above-described developing units 102.

If it is now assumed that the development of a first color is being effected by the developing unit 102A, the magnet roll 124 of the developing unit 102A is set to the set position X (development position), but since the other developing units 102B to 102D are in the state of nondevelopment, their magnet rolls 124 are set to the set position Y (nondevelopment position).

Then, upon completion of the development of the first color, the magnet roll 124 of the developing unit 102A is set to the set position Y, and the magnet roll 124 of the developing unit 102B for the second color is set to the set position X. Incidentally, the magnet rolls 124 of the third and fourth developing units 102C and 102D remain in the set position Y.

Subsequently, upon completion of the development of the second color, the magnet roll 124 of the developing unit 102B is set to the set position Y, and the magnet roll 124 of the developing unit 102C for the third color is set to the set position X. Incidentally, the magnet rolls 124 of the first and fourth developing units 102A and 102D remain in the set position Y.

Further, upon completion of the development of the third color, the magnet roll 124 of the developing unit 102C is set to the set position Y, and the magnet roll 124 of the developing unit 102D for the fourth color is set to the set position X. Incidentally, the magnet rolls 124 of the first and second developing units 102A and 102B remain in the set position Y.

Through the above-described process, a toner image in which four colors are superposed is formed on the intermediate transfer belt 105, and is collectively transferred onto the recording material in due time and fixed by an unillustrated fixing unit before it is outputted.

In such an image forming process, only the developing unit 102 at the time of development effects the development operation, and the developer is not supplied to the development region m in the case of the developing units 102 at the time of nondevelopment. Therefore, only a respective color-component toner image is formed on the photoconductor drum 101 on each occasion of development, so that there is no possibility of other color-component toners from becoming mixed in.

In addition, in this embodiment, as the means for preventing the supply of the developer to the development region m of the developing unit 102 at the time of nondevelopment, the technique of offsetting the position of the magnet roll 124 is used. Therefore, a mechanism for reversely rotating the development sleeve 123 and a mechanism for stopping the rotation of the development sleeve 123 are not required, and the technique of scraping off the developer is not adopted. Hence, it is possible to effectively prevent such as the vibration occurring at the time of scraping off the developer, and it is possible to provide a developing unit of a compact and inexpensive configuration.

For instance, since the developer on the development roll 122 can be removed without stopping or reversing the rotation of the development sleeve 123, it is unnecessary to control the on/off driving of the development sleeve 123, it is possible to use the same drive for each color, thereby making it possible to effectively reduce the cost of the drive systems.

Further, in this embodiment, since the angle of movement of the magnet roll 124 is small in the range of 5.° to 45.°, and the driving torque is small, so that the magnet roll variable mechanism 140 can be realized by a relatively simple mechanism.

Figure 23B:
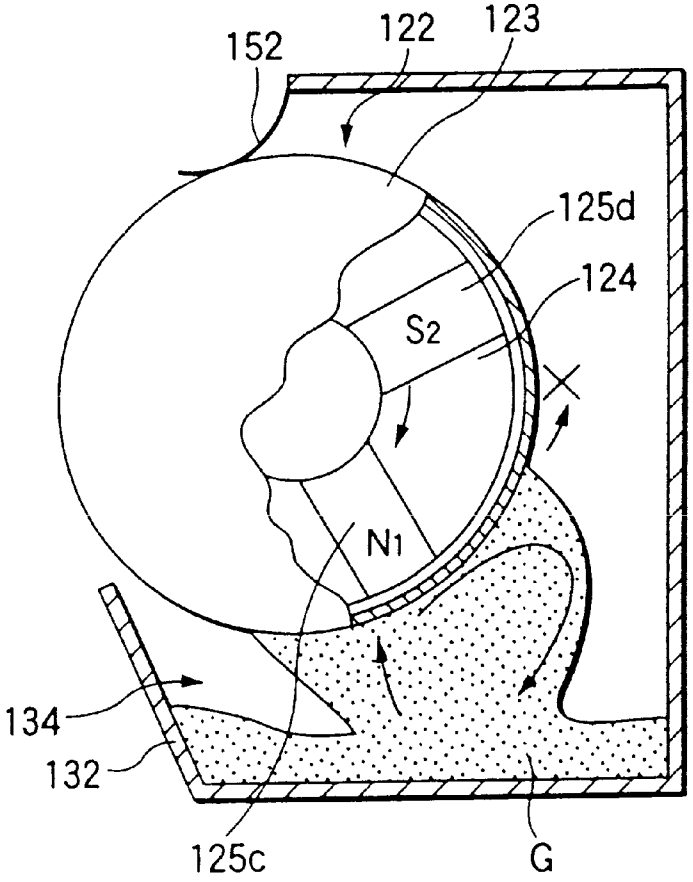
FIGS. 23A and 23B are explanatory diagrams respectively illustrating the process of operation at the time of development of the developing unit and the process of operation at the time of nondevelopment thereof in accordance with a modification of the fifth embodiment.
Figure 23A:
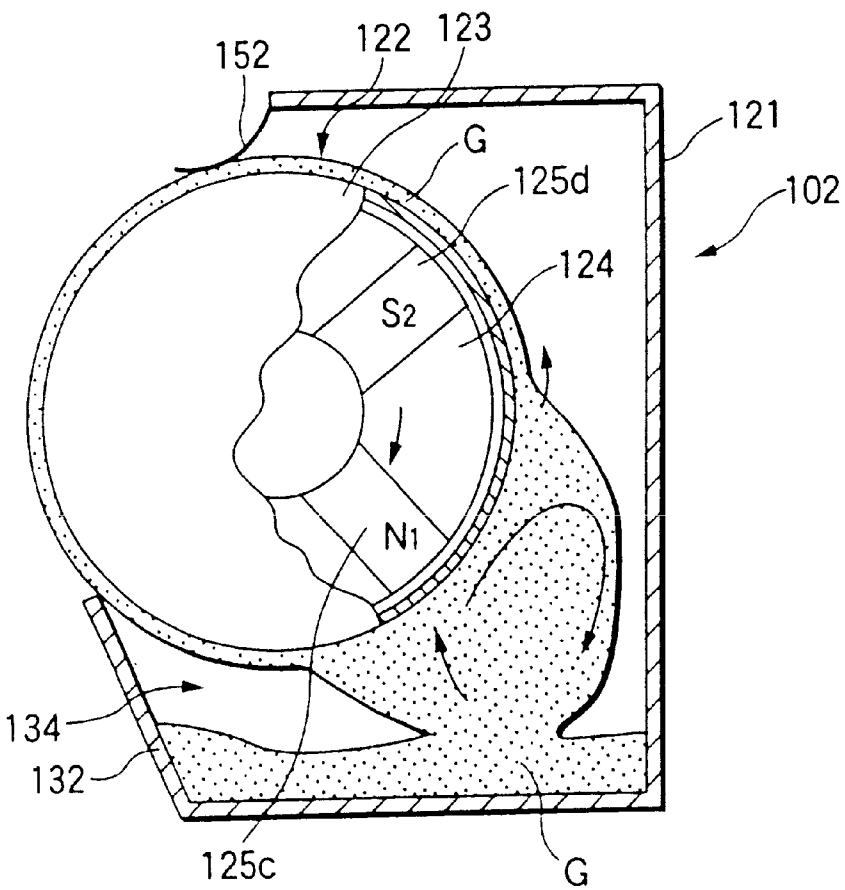

Furthermore, although in this embodiment the sealing/leveling member 151 is provided inside the development housing 121, the invention is not limited to the same, and an arrangement may be provided such that, as shown in FIGS. 23A and 23B, a film seal 152 formed of a flexible film or the like is provided at an upper edge portion of the opening 121*a* for development in the development housing 121 so as to prevent the leakage of the toner cloud by means of this film seal 152.

It should be noted, however, that this film seal 152 should be preferably of such a type as not to cause convection in or blockage to the developer G so as not to disturb the developer G whose layer thickness has been restricted.

EXAMPLES

Example 1

Figure 24B:
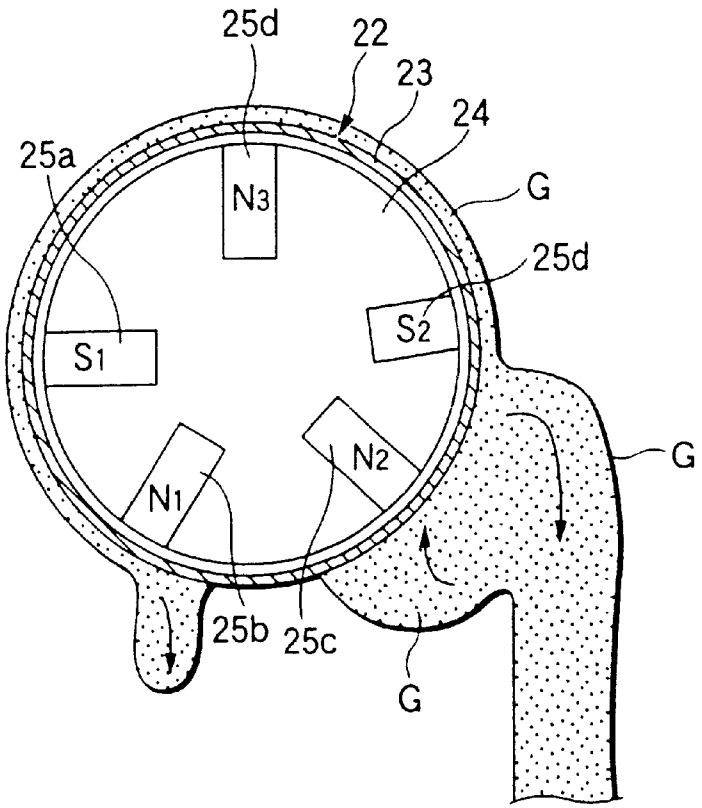
FIG. 24B is an explanatory diagram illustrating the behavior of the developer when the development roll in accordance with Example 1 was used.
Figure 24A:
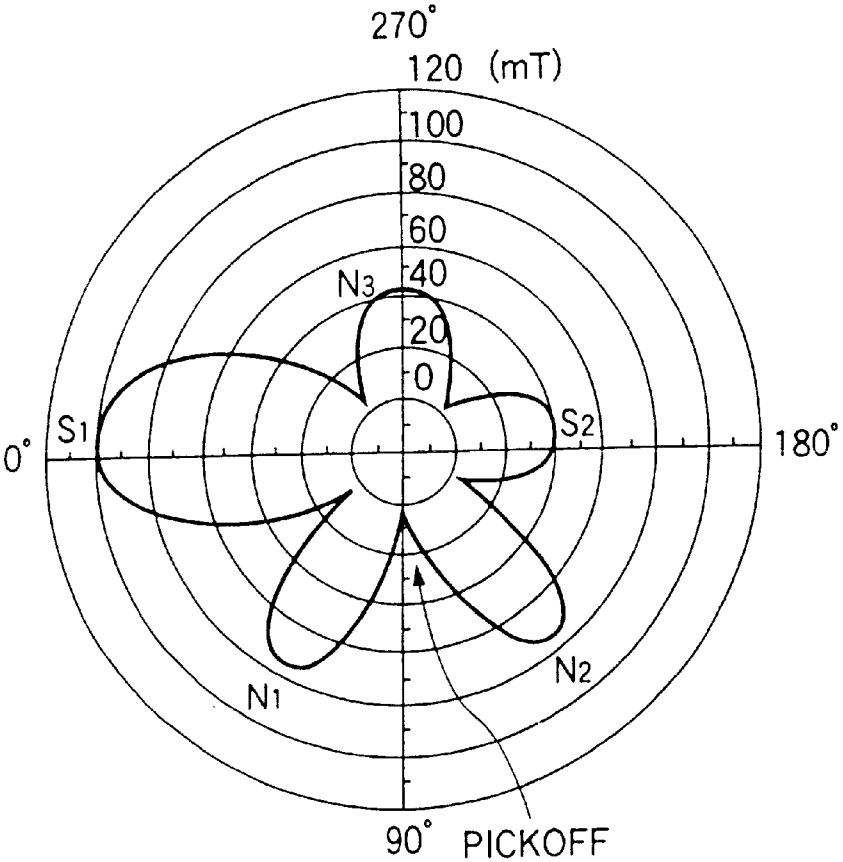
FIG. 24A is an explanatory diagram illustrating the magnetic force distribution of the magnetic poles of the magnet roll in accordance with Example 1.

In a developing unit in accordance with the first embodiment, peak magnetic flux densities and the angular layout (shown by counterclockwise angular deflections with respect to adjacent magnetic poles) of the respective magnetic poles 25*a* to 25*e* (S1, N1, N2, S2, and N3) are shown in FIGS. 24A and 24B, respectively.

According to the drawings, the angular layout and peak magnetic flux densities of the magnetic poles are as follows:

S1 (97 mT)/63°/N1(72 mT)/60°/N2(71 mT)/S2(40 mT)/85°/N3(42 mT)

As for the conditions used in this example, the development roll 22 having a diameter of 18 mm and a surface roughness Rz of 8 to 10 $\mu$m was used, the restricted layer thickness d of the developer was set to 0.75 mm, the amount of developer and the distance between the development roll 22 and the lower portion of the development housing 21 were adjusted so that all the developer would be released (picked off) and captured (picked up) again on the lower side, and the development roll 22 was rotated at the surface speed of 100 mm/sec.

As the developer, one was used in which a ferrite carrier with a saturation magnetization of 60 emu/g and a volume average particle size of approx. 50 $\mu$m and a polyester toner with an average particle size of approx. 7.5 $\mu$m, which were subjected to charging adjustment by using a carrier coating agent and toner external additives, were mixed to a toner density of 8%.

Comparative Example 1

Figure 27B:
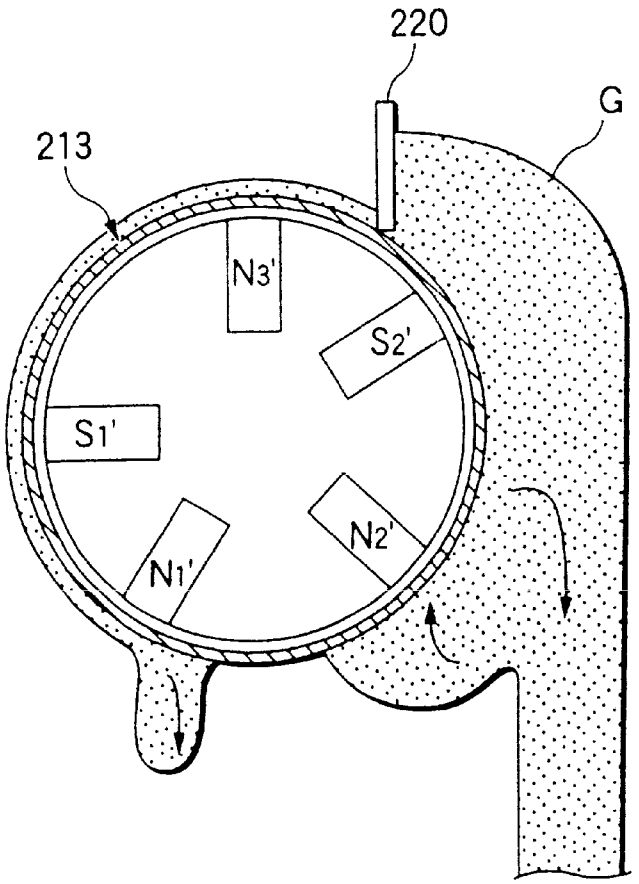
FIG. 27B is an explanatory diagram illustrating the behavior of the developer when the development roll in accordance with Comparative Example 1 was used.
Figure 27A:
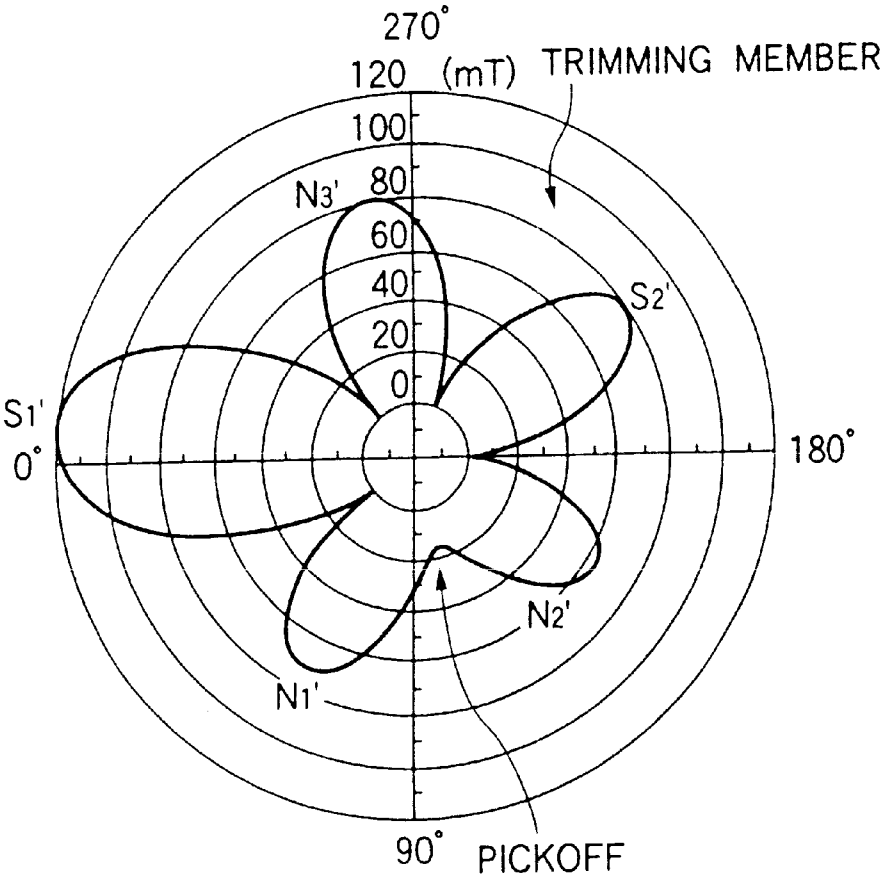
FIG. 27A is an explanatory diagram illustrating the magnetic force distribution of the magnetic poles of the magnet roll in accordance with Comparative Example 1.

Peak magnetic flux densities and the angular layout of magnetic poles S1' to N3' of a development roll 213 of the developing unit are shown in FIGS. 27A and 27B, respectively.

Specifically, the center of the development magnetic pole (S1') was located at the position of +3° in the clockwise direction with respect to the height of the rotational center of the development roll 213 on the development region side, and the angular positional relationship and peak magnetic flux densities of the magnetic poles from that position in the downstream direction of flow of the developer can be expressed as follows:

S1'(122 mT)/63°/N1'(71 mT)/90°/N2'(62 mT)/65°/S2'(80 mT)/20°/trimming member/50°/N3'(85 mT)

As for the conditions used in this comparative example, a development roll having a diameter of 18 mm and a surface roughness Rz of 8 to 10 μm was used, a trimming member 220 was attached with a gap of 0.75 mm, and the other conditions were set in the same way as Example 1.

According to Example 1, as shown in FIG. 24B, the developer G captured by the pickup magnetic pole 25*c* (N2) tents to be carried upward by the rotation of the development roll 22, but a portion of the developer G drops in the vicinity of a plane horizontal to the height of the rotational center O on the surface of the development roll 22.

This is due to the fact that although the magnetically attracting force is strong at the surface of the development roll 22 corresponding to the pickup magnetic pole 25*c,* and a large amount of developer G is hence held, the magnetically attracting force rapidly becomes weak at the surface of the development roll 22 leading to the trimming magnetic pole 25*d,* so that the developer which can be no longer held by the magnetically attracting force drops, thereby forming a thin developer layer.

In contrast, in the case of Comparative Example 1, as shown in FIG. 27B, the developer reaches the trimming member 220 as held on the development roll 213, and its layer thickness is restricted by the trimming member 220.

At this time, if the development roll used in Example 1 is employed, even if the trimming member is provided, the convection of toner in the vicinity of the trimming member is very small, and the stress imparted to the developer can be suppressed to one-tenth to one-hundredth or thereabouts of Comparative Example 1.

Figure 29:
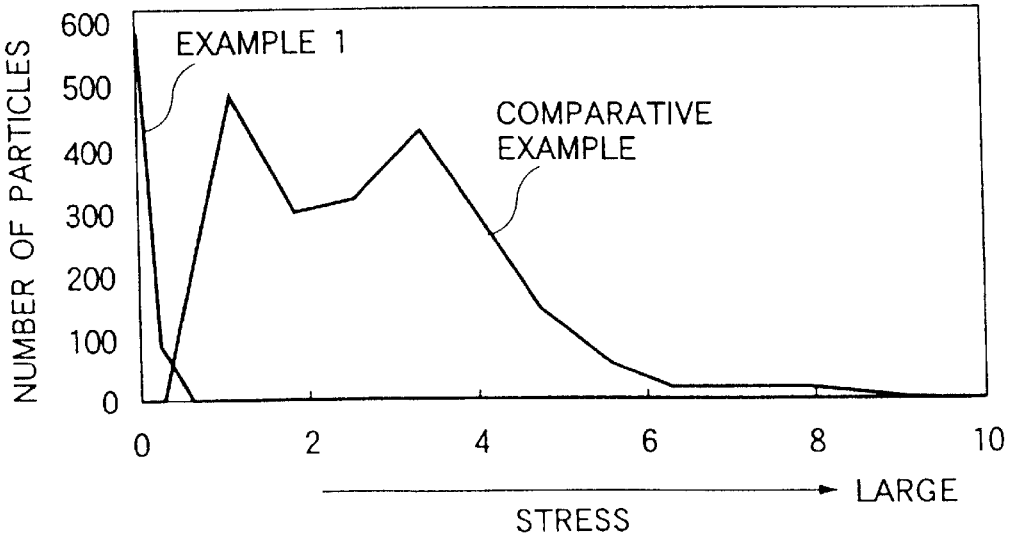
FIG. 29 is an explanatory diagram illustrating the results obtained by performing simulation calculation of the distribution of stresses to which the toner was subjected in Example 1 and Comparative Example 1.

FIG. 29 shows the results of simulation of stresses to which the toner was subjected in Example 1 and Comparative Example 1. It can be appreciated from this diagram that only a very weak stress is applied to the developer in Example 1 as compared with Comparative Example 1.

Example 2

An L9 straight test was performed by varying the conditions of the layout of magnetic poles of the development roll 22 in the developing unit (the mode in which the pickoff process by means of the pair of magnetic poles of the same polarity is not used) in accordance with the first embodiment.

The development magnetic pole was disposed in alignment with the horizontal plane passing through the center O of rotation of the development roll 22 on the development region m side, the pickup magnetic pole was disposed 90° offset in the downstream direction of flow of the developer, the transporting magnetic pole was disposed at a position 210° offset therefrom, and the trimming magnetic pole was disposed at a position 120° offset from the pickup magnetic pole (N1) as the center. As for the trimming magnetic pole, there are cases where one pole was used and three poles were used. In the case of three poles, magnetic poles having substantially the same intensity were respectively disposed at a central position and two positions offset 300 before and after it.

As for polarities, the development magnetic pole had the S pole, followed by alternately arranged N and S.

The magnetic flux density of the development magnetic pole on the surface of the development roll 22 was set to 90 mT, and the magnetic flux density of the transporting magnetic pole to approx. 40 mT so that it would not exert an influence when the magnetic flux density of the pickup magnetic pole was small.

Further, the development roll having a diameter of 18 mm and a surface roughness Rz of 8 to 10 μm was used, the amount of developer and the distance between the development roll 22 and the lower portion of the development housing were adjusted so that all the developer would be released (picked off) and captured (picked up) again on the lower side, and the development roll 22 was rotated at the surface speed of 300 mm/sec.

As the developer, one was used in which a ferrite carrier with a saturation magnetization of 60 emu/g and a volume average particle size of approx. 50 μm and a polyester toner with an average particle size of approx. 7.5 μm, which were subjected to charging adjustment by using a carrier coating agent and toner external additives, were mixed to a toner density of 8%.

Figure 25A:
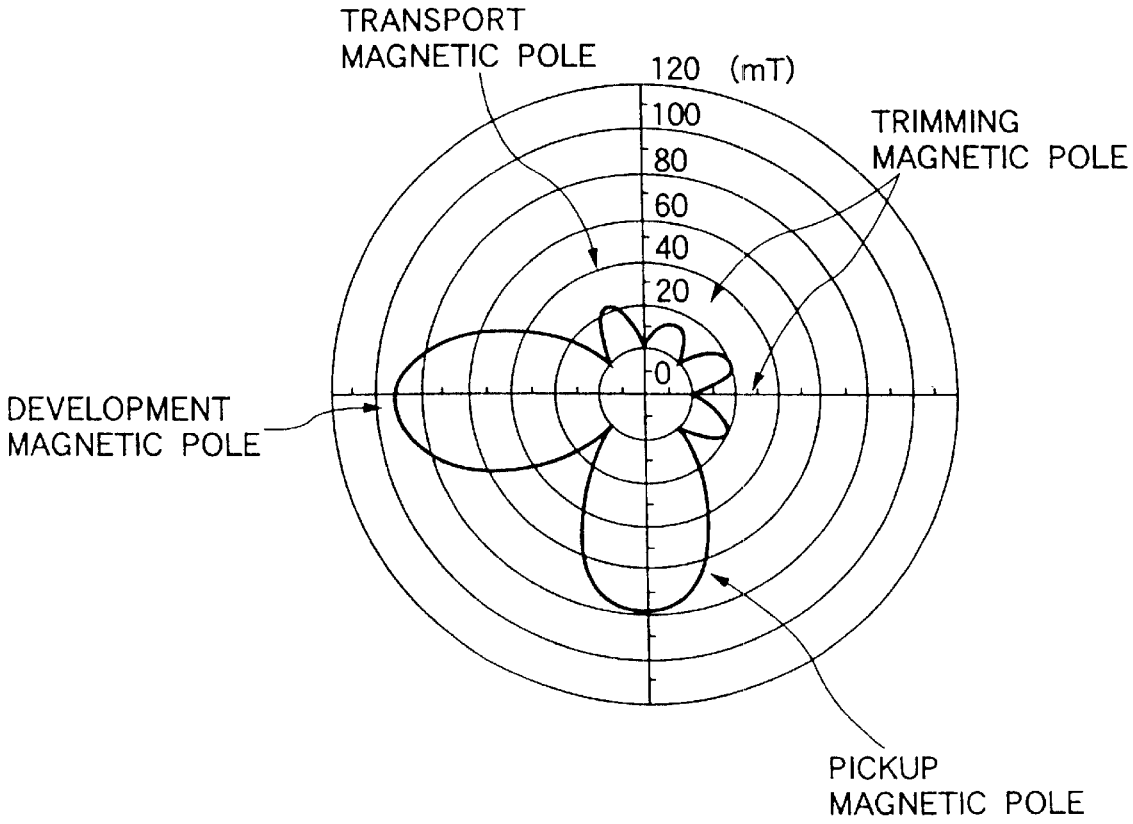
FIG. 25A is an explanatory diagram illustrating the magnetic force distribution of the magnetic poles of the magnet roll in accordance with Example 2.
Figure 25B:
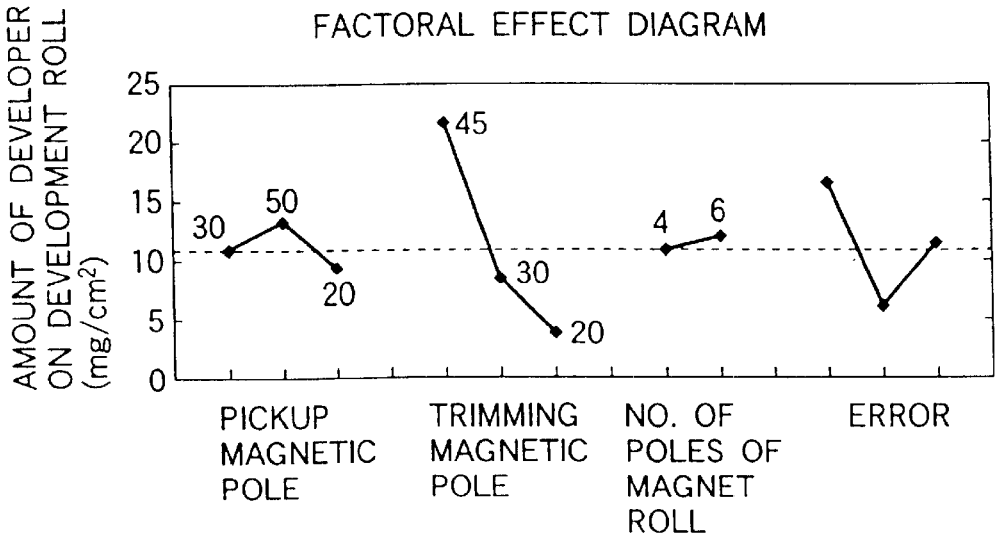
FIG. 25B is an explanatory diagram illustrating the factorial effect of an orthogonal test with respect to Example 2.

Under these conditions, the intensity (magnetic flux density) of the pickup magnetic pole, the intensity of the trimming magnetic pole, and the number of poles of the trimming magnetic pole were varied, as shown in FIG. 25B.

Consequently, the intensity (the magnitude of the magnetic flux density) of the magnetic pole referred to as the trimming magnetic pole in the drawing and acting on the upper side from the vicinity of the height of the rotational center of the development roll 22 on the opposite side of the development region is a major factor for determining the rate of developer transported. In addition, the phenomenon was clearly observed in which, in the region where the rate of developer transported is low, the developer drops in the vicinity of the height of the rotational center of the development roll 22 and a thin layer is formed on its downstream side.

That is, it is conceivable that because the magnetically attracting force acting on the upper side from the vicinity of the height of the rotational center on the surface of the development roll 22 weakens, the force for holding the developer weakens, and the developer drops, but since the weaker the magnetically attracting force of the portion referred to as the trimming magnetic pole in FIG. 25A, the more the portion where the force for upwardly transporting the developer and the gravity are balanced approaches the surface of the development roll 22, the layer becomes thinner, and the rate of developer transported becomes low.

Example 3

In the developing unit in accordance with the second embodiment, the development roll 22 having a diameter of 30 mm and a surface roughness Rz of 8 to 10 μm was used, the amount of developer and the distance between the development roll and the lower portion of the development housing were adjusted so that all the developer would be released (picked off) and captured (picked up) again on the lower side, and the development roll 22 was rotated continuously for 30 seconds at the surface speed of 300 mm/sec.

As the developer, one was used in which a ferrite carrier with a saturation magnetization of 60 emu/g and a volume average particle size of approx. 50 μm and a polyester toner with an average particle size of approx. 7.5 μm, which were subjected to charging adjustment by using a carrier coating agent and toner external additives, were mixed to a toner density of 8%.

The respective positions of the magnetic poles ad their intensities were selected so that the rate of development transported became 300 to 400 g/m$^2$. The respective magnetic flux densities (solid line: component in the normal direction; dotted line: component in the tangential direction) and the angular positional relationship are shown in FIG. 26.

Figure 26:
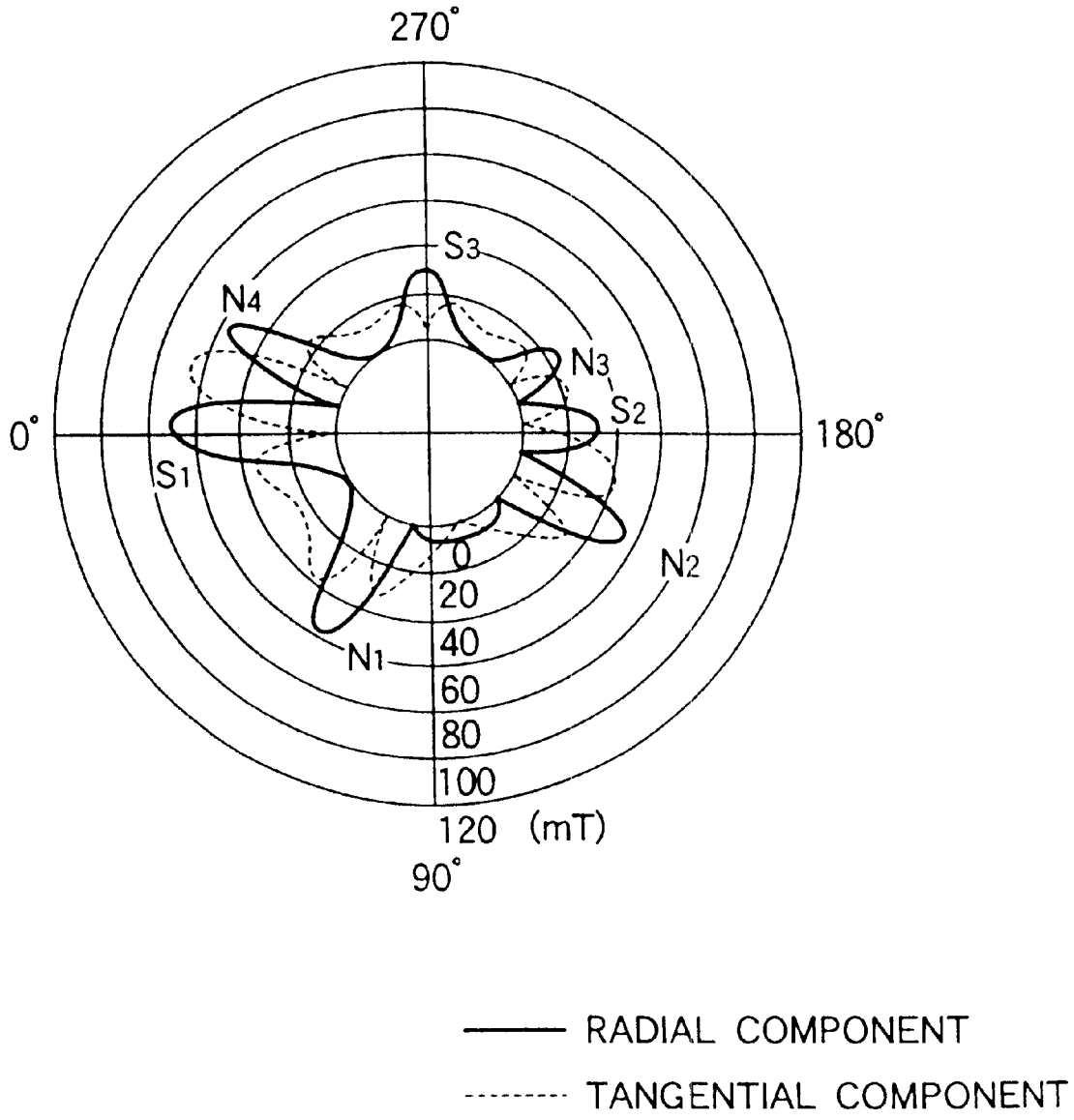
FIG. 26 is an explanatory diagram illustrating the magnetic force distribution of the magnetic poles of the magnet roll in accordance with Example 3.

It should be noted that, in FIG. 26, the angle is expressed in the direction of flow of the developer by setting as 0.° the horizontal plane passing through the rotational center of the development roll 22 in the development region.

Example 4

The development roll 22 similar to that of Example 3 was used in the developing unit (type in which the screw augers and the transport paddle are not used) in accordance with the third embodiment.

Comparative Example 2

Figure 28:
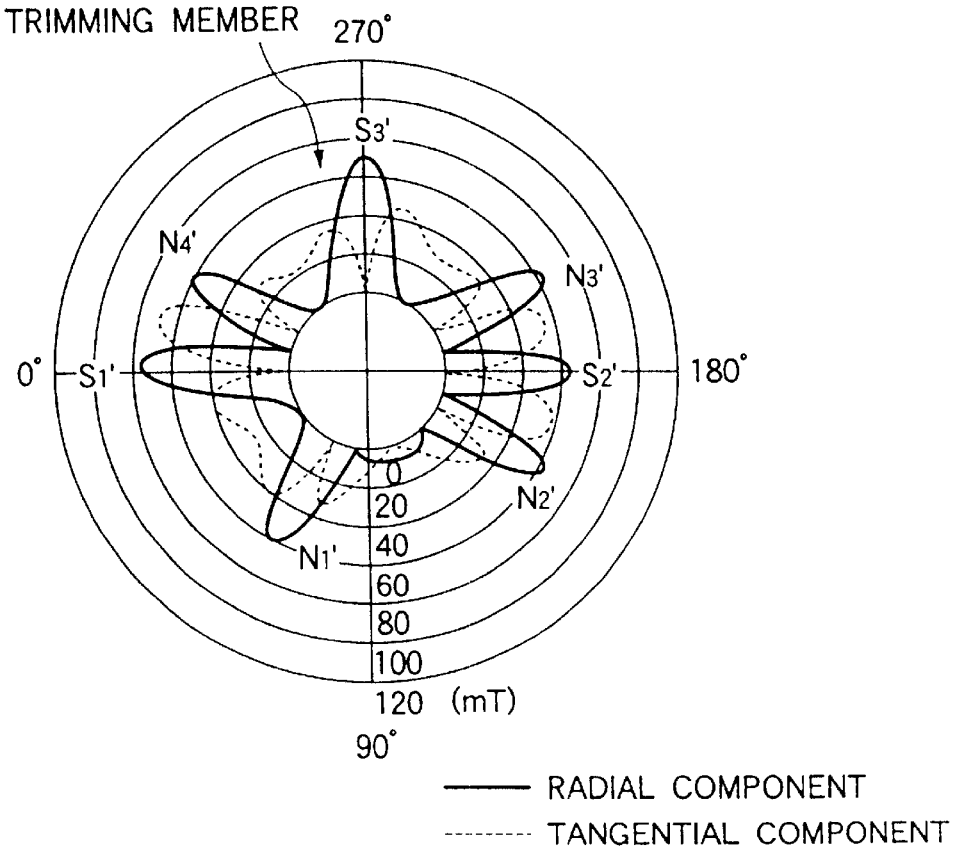
FIG. 28 is an explanatory diagram illustrating the magnetic force distribution of the magnetic poles of the magnet roll in accordance with Comparative Example 2.

A development roll having a diameter of 30 mm and a surface roughness Rz of 8 to 10 $\mu$m was used, the trimming member was attached with a gap of 0.75 mm, the layout of the magnetic poles of the development roll was set as shown in FIG. 28, and the conditions similar to those of Example 3 were used. It should be noted that the position of the trimming member was set to 282.° in the direction of flow of the developer by setting as 0.° the horizontal plane passing through the rotational center of the development roll on the development region side.

Figure 30:
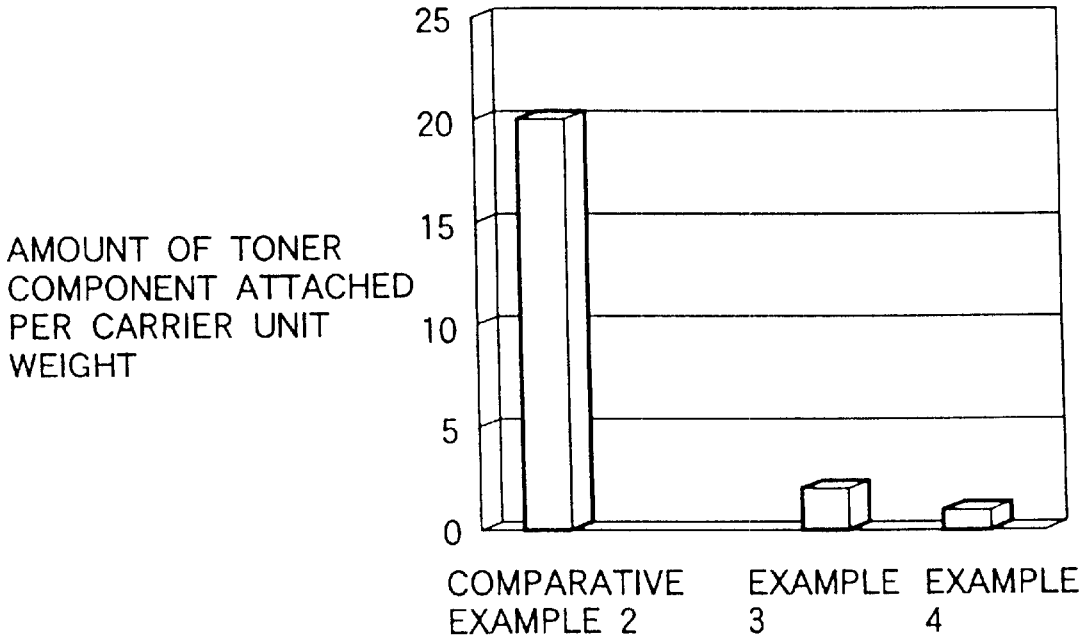
FIG. 30 is an explanatory diagram illustrating the results of examination of the rate of fixation of the toner on carrier surfaces in the developer used in Examples 3 and 4 and Comparative Example 2.

When the total amount (%) of the toner component fixed on the carrier surfaces was examined with respect to Examples 3 and 4 and Comparative Example, as shown in FIG. 30, it can be understood that the amount of the toner component fixed was remarkably small in Examples 3 and 4 as compared to Comparative Example 2.

In addition, in the case of Example 4, it can be understood that the amount of the toner component fixed on the carriers was further smaller than in Example 3 since agitating members such as screw augers were not used.

Incidentally, in FIG. 30, in the measurement of the amount fixed, the developer was placed in an aqueous solution of a surface active agent and was agitated, and after the toner and the carrier were separated, the component on the carrier surfaces was determined.

Example 5

The results of an experiment conducted on the basis of a developing unit model in accordance with the fourth embodiment are shown.

In this example, a hollow Al roll having a diameter of 30 mm and a surface roughness Rz of 5 to 8 $\mu$m was used as the development roll 22. As the magnetic poles, an arrangement in which five magnetic poles were arranged was used, including the development magnetic pole S1 with 76 mT the pair of magnetic poles of the same polarity N1 and N2 (N2: functioning as the pickup magnetic pole), the transporting magnetic pole N3 with 60 mT, and the trimming magnetic pole S2 with 30 mT.

As the charging projecting member 40, a plate on which wooden needles with a diameter of 0.3 mm were disposed with a density of 20 needles/cm$^2$, and which had a width w of 0.5 mm along the advancing direction of the development roll, was used. An arrangement was adopted in which this plate was brought into contact with the surface of the development roll 22 at the position opposing the trimming magnetic pole S2 on the development roll 22. It should be noted that the wooden needles were arranged such that the rows of the wooden needles arranged in the axial direction of the development roll 22 were staggered along the advancing direction of the development roll 22.

As for the developer, a negatively charged toner with a weight average diameter of 5 $\mu$m or more was used as the nonmagnetic toner, and a semiconductive carrier with a weight average diameter of 20 to 100 $\mu$m was used as the magnetic carrier.

In addition, the peripheral speed of the development roll was set to 320 mm/s, the density of the toner in the developer was 10 wt. %, and the rate of developer transported was 250 g/m$^2$.

Figure 31:
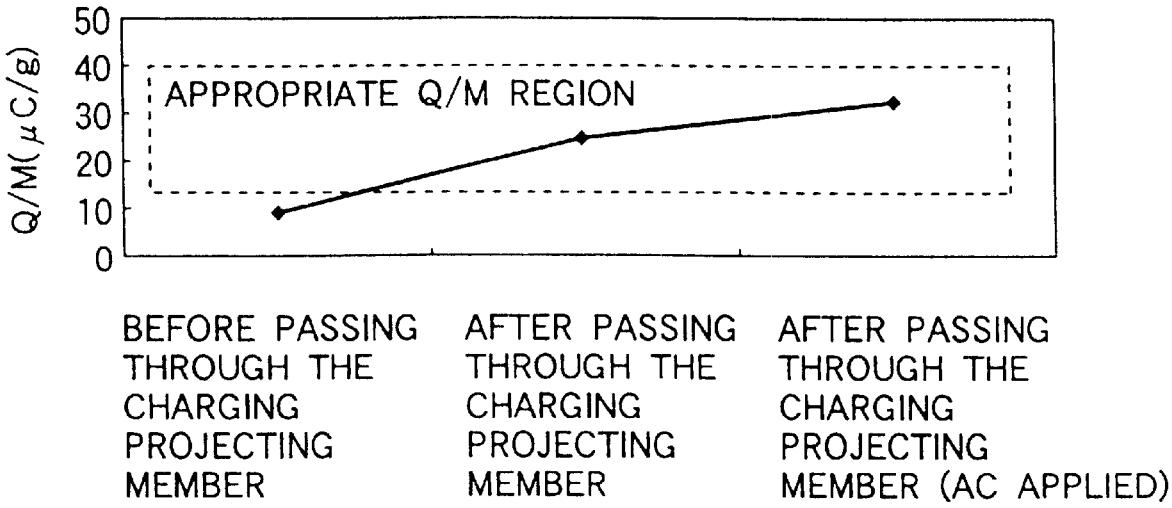
FIG. 31 is an explanatory diagram illustrating the effect of charging by the charging projecting member in Example 5.

FIG. 31 shows the results of measurement of the quantity charged per unit mass Q/M [$\mu$C/g] of the toner before impinging upon the charging projecting member 40 sampled in the vicinity of the pickup magnetic pole N2 on the development roll 22 and the toner after passing through the charging projecting member sampled in the vicinity of the development magnetic pole S1.

According to this diagram, it can be appreciated that the quantity of toner charged after passing through the charging projecting member 40 fell within an appropriate Q/M range of −15 to −40 $\mu$C/g. Further, when an alternating electric field with a frequency f of 1.5 kHz and an amplitude Vpp of 1.5 kV was applied between the charging projecting member 40 and the development roll 22, it was possible to confirm a further charging effect on the developer.

Figure 32:
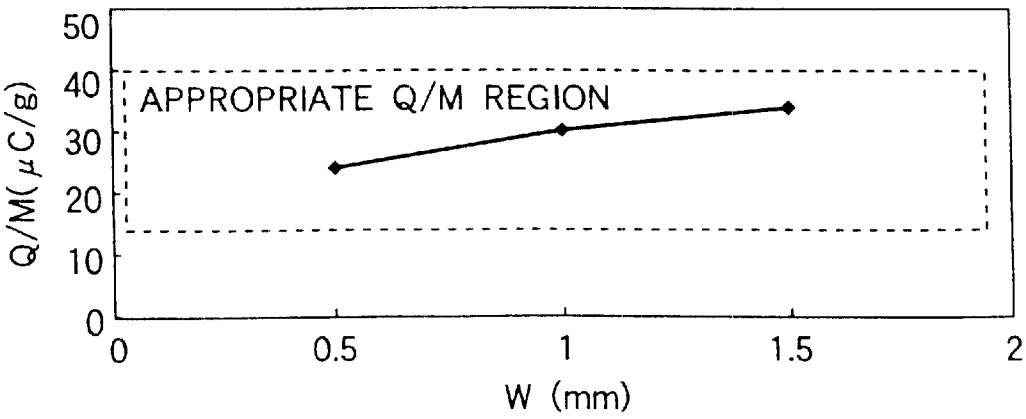
FIG. 32 is an explanatory diagram illustrating the relationship between the width of the charging projecting member in Example 5 and the charging effect.

In addition, FIG. 32 shows the results of measurement of the quantity charged per unit mass Q/M [$\mu$C/g] of the toner after passing through the charging projecting member 40 in a case where the width w of the charging projecting member 40 along the advancing direction of the development roll 22 was set to 1.0 mm and 1.5 mm.

According to the diagram, it was possible to confirm that the wider the width of the charging projecting member 40 along the advancing direction of the development roll 22 and the larger the area for causing convection in the developer, the more the charging efficiency of the developer improves.

Then, as shown in FIG. 14, as the leveling member 47, a PET sheet with a thickness of 100 $\mu$m was opposed to the transporting magnetic pole 25*e* (N3) on the downstream side, in the rotating direction of the development roll 22, of the aforementioned charging projecting member 40, and solid development was effected on the recording material.

Figure 33:
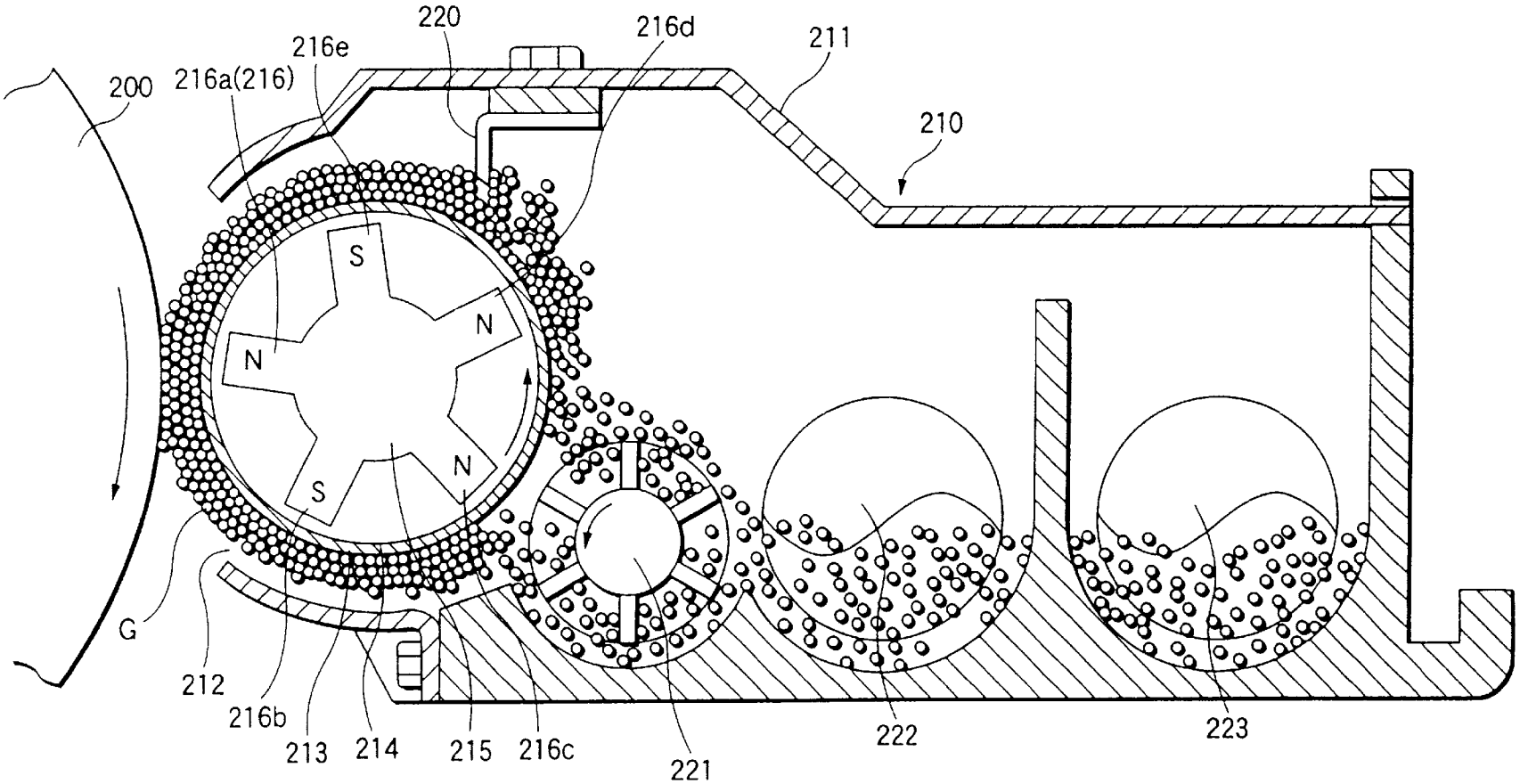
FIG. 33 is an explanatory diagram illustrating one example of a conventional developing unit.
Figure 34:
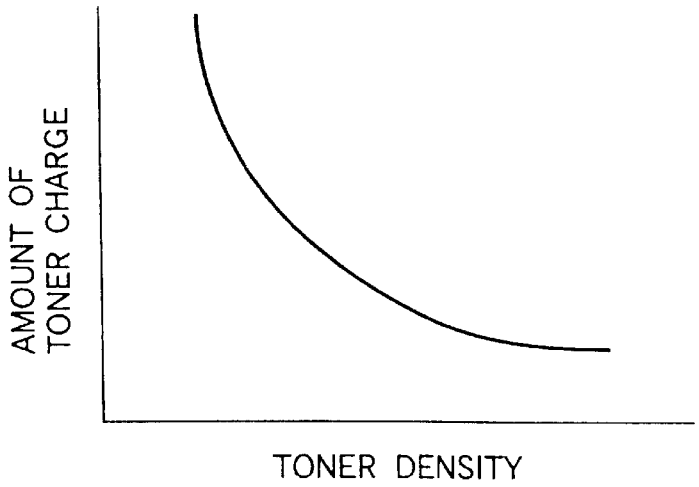
FIG. 34 is an explanatory diagram illustrating the relationship between the toner density and the amount of toner charge.
Figure 35:
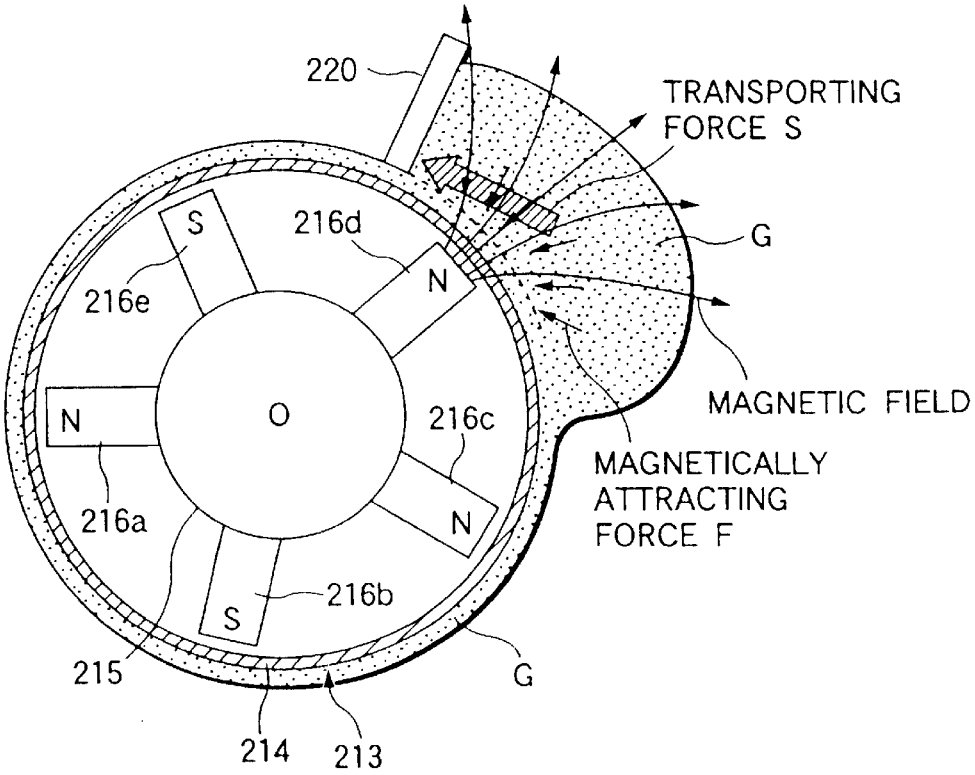
FIG. 35 is an explanatory diagram illustrating the behavior of the developer in the vicinity of the trimming member of a conventional developing unit.

Here, when a comparison was made with a developing unit serving as a comparative example and having the trimming member 220 and screw augers 222 and 223, as shown in FIG. 33, and an evaluation was made on the image uniformity of the solid images through visual observation, it was confirmed that image quality equivalent to that of the comparative example can be obtained.

Further, the development roll was continued to rotate for a time duration equivalent to the printing of 30,000 sheets or thereabouts using this configuration, the quantity of toner charged did not drop.

Example 6

In the developing unit in accordance with the fifth embodiment, the layout of the magnetic poles at the time of development of the magnet roll 124 is set as a pattern in which the developer is present in a large quantity from the position of a lowest end of the development roll 122 up to the vicinity of the height of the rotational center in the rotating direction of the development roll 122, and the developer assumes a thin layer in the remaining portion.

In this example, the difference in the magnetic field between the pickup magnetic pole 125*c* (N1) and the trimming magnetic pole 125*d* (S2) is large, and the trimming magnetic pole 125*d* has a weak magnetic field. Therefore, of the developer transported by the pickup magnetic pole 125*c*, only a limited quantity of developer is transported to the trimming magnetic pole 125*d* side, and the remaining developer is returned to the developer storage section 134 by the gravity.

In the case where such a development roll 122 is used, by rotating the magnet roll 122 to the upstream side by 5 to 30° or thereabouts (e.g., rotating it by 15°) at the time of nondevelopment, the developer G is not supplied to the trimming magnetic pole 125*d* by the gravity and all of it drops. Thus, it becomes possible to restrict the transport of the developer to the development region m without stopping the rotation of the development roll 122.

[Advantages of the Invention]

As described above, in accordance with one aspect of the invention, in a two-component developing unit, by devising the layout of the magnetic poles (particularly the pickup magnetic pole and the trimming magnetic pole) of the magnet member arranged inside the developer carrier, an excess portion of the developer picked up onto the surface of the developer carrier is allowed to drop in the vicinity of the height of the rotational center of the developer carrier, and only the developer restricted to a predetermined layer thickness is carried and transported to the development region. Therefore, the layer thickness of the developer on the developer carrier can be restricted without using a conventional trimming member.

For this reason, it is possible to accurately restrict the thickness of the developer layer carried on the developer carrier without imparting undue stresses to the developer.

In addition, in the invention, since it is unnecessary to use the trimming member, it is possible to dispose, for instance, a charging member by making use of the installation space for the trimming member in the space surrounding the developer carrier.

In this mode, since the developer can be charged by a charging member, even if agitating members such as screw augers are not disposed inside the development housing, it becomes possible to charge the developer. Hence, the decline in the life of the developer due to the agitating members can be controlled, and the developing unit can be made compact correspondingly.

In addition, in accordance with another aspect of the invention, in the two-component developing unit, the layout of the magnetic poles of the magnet member arranged inside the developer carrier is set variably between the time of development and the time of nondevelopment, and the amount of developer carried on the surface of the developer carrier and transported to the development region is set to substantially zero at the time of nondevelopment. Therefore, it is possible to stop the supply of the developer to the development region without imparting undue stresses to the developer at the time of nondevelopment.

For this reason, in, for example, a four-cycle type image forming apparatus, even in the mode in which respective color-component images are consecutively formed on a common latent image carrier, the developer can be supplied to the development region only with respect to the developing unit set in the development mode, whereas the supply of the developer to the development region can be stopped with respect to the developing units set in the nondevelopment mode. Therefore, it is possible to effectively avoid the so-called color mixing in which other color-component toners are mixed in in the respective color-component development processes.

What is claimed is:

1. A developing unit comprising:

a development housing with an opening for development formed therein in such a manner as to oppose a latent image carrier, a developer carrier disposed in face-to-face relation to said opening for development, and two-component developer having a magnetic carrier and a toner is carried on a surface of said developer carrier, so as to convert an electrostatic latent image on said latent image carrier into a visible image in a development region opposing said latent image carrier of said developer carrier, wherein said developer carrier comprises:

a development sleeve for carrying the two-component developer and disposed rotatably so as to rotate from an upper side toward a lower side in the development region, and a magnet member which is fixedly provided inside said development sleeve and in a periphery of which a plurality of magnetic poles are arranged, and said magnet member comprises:

a development magnetic pole disposed at a position corresponding to the development region and contributing to development, a pickup magnetic pole disposed in a region which is located on a lower side than the height of a rotational center of said development sleeve in a region where said development sleeve in terms of its rotating direction is headed from the lower side toward the upper side, and adapted to capture the developer inside said development housing onto a surface of said development sleeve, and a trimming magnetic pole disposed on a downstream side, in the rotating direction of said development sleeve, of said pickup magnetic pole and adapted to cause a portion of the developer captured by said pickup magnetic pole to drop.

2. The developing unit according to claim 1, wherein said trimming magnetic pole has a weaker magnetic field than said pickup magnetic pole.

3. The developing unit according to claim 1, wherein said trimming magnetic pole is disposed at a position higher than the height of the rotational center of said development sleeve.

4. The developing unit according to claim 1, wherein said magnet member comprises:

a transporting magnetic pole disposed between said trimming magnetic pole and said development magnetic pole in the rotating direction of said development sleeve and adapted to transport the developer with the layer thickness restricted by said trimming magnetic pole.

5. The developing unit according to claim 1, further comprising:

a dropping assisting mechanism for causing an excess portion of the developer captured on the surface of said development sleeve by said pickup magnetic pole to drop on the lower side than the height of the rotational center of said development sleeve.

6. The developing unit according to claim 1, further comprising:

a sealing member for sealing a gap between said development housing and the developer layer over a periphery of said developer carrier on which the developer with the layer thickness restricted by said trimming magnetic pole is transported to the development region.

7. The developing unit according to claim 1, further comprising:

a developer supplying member for supplying the developer disposed inside said development housing at a portion of said developer carrier corresponding to said pickup magnetic pole.

8. The developing unit according to claim 1, wherein magnetic poles of different polarities are arranged alternately in said magnet member.

9. The developing unit according to claim 1, further comprising:

an agitating member for agitating the developer disposed in said development housing.

10. The developing unit according to claim 1, wherein only said developer carrier is disposed in said development housing.

11. The developing unit according to claim 1, further comprising:

a guide portion for guiding the developer dropping from said developer carrier toward a developer storage section disposed in said development housing.

12. The developing unit according to claim 1, further comprising:

a leveling member for leveling the developer layer over a periphery of said developer carrier on which the developer with the layer thickness restricted by said trimming magnetic pole is transported to the development region.

13. The developing unit according to claim 1, further comprising:

a charging member for charging the developer over a periphery of said developer carrier on which the developer with the layer thickness restricted by said trimming magnetic pole is transported to the development region.

14. A developing unit comprising:

a development housing with an opening for development formed therein in such a manner as to oppose a latent image carrier, a developer carrier disposed in face-to-face relation to the opening for development, and a two-component developer having a magnetic carrier and a toner is carried on a surface of said developer carrier, so as to convert an electrostatic latent image on said latent image carrier into a visible image in a development region opposing said latent image carrier of said developer carrier, wherein said developer carrier comprises:

a development sleeve for carrying the two-component developer and disposed rotatably so as to rotate from an upper side toward a lower side in the development region, and a magnet member which is fixedly provided inside said development sleeve and in a periphery of which a plurality of magnetic poles are arranged, said magnet member being so arranged that the layout of said magnetic poles is set variably between the time of development and the time of nondevelopment.

15. The developing unit according to claim 1, wherein said magnet member is so arranged that the layout of said magnetic poles is set variably between the time of development and the time of nondevelopment, and the amount of developer transported to the development region while being carried on the surface of said developer carrier is set to substantially zero at the time of nondevelopment.

16. The developing unit according to claim 1, wherein said magnet member is so arranged that the position of at least said trimming magnetic pole is set variably between the time of development and the time of nondevelopment, and the amount of developer whose layer thickness is restricted by said trimming magnetic pole is set to substantially zero at the time of nondevelopment.

17. An image forming apparatus comprising:

said developing unit according to claim 1.

18. An image forming apparatus comprising:

said developing unit according to claim 14.

* * * * *